US007831419B2

(12) United States Patent
Cariveau et al.

(10) Patent No.: US 7,831,419 B2
(45) Date of Patent: Nov. 9, 2010

(54) PDC DRILL BIT WITH CUTTER DESIGN OPTIMIZED WITH DYNAMIC CENTERLINE ANALYSIS HAVING AN ANGULAR SEPARATION IN IMBALANCE FORCES OF 180 DEGREES FOR MAXIMUM TIME

(75) Inventors: Peter Thomas Cariveau, Spring, TX (US); Bala Durairajan, Houston, TX (US); Sujian Huang, Beijing (CN)

(73) Assignee: Smith International, Inc., Houston, TX (US)

( * ) Notice: Subject to any disclaimer, the term of this patent is extended or adjusted under 35 U.S.C. 154(b) by 494 days.

(21) Appl. No.: 11/041,911

(22) Filed: Jan. 24, 2005

(65) Prior Publication Data

US 2006/0167669 A1 Jul. 27, 2006

(51) Int. Cl.
*G06G 7/48* (2006.01)
*E21B 10/00* (2006.01)

(52) U.S. Cl. ..... 703/7; 175/336

(58) Field of Classification Search ..... 703/7; 175/57, 336

See application file for complete search history.

(56) References Cited

U.S. PATENT DOCUMENTS

| | | | | |
|---|---|---|---|---|
| 4,475,606 | A | 10/1984 | Crow | |
| 4,815,342 | A | 3/1989 | Brett | |
| 4,932,484 | A | 6/1990 | Warren | |
| 5,010,789 | A | 4/1991 | Brett | |
| 5,042,596 | A | 8/1991 | Brett | |
| 5,131,478 | A | 7/1992 | Brett | |
| 5,178,222 | A | 1/1993 | Jones | |
| 5,213,168 | A * | 5/1993 | Warren et al. | 175/61 |
| RE34,435 | E | 11/1993 | Warren et al. | |
| 5,373,908 | A * | 12/1994 | Pastusek | 175/431 |
| 5,456,141 | A | 10/1995 | Ho | |
| 5,605,198 | A | 2/1997 | Tibbitts | |
| 5,613,093 | A | 3/1997 | Kolb | |
| 5,787,022 | A | 7/1998 | Tibbitts | |
| 5,803,196 | A | 9/1998 | Fielder | |
| 5,864,058 | A | 1/1999 | Chen | |
| 5,868,213 | A | 2/1999 | Cisneros et al. | |
| 5,903,743 | A | 5/1999 | Kolb | |
| 5,950,747 | A | 9/1999 | Tibbitts | |

(Continued)

FOREIGN PATENT DOCUMENTS

| | | | |
|---|---|---|---|
| BE | 1013217 | A6 | 10/2001 |
| CA | 2536684 | | 1/2005 |
| EP | 0467580 | A1 * | 7/1991 |
| EP | 0467580 | A1 * | 7/1991 |

(Continued)

OTHER PUBLICATIONS

Combined Search and Examination Report issued on corresponding British Application No. GB0601316.3; Dated Apr. 20, 2006; 9 pages.

(Continued)

*Primary Examiner*—Donald Sparks
*Assistant Examiner*—Ben M Rifkin
(74) *Attorney, Agent, or Firm*—Osha Liang LLP

(57) ABSTRACT

A method for designing a fixed cutter drill bit, includes simulating the fixed cutter drill bit drilling in an earth formation, determining radial and circumferential components of imbalance forces on the drill bit and a Beta angle between the radial and circumferential components of the imbalance forces during a period of simulated drilling, and adjusting a value of at least one design parameter for the fixed cutter drill bit at least based upon the Beta angle. To facilitate drill bit design, the Beta angel can be displayed to a drill bit designer. To improve performance, the method can include repeating the simulating, determining, and adjusting to change a simulated performance of the fixed cutter drill bit. A drill bit may be made according to the design resulting from the method.

22 Claims, 26 Drawing Sheets

U.S. PATENT DOCUMENTS

| | | | | |
|---|---|---|---|---|
| 6,021,377 | A | 2/2000 | Dubinsky et al. | |
| 6,021,859 | A | 2/2000 | Tibbitts | |
| 6,039,131 | A | 3/2000 | Beaton | |
| 6,095,262 | A | 8/2000 | Chen | |
| 6,213,225 | B1 | 4/2001 | Chen | |
| 6,233,524 | B1 * | 5/2001 | Harrell et al. | 702/9 |
| 6,241,034 | B1 | 6/2001 | Steinke et al. | |
| 6,269,893 | B1 | 8/2001 | Beaton | |
| 6,349,595 | B1 | 2/2002 | Civolani et al. | |
| 6,401,839 | B1 | 6/2002 | Chen | |
| 6,412,577 | B1 * | 7/2002 | Chen | 175/57 |
| 6,435,058 | B1 | 8/2002 | Matthias | |
| 6,516,293 | B1 | 2/2003 | Huang | |
| 6,536,543 | B2 | 3/2003 | Meiners | |
| 6,695,073 | B2 | 2/2004 | Glass | |
| 6,711,969 | B2 | 3/2004 | Meiners | |
| 6,729,420 | B2 | 5/2004 | Mensa-Wilmot | |
| 7,258,175 | B2 | 8/2007 | Veeningen et al. | |
| 2003/0178232 | A1 | 9/2003 | Mensa-Wilmot | |
| 2004/0000430 | A1 * | 1/2004 | King | 175/24 |
| 2004/0238219 | A1 * | 12/2004 | Nichols et al. | 175/57 |
| 2005/0133272 | A1 | 6/2005 | Huang et al. | |

FOREIGN PATENT DOCUMENTS

| | | | |
|---|---|---|---|
| EP | 0 467 580 | A1 | 1/1992 |
| EP | 0728912 | A2 | 8/1996 |
| EP | 0972908 | A2 | 1/2000 |
| EP | 1146200 | A1 | 10/2001 |
| GB | 2241266 | A | 8/1991 |
| GB | 2300208 | A | 10/1996 |
| GB | 2339815 | A | 2/2000 |
| GB | 2346628 | A | 8/2000 |
| GB | 2357534 | A | 6/2001 |
| GB | 2367843 | A | 4/2002 |
| GB | 2379699 | A | 3/2003 |
| SU | 933932 | | 6/1982 |
| SU | 1461855 | A1 | 2/1989 |
| SU | 1654515 | A1 | 7/1991 |
| SU | 1691497 | A1 | 11/1991 |
| WO | WO 00/12859 | | 3/2000 |
| WO | WO 00/12860 | | 3/2000 |
| WO | WO-01/33027 | A2 | 5/2001 |
| WO | WO-02/077407 | A1 | 10/2002 |

OTHER PUBLICATIONS

D. Ma, et al. "Dynamics of Roller Cone Bits", Journal of Energy Resources Technology, Dec. 1985, vol. 107 (pp. 543-548).
RockBit International, "System Designed to Speed Continuous Coring Operation", (4 pages).
B. L Steklyanov, et al.; "Improving the effectiveness of Drilling Tools"; KhM-3 Oil Industry Machine Building; (1991) pp. 1-35.
Society of Petroleum Engineers Paper No. 71053, "Development and Application of a New Roller Cone Bit with Optimized Tooth Orientation", S. L. Chen, et al., presented May 21-23, 2001 (15 pages).
Hancke, G. P. The Effective Control of a Deep Hole Diamond Drill, Conference REcord of the IEEE Industry Applications Society Annual Meeting, 1991, pp. 1200-1205.
Ertunc, et al., H. M. Real Time Monitoring of Tool Wear Using Multiple Modeling Method, IEEE International Electric Machines and Drives Conference, IEMDC 2001, pp. 687-691.
Society of Petroleum Engineers Paper No. 56439, "Field Investigation of the Effects of Stick-Slip, Lateral, and Whirl Vibrations on Roller Cone Bit Performance", S.L. Chen, et al., presented Oct. 3-6, 1999, (10 pages).
Sandvik Rock Bits, "Sandvik in teh World of Oil and Gas" (8 pages).
Robert L. McIntyre, "Surface Mine Rotary Drilling", Smith-Gruner (3 pages).
Translation of Description of Invention No. 933932 dated Jun. 7, 1982.
Glowka, David A., "Use of Single-Cutter Data in the Analysis of PDC Bit Designs: Part 1—Development of a PDC Cutting Force Model"; JPT, Aug. 1989 (pp. 797-799, 844-849).
Glowka, et al., "Progress in the Advanced Synthetic-Diamond Drill Bit Program"; ASME International (pp. 87-95).
International Search Report dated Nov. 22, 2004, (6 pages).
D. Ma, et al. "A New Way to Characterize the Gouging-Scraping Action of Roller Cone Bits", Society of Petroleum Engineers, 1989 (24 pgs.).
RockBit International, "If You've Ever Doubted RBI's Ability to Drill at a Lower Cost Per Foot . . . Ask the Folks Drilling This Well", (4 pages).
Dekun Ma, et al.; "The Computer Simulation of the Interaction Between Roller Bit and Rock"; International Meeting on Petroleum Engineering; PR China; Nov. 14-17, 1995; pp. 309-317.
Society of Petroleum Engineers Paper No. 71393, "Development and Field Applications of Roller Cone Bits with Balanced Cutting Structure", S. L. Chen, et al., presented Sep. 30-Oct. 3, 2001 (11 pages).
Howie, et al., W. L. A Smart Bolter for Improving Entry Stability, Conference Record of the IEEE Industry Applications Society Annual Meeting, 1989, pp. 1556-1564.
Hancke, et al., G.P. A Control System for Optimizing Deep Hole Drilling Conditions, IECON 1991 International Conference on Industrial Electrionics, Control and Instrumentation, 1991, pp. 2279-2284.
Ma Dekun, et al., "The Operational Mechanics of The Rock Bit", Petroleum Industry Press, 1996, pp. 1-243.
RockBit International, "The Leader in High-Speed Drill Bit Technology" (24 pages).
Boris L. Steklianov, "Increasing the Efficiency of Rock-Cutting Tools on the Basis of Comparative Analysis of the Kinetic Characteristics of Their Cutting Structure"; NDERI, 1990 (24 pages).
Certification and Notarization dated Nov. 12, 2003 from Universe Technical Translation.
Glowka, D.A., "Use of Single-Cutter Data in the Analysis of PDC Bit Designs: Part 2—Development and Use of the PDCWEAR Computer Code", JPT, Aug. 1989 (pp. 850-859).
Canadian Intellectual Property Office, Office Action with cited reference dated Apr. 25, 2007, Canadian Application No. 2,532,753.
Cooley et al, "The Design and Testing of Anti-Whirl Bits", SPE 24586, 1992 (10 pages).
Ho, H-S, "Prediction of Drilling Trajectory in Directional Wells Via a New Rock-Bit Interaction Model", SPE 16658, 1987 (13 pages).
Brakel et al, "Prediction of Wellbore Trajectory Considering Bottomhole Assembly and Drill-Bit Dynamics", SPE Drilling Engineering, Jun. 1989 (10 pages).
Office Action dated Feb. 27, 2007 for corresponding U.S. Appl. No. 11/041,910 (20 pages).
U.S. Office Action dated Aug. 3, 2007, for corresponding U.S. Appl. No. 11/041,910.
U.S. Office Action dated Jun. 23, 2008 for related U.S. Appl. No. 11/041,910, (15 pages).
Hanson, et al., "Dynamics of Modeling of PDC Bits", SPE/IADC 29401, Feb. 28-Mar. 2, 1995.
Brett, et al., "A Method of Modeling the Directional Behaviro of Bottomhole Assemblies Including Those with Bent Subs and Downhole Motors", IADC/SPE 14767, Feb. 10-12, 1986.
Menand , et al., "How the Bit Profile and Gages Affect the Well Trajectory", IADC/SPE 74459, Feb. 26-28, 2002.
Christoforou, et al., "Dynamic Modelling of Rotating Drillstrings with Borehole Interactions", Journal of Sound and Vibration, 206(2) pp. 243-260, 1997.
U.S. Office Action for related U.S. Appl. No. 11/041,910, dated Nov. 21, 2008, (14 pages).
Al-Hiddabi, et al., "Non-linear control of torsional and bending vibrations of oilwell drillstrings", Journal of Sound and Vibration, 265, 203, pp. 401-415.
Office Action issued in related Canadian Application No. 2,532,753 dated Mar. 11, 2010 (4 pages).
Canadian Office Action for Canadian Application No. 2,532,753, dated Mar. 6, 2008, (3 pages).

* cited by examiner

PDC DRILL BIT WITH CUTTER DESIGN OPTIMIZED WITH DYNAMIC CENTERLINE ANALYSIS HAVING AN ANGULAR SEPARATION IN IMBALANCE FORCES OF 180 DEGREES FOR MAXIMUM TIME

CROSS-REFERENCE TO RELATED APPLICATIONS

This is an application for patent and is related to co-pending and co-owned U.S. patent application entitled "Methods For Designing Fixed Cutter Bits and Bits Made Using Such Methods" (U.S. patent application Ser. No. 10/888,523) filed on Jul. 9, 2004, U.S. patent application entitled "Methods For Modeling, Displaying, Designing, And Optimizing Fixed Cutter Bits (U.S. patent application Ser. No. 10/888,358) filed on Jul. 9, 2004, U.S. patent application entitled "Methods for Modeling Wear of Fixed Cutter Bits and for Designing and Optimizing Fixed Cutter Bits," (U.S. patent application Ser. No. 10/888,354) filed on Jul. 9, 2004, and U.S. patent application entitled "Methods For Modeling, Designing, and Optimizing Drilling Tool Assemblies," (U.S. patent application Ser. No. 10/888,446), filed on Jul. 9, 2004, and U.S. patent application entitled "PDC Drill Bit With Cutter Design Optimized With Dynamic Centerline Analysis And Dynamic Centerline Trajectory," (U.S. patent application Ser. No. 11/041,910) filed concurrently herewith, all of which are expressly incorporated by reference in their entireties.

COPYRIGHT NOTICE

A portion of the disclosure of this patent document contains material which is subject to copyright protection. The copyright owner has no objection to the facsimile reproduction by anyone of the patent document or the patent disclosure, as it appears in the Patent and Trademark Office patent file or records, but otherwise reserves all copyright rights whatsoever.

STATEMENT REGARDING FEDERALLY SPONSORED RESEARCH OR DEVELOPMENT

Not applicable.

BACKGROUND OF THE INVENTION

1. Field of the Invention

The invention relates generally to fixed cutter drill bits used to drill boreholes in subterranean formations. More specifically, the invention relates to methods for modeling the drilling performance of a fixed cutter bit drilling through an earth formation, methods for designing fixed cutter drill bits, methods for optimizing the drilling performance of a fixed cutter drill bit, and to drill bits formed using such methods.

2. Background Art

Fixed cutter bits, such as PDC drill bits, are commonly used in the oil and gas industry to drill well bores. One example of a conventional drilling system for drilling boreholes in subsurface earth formations is shown in FIG. 1. This drilling system includes a drilling rig 10 used to turn a drill string 12 which extends downward into a well bore 14. Connected to the end of the drill string 12 is a fixed cutter drill bit 20.

As shown in FIG. 2, a fixed cutter drill bit 21 typically includes a bit body 22 having an externally threaded connection at one end 24, and a plurality of blades 28 extending from the other end of bit body 22 and forming the cutting surface of the bit 22. A plurality of cutters 29 are attached to each of the blades 28 and extend from the blades to cut through earth formations when the bit 21 is rotated during drilling. The cutters 29 deform the earth formation by scraping and shearing. The cutters 29 may be tungsten carbide inserts, polycrystalline diamond compacts, milled steel teeth, or any other cutting elements of materials hard and strong enough to deform or cut through the formation. Hardfacing (not shown) may also be applied to the cutters 29 and other portions of the bit 21 to reduce wear on the bit 21 and to increase the life of the bit 21 as the bit 21 cuts through earth formations.

Significant expense is involved in the design and manufacture of drill bits and in the drilling of well bores. Having accurate models for predicting and analyzing drilling characteristics of bits can greatly reduce the cost associated with manufacturing drill bits and designing drilling operations because these models can be used to more accurately predict the performance of bits prior to their manufacture and/or use for a particular drilling application. For these reasons, models have been developed and employed for the analysis and design of fixed cutter drill bits.

Two of the most widely used methods for modeling the performance of fixed cutter bits or designing fixed cutter drill bits are disclosed in Sandia Report No. SAN86-1745 by David A. Glowka, printed September 1987 and titled "Development of a Method for Predicting the Performance and Wear of PDC drill Bits" and U.S. Pat. No. 4,815,342 to Bret, et al. and titled "Method for Modeling and Building Drill Bits," and U.S. Pat. Nos. 5,010789; 5,042,596, and 5,131,478 which are all incorporated herein by reference. While these models have been useful in that they provide a means for analyzing the forces acting on the bit, their accuracy as a reflection of drilling might be improved because these models rely on generalized theoretical approximations (typically some equations) of cutter and formation interaction. A good representation of the actual interactions between a particular drill bit and the particular formation to be drilled is useful for accurate modeling. The accuracy and applicability of assumptions made for all drill bits. All cutters and all earth formations can affect the accuracy of the prediction of the response of an actual drill bit drilling in an earth formation, even though the constants in the relationship are adjusted.

In one popular model for drill bit design it is assumed that the centerline of the drill bit remains aligned with the centerline of the bore hole in which the drill bit is drilling. This type of centerline constrained model might be referred to as a "static model," even though the model calculates incremental dynamic rotation. The term static as applied to this type of modeling means not varying centerline alignment. In such prior modeling the "conventional wisdom" has been that a stable drill bit design is one with minimum imbalanced cutter forces and a Beta angle ($\beta$) between the radial and circumferential components of the resultant imbalance forces that is as small as possible. The theory is based upon vector addition such that for given magnitude imbalance force components, variation from a small $\beta$ angle to a larger $\beta$ angle will produce a smaller magnitude total imbalance force vector, even if the magnitudes of the components are not decreased. Thus, starting at a small $\beta$ angle should result in increased stability, because any increase in the $\beta$ angle tends to reduce the total imbalance force and moves the drill bit toward a low imbalance force (stable) condition.

A method is desired for modeling the overall cutting action and drilling performance of a fixed cutter bit that takes into consideration a more accurate reflection of the interaction between a drill bit, cutters of the drill bit, and an earth formation during drilling.

BRIEF SUMMARY OF THE INVENTION

The invention relates to methods for modeling the performance of fixed cutter bit drilling earth formations. The invention also relates to methods for designing fixed cutter drill bits and methods for optimizing drilling parameters for the drilling performance of a fixed cutter bit.

According to one aspect of one or more embodiments of the present invention, a method for modeling the dynamic performance of a fixed cutter PDC drill bit with the design optimized using a dynamic centerline analysis to provide an angular separation between the radial and circumferential components of resultant imbalance forces (the Beta angle) at or near 180 degrees ($\beta$=180°) for a maximum percentage of the time during drilling in earth formations.

In other aspects of the invention, the modeling method can include selecting a drill bit as a starting model to be simulated, selecting an earth formation to be represented as drilled, and simulating the drill bit drilling the earth formation. The simulation according to these aspects of the invention includes numerically rotating the bit, calculating bit interaction with the earth formation during the rotating, and determining the resultant imbalance forces and the resultant Beta angle between resultant radial and circumferential vector components of imbalanced forces acting at the center of the face of the drill bit during the rotation based on the calculated interaction of the selected drill bit with the selected earth formation. Empirical data for a drill bit and/or for a given earth formation can also be used to modify calculation coefficients to improve the accuracy of the calculations. Modifications to the design are made both to decrease the magnitude of the total resultant imbalance forces and to increase proportion of time that the Beta angle is at or near 180 during. Generally, an increased average Beta angle results from increasing the proportion of drilling time that the Beta angle is at or near 180 degrees ($\beta$=180°). It will be recognized that in this analysis the maximum $\beta$ angle will be 180° because two directly opposed vectors are at 180° to each other, and in all cases where the vectors are not opposed to each other at 180°, the angle between them is less than 180°.

In other aspects, the invention also provides a method dynamically modeling a drill bit during simulated drilling in an earth formation. "Dynamically modeling" as used in this disclosure means modeling a drill string without an assumed constraint that the centerline of the drill bit is aligned with the centerline of the hole bored into the earth formation. Thus, if the drill bit wobbles or gyrates at the end of a drill string during drilling, the dynamic model accounts for the increased depth of cut for certain cutters and the decreased depth of cut for other cutters. The centerline of the drill bit for dynamically modeling a drill bit is not arbitrarily constrained to align with the centerline of the bore hole. For improved accuracy the centerline of the drill bit is constrained by appropriately modeled physical and dynamic features of the drill string components, including the number of components, size, length, strength, modulus of elasticity of each component and of the connectors between components, contact of the components with the bore hole, impact forces, friction forces, and/or other features that may be associated with a given drill string configuration.

According to one alternative embodiment of the invention, a method includes generating a visual representation of a fixed cutter bit dynamically drilling in an earth formation, a method for designing a fixed cutter drill bit, and a method for optimizing the design of a fixed cutter drill bit. In another aspect, the invention provides a method for optimizing drilling operation parameters for a fixed cutter drill bit based upon a representation of the drill bit showing the Beta angle (angle) for the drill bit during dynamically simulated drilling rotation in an earth formation and modifying the drill bit design to increase the percentage of time during dynamic drilling that the Beta angle is at $\beta$=180°, as large as possible, or as near $\beta$=180° as possible.

In other aspects, the invention also provides a method for modeling a selected drill bit in a selected earth formation using static modeling (defined as modeling assuming that the centerline of the drill bit is aligned with the centerline of the hole bored into the earth formation) for purposes of determining wear predictions for the cutters of the drill bit, modifying the drill bit model according to the static wear model and dynamically modeling the drill bit with the static wear model characteristics substituted into the dynamic model calculations.

In other further aspects of the invention the Beta angle is determined for the wear modified dynamic model and the design is selected so that the Beta angle is at or near $\beta$=180° for a maximum period of time during drilling is obtained, so that a small diameter historic plot of the dynamic centerline trajectory is obtained, or so that a Beta angle or a dynamic centerline trajectory is obtained that meets a desired criteria.

In other aspects, the invention can also provide a method for modeling a selected drill bit in a selected earth formation, simulating the drill bit drilling in an earth formation, determining the Beta angle between the radial and the circumferential components of imbalance forces over a selected period of the simulated drilling, displaying a graphical depiction of the Beta angle over a period of time during drilling, modifying drill bit design parameters to increase the proportion of time the Beta angle is at or near 180° and repeating the simulating, determining, and displaying at least until the proportion of time the Beta angle is at or near 180° increases.

In other aspects, the invention can also provide a method for modeling a selected drill bit in a selected earth formation, simulating the drill bit drilling in an earth formation, determining the dynamic centerline trajectory over a selected period of the simulated drilling, displaying a graphical depiction of the dynamic centerline trajectory over a period of time during drilling, modifying drill bit design parameters to decrease the maximum diameter of the dynamic centerline trajectory or to modify the pattern of the displayed dynamic centerline trajectory and repeating the simulating, determining, and displaying at least until the maximum diameter of the dynamic centerline trajectory decreases or the pattern of the displayed dynamic centerline trajectory is modified.

In other aspects, the invention also provides a fixed cutter drill bit designed by the method of the invention.

Other aspects and advantages of the invention will be apparent from the following description and the appended claims.

DETAILED DESCRIPTION OF PREFERRED EMBODIMENTS

Figure 1:
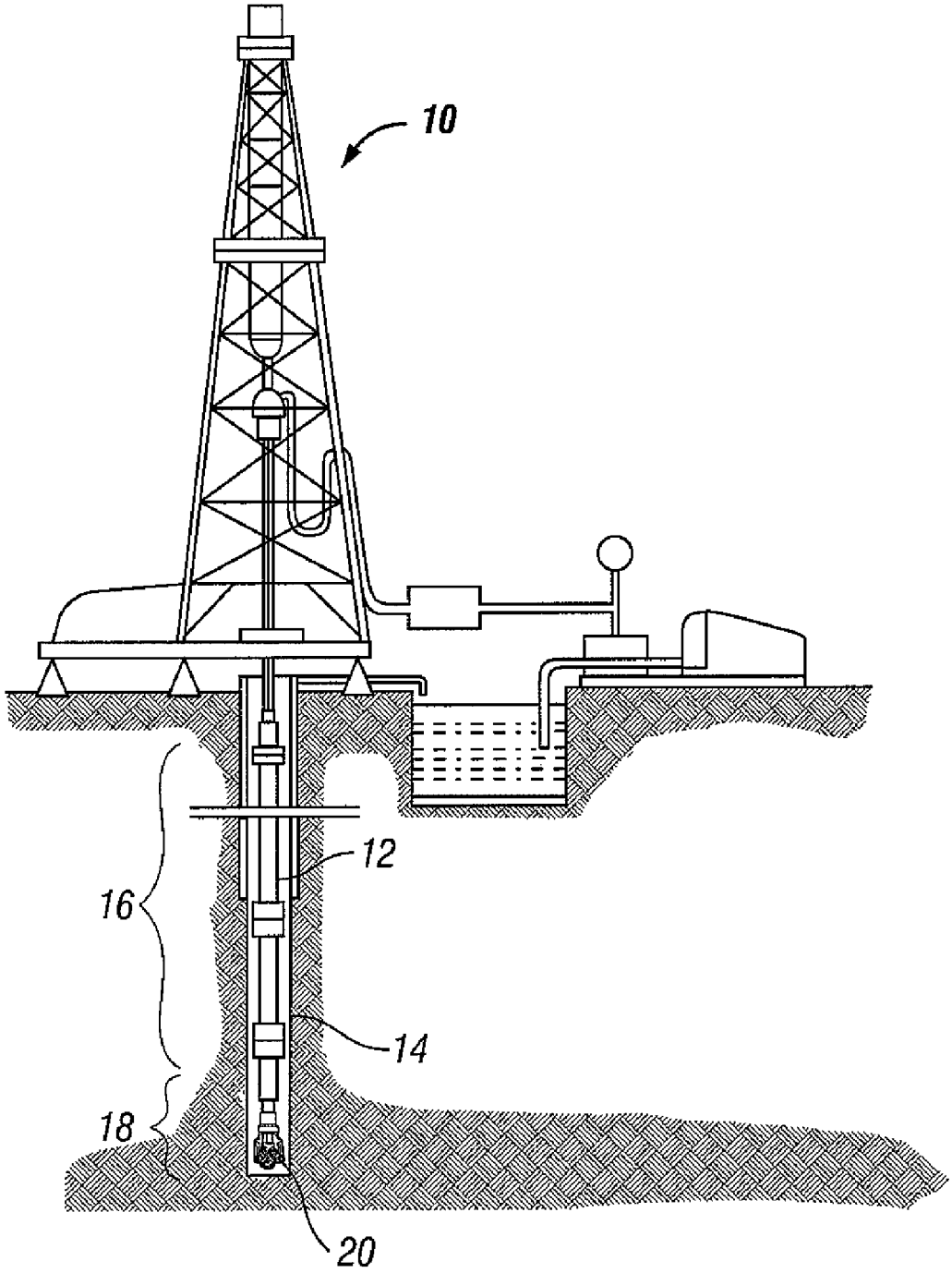
FIG. 1 (Prior Art)
FIG. 1 shows a schematic diagram of a conventional drilling system for drilling earth formations.
Figure 2:
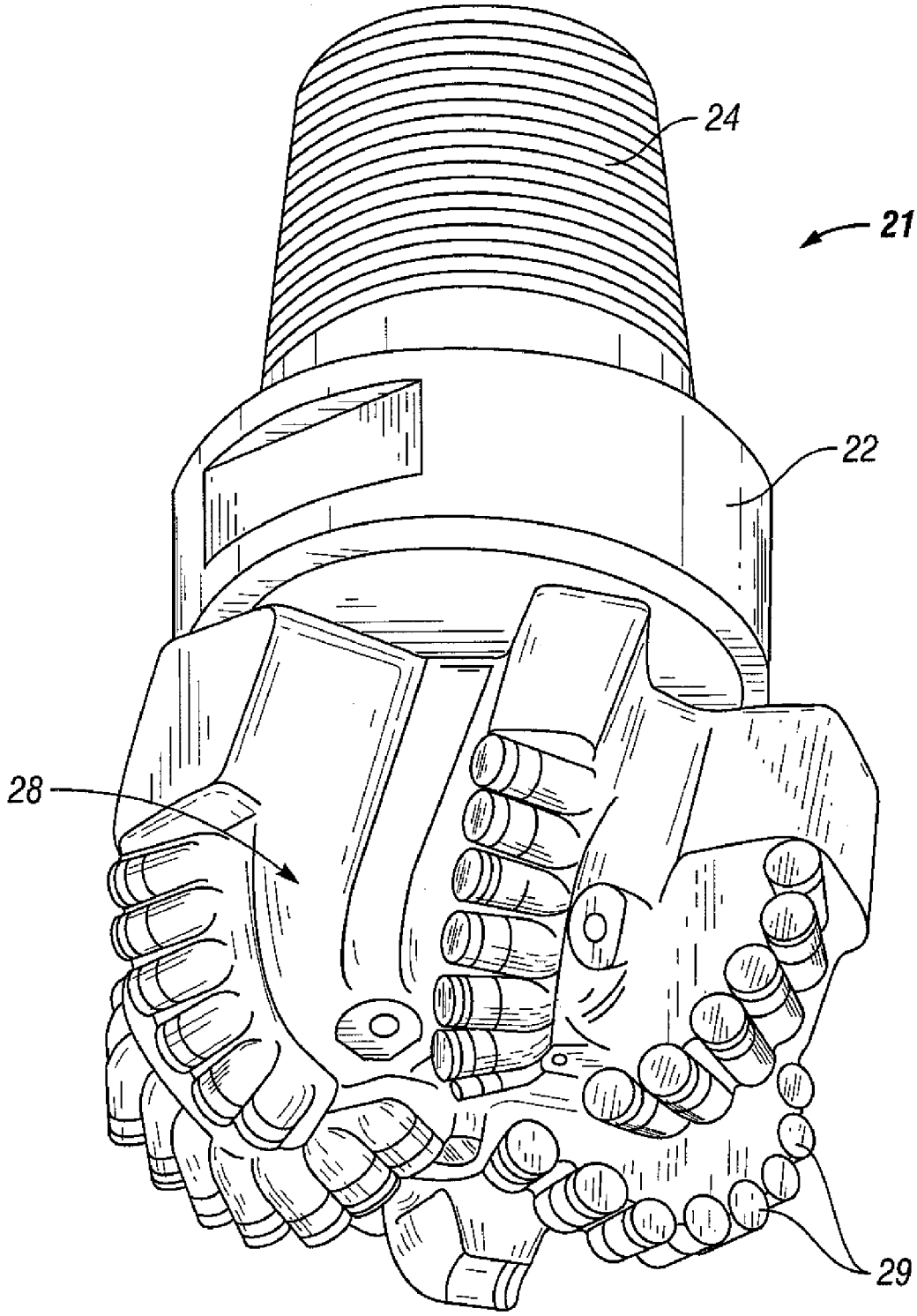
FIG. 2 (Prior Art)
FIG. 2 shows a perspective view of a prior art fixed-cutter bit.

The present invention provides methods for predicting the dynamic response of a drilling tool assembly drilling an earth formation, methods for optimizing a drilling tool assembly design, methods for optimizing drilling operation parameters, and methods for optimizing drilling tool assembly performance.

The present invention provides methods for modeling the performance of a fixed cutter drill bit drilling in an earth formation. In one aspect, a method takes into account actual interactions between cutters and earth formation during drilling. Methods in accordance with one or more embodiments of the invention may be used to design a fixed cutter drill bit, to optimize the performance of the drill bit, to optimize the dynamic response of the drill bit in connection with an entire drill string during drilling, or to generate visual displays representing performance characteristics of the drill bit drilling in an earth formation. In one particular embodiment, the invention usefully provides a representation of radial and circumferential imbalance force components and a Beta (β) angle between such components during simulated drilling.

In accordance with one aspect of the present invention, one or more embodiments of a method for modeling the dynamic performance of a fixed cutter drill bit drilling in an earth formation include selecting a drill bit design and an earth formation to be represented as drilled, wherein a geometric model of the drill bit, a geometric model of a drill string on which the drill bit is to be supported for drilling, and a geometric model of the earth formation to be represented as drilled are generated. The method also includes incrementally rotating the drill string and the drill bit to simulate drilling in the formation and calculating the interaction between the cutters on the drill bit and the earth formation during the incremental rotation. The method further includes determining the forces on the cutters of the drill bit during the incremental rotation, determining the interaction between the drill bit and the earth formation, and determining resultant radial and circumferential components of imbalance forces acting on the drill bit and the Beta angle between such imbalance force components during a period of full or partial rotation of the drill bit in the formation. By graphically displaying at least a representation of the Beta angle for a drill bit during drilling, a design of a drill bit can be obtained that provides useful performance characteristics.

Methods for determining the dynamic response of a drilling tool assembly to drilling interaction with an earth formation were initially disclosed in U.S. Pat. No. 6,785,641 by Huang, which is assigned to the assignee of the present invention and incorporated herein by reference in its entirety. New methods developed for modeling fixed cutter drill bits are disclosed in U.S. Patent Application No. 60/485,642 by Huang, filed on Jul. 9, 2003, titled "Method for Modeling, Designing, and Optimizing Fixed Cutter Bits," assigned to the assignee of the present application and incorporated herein by reference in its entirety. Methods disclosed in the '642 application may advantageously allow for a more accurate prediction of the actual performance of a fixed cutter bit in drilling selected formations by incorporating the use of actual cutting element/earth formation interact data or related empirical formulas to accurately predict the interaction between cutting elements and earth formations during drilling. Embodiments of the invention disclosed herein relate to the use of methods disclosed in the '299 combined with methods disclosed in the '642 application and other novel methods related to drilling tool assembly design.

FIG. 1 shows one example of a drilling tool assembly that may be designed, modeled, or optimized in accordance with one or more embodiments of the invention. The drilling tool assembly includes a drill string 16 coupled to a bottomhole assembly (BHA) 18. The drill string 16 includes one or more joints of drill pipe. A drill string may further include additional components, such as tool joints, a kelly, kelly cocks, a kelly saver sub, blowout preventers, safety valves, and other components known in the art. The BHA 18 includes at least a drill bit. A BHA 18 may also include one or more drill collars, stabilizers, a downhole motor, MWD tools, and LWD tools, jars, accelerators, push the bit directional drilling tools, pull the bit directional drilling tools, point stab tools, shock absorbers, bent subs, pup joints, reamers, valves, and other components.

While in practice, a BHA comprises a drill bit, in embodiments of the invention described below, the parameters of the drill bit, required for modeling interaction between the drill bit and the bottomhole surface, are generally considered separately from the BHA parameters. This separate consideration of the drill bit allows for interchangeable use of any drill bit model as determined by the system designer.

To simulate the dynamic response of a drilling tool assembly, such as the one shown in FIG. 1, components of the drilling tool assembly need to be defined. For example, the drill string may be defined in terms of geometric and material parameters, such as the total length, the total weight, inside diameter (ID), outside diameter (OD), and material properties of each of the various components that make up the drill string. Material properties of the drill string components may include the strength and elasticity of the component material. Each component of the drill string may be individually defined or various parts may be defined in the aggregate. For example, a drill string comprising a plurality of substantially identical joints of drill pipe may be defined by the number of drill pipe joints of the drill string, and the ID, OD, length, and material properties for one drill pipe joint. Similarly, the BHA may be defined in terms of geometrical and material parameters of each component of the BHA, such as the ID, OD, length, location, and material properties of each component.

The geometry and material properties of the drill bit also need to be defined as required for the method selected for simulating drill bit interaction with earth formation at the bottom surface of the wellbore. Examples of methods for modeling drill bits are known in the art, see for example U.S. Pat. No. 6,516,293 to Huang, U.S. Pat. No. 6,213,225 to Chen for roller cone bits, and U.S. Pat. No. 4,815,342; U.S. Pat. No. 5,010,789; U.S. Pat. No. 5,042,596; and U.S. Pat. No. 5,131,479, each to Brett et al. for fixed cutter bits, which are each hereby incorporated by reference in their entireties. Other methods for modeling, designing, and optimizing fixed cutter drill bits are also disclosed in U.S. Patent Application No. 60/485,642, previously incorporated herein by reference.

To simulate the dynamic response of a drilling tool assembly drilling through an earth formation, the wellbore trajectory in which the drilling tool assembly is to be confined should also be defined along with its initial bottomhole geometry. The wellbore trajectory may be straight, curved, or a combination of straight and curved sections at various angular orientations. The wellbore trajectory may be defined in terms of parameters for each of a number of segments of the trajectory. For example, a wellbore defined as comprising N segments may be defined by the length, diameter, inclination angle, and azimuth direction of each segment along with an index number indicating the order of the segments. The material or material properties of the formation defining the wellbore surfaces can also be defined.

Additionally, drilling operation parameters, such as the speed at which the drilling tool assembly is rotated and the rate of penetration or the weight on bit (which may be determined from the weight of the drilling tool assembly suspended at the hook) may also be defined. Once the drilling system parameters are defined, they can be used along with selected interaction models to simulate the dynamic response of the drilling tool assembly drilling an earth formation as discussed below.

In connection with dynamically modeling a drill bit, it has been found that the dynamic model can often benefit from input obtained from static modeling.

In one aspect, the invention provides a method for determining the dynamic response of a drilling tool assembly during a drilling operation. Advantageously, in one or more embodiments, the method takes into account interactions between an entire drilling tool assembly and the drilling environment. The interactions may include the interaction between the drill bit at the end of the drilling tool assembly and the formation at the bottom of the wellbore. The interactions between the drilling tool assembly and the drilling environment may also include the interactions between the drilling tool assembly and the side (or wall) of the wellbore. Further, interactions between the drilling tool assembly and drilling environment may include the viscous damping effects of the drilling fluid on the dynamic behavior of the drilling tool assembly. In addition, the drilling fluid also provides buoyancy to the various components in the drilling tool assembly, reducing the effective masses of these components.

Figure 3:
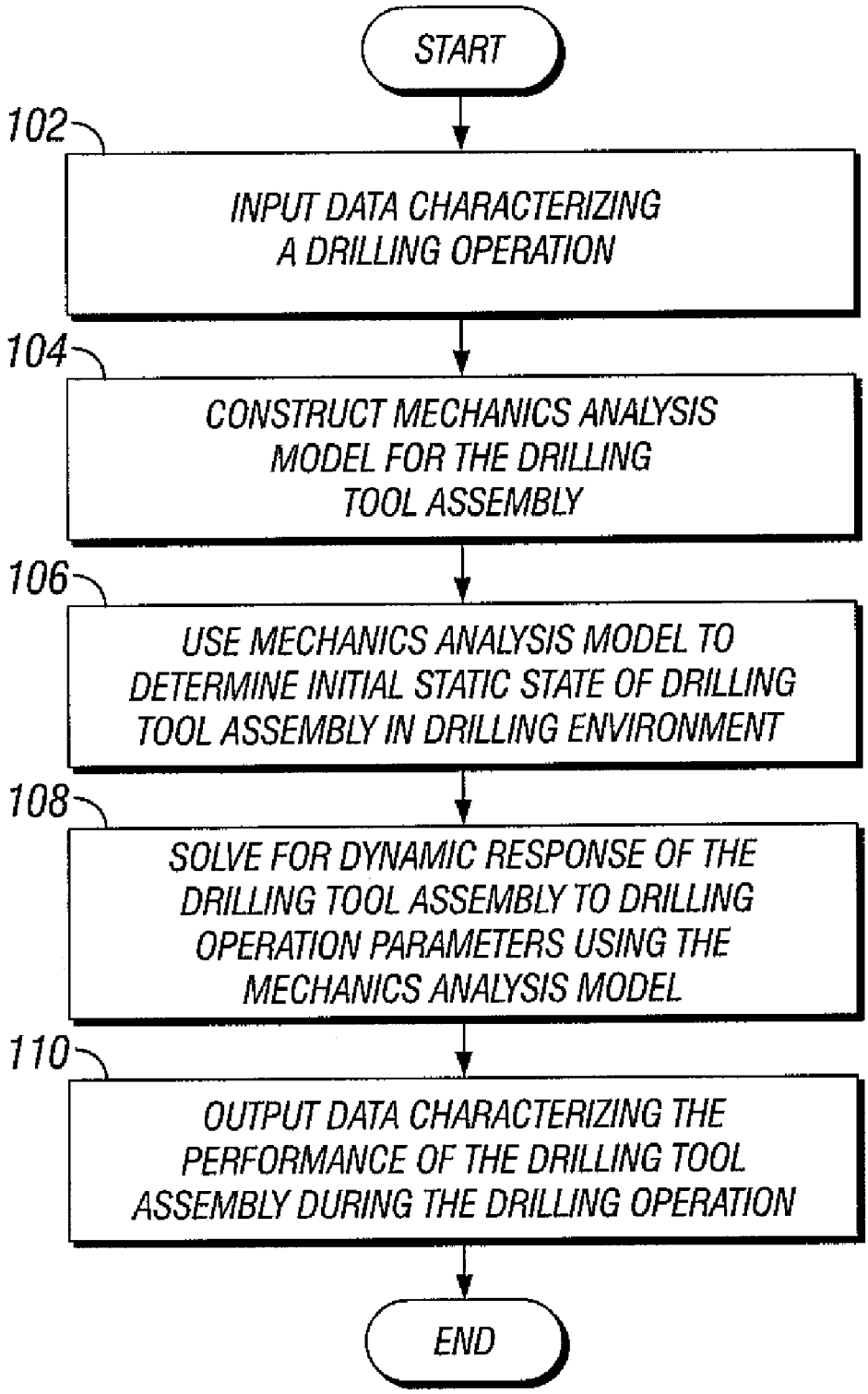
FIG. 3 shows a flow chart of a method for determining the dynamic response of a drilling tool assembly drilling through earth formation.

A flow chart for one embodiment of a method in accordance with an aspect of the present invention is shown in FIG. 3. The method includes inputting data characterizing a drilling operation to be simulated 102. The input data may include drilling tool assembly parameters, drilling environment parameters, and drilling operation parameters. The method also includes constructing a mechanics analysis model for the drilling tool assembly 104. The mechanics analysis model can be constructed using finite element analysis with drilling tool assembly parameters and Newton's law of motion. The method further includes determining an initial static state of the drilling tool assembly in the drilling environment 106 using the mechanics analysis model along with drilling environment parameters. Then, based on the initial static state and operational parameters provided as input, the dynamic response of the drilling tool assembly in the drilling environment is incrementally calculated 108.

Results obtained from calculation of the dynamic response of the drilling tool assembly are then provided as output data. The output data may be input into a graphics generator and used to graphically generate visual representations characterizing aspects of the performance of the drilling tool assembly in drilling the earth formation 110. One of ordinary skill in the art would appreciate from the present disclosure that the order of these steps is for illustration only and other permutations are possible without departing from the scope of the invention. For example, the data needed to characterize the drilling operation may be provided after the construction of the mechanics analysis model.

Figure 4:
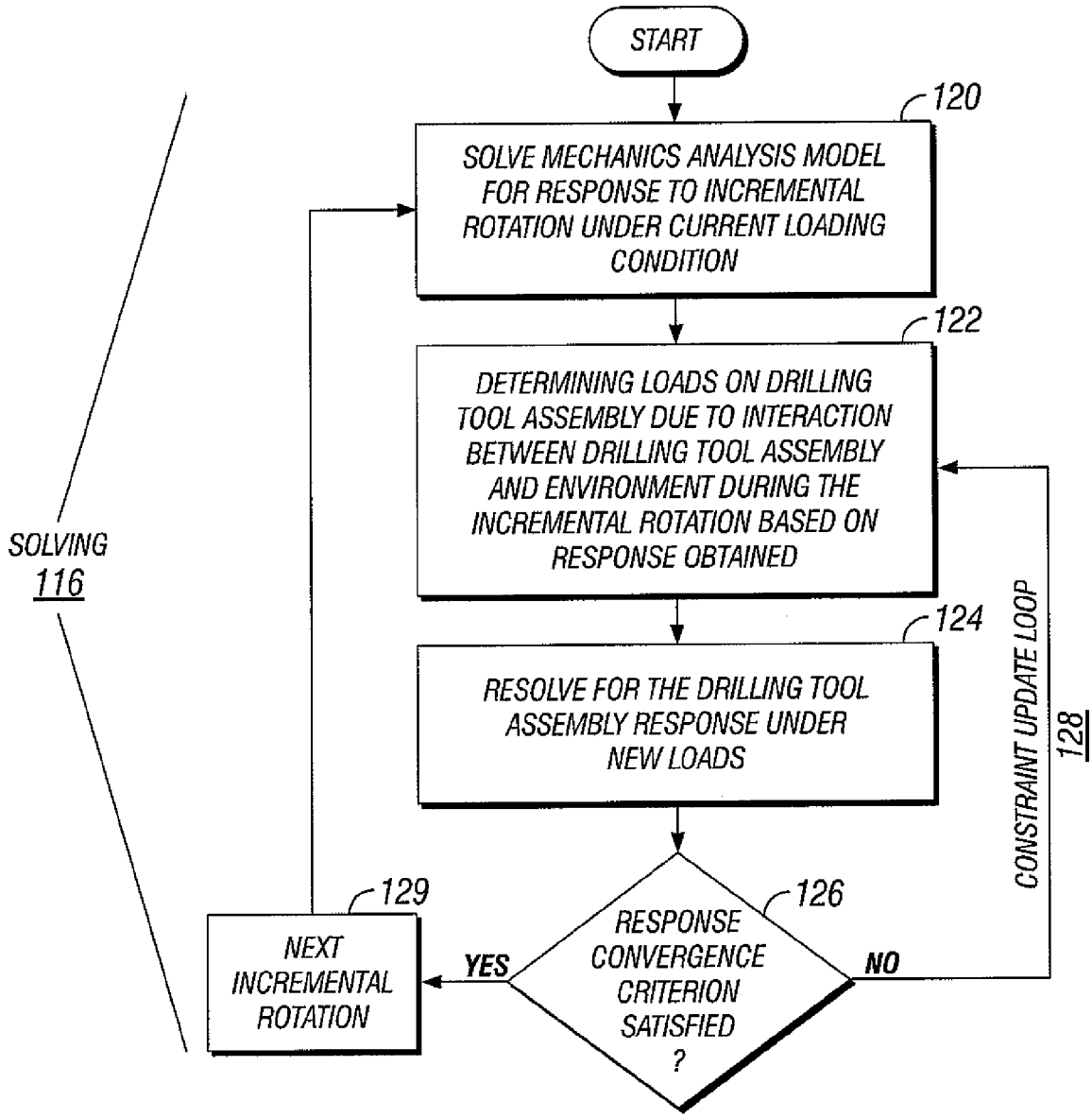
FIG. 4 shows a flow chart of one embodiment of the method predicting the dynamic response of a drilling tool assembly drilling through earth formation in accordance with the method shown in FIG. 3.

In one example, illustrated in FIG. 4, solving for the dynamic response 116 may not only include solving the mechanics analysis model for the dynamic response to an incremental rotation 120, but may also include determining, from the response obtained, loads (e.g., drilling environment interaction forces, bending moments, etc.) on the drilling tool assembly due to interactions between the drilling tool assembly and the drilling environment during the incremental rotation 122, and resolving for the response of the drilling tool assembly to the incremental rotation 124 under the newly determined loads. The determining and resolving may be repeated in a constraint update loop 128 until a response convergence criterion 126 is satisfied.

For example, assuming the simulation is performed under a constant WOB, with each incremental rotation, the drill bit is rotated by a small angle and moved downward (axially) by a small distance. During this movement, the interference between the drill bit and the bottom of the hole generates counter force acting against the drill bit (loads). If the load is more than the WOB, then the rotation or downward movement of the drill bit is too much. The parameters (constraints) should be adjusted (e.g., reduced the downward movement distance) and the incremental rotation is again performed. On the other hand, if the load after the incremental rotation is less than the WOB, then the incremental rotation should be performed with a larger angular or axial movement.

Incrementally calculating the dynamic response 116 may not only include solving the mechanics analysis model for the dynamic response to an incremental rotation, at 120, but may also include determining, from the response obtained, loads (e.g., drilling environment interaction forces) on the drilling tool assembly due to interactions between the drilling tool assembly and the drilling environment during the incremental rotation, at 122, and resolving for the response of the drilling tool assembly to the incremental rotation, at 124, under the newly determined loads. The determining and resolving may be repeated in a constraint update loop 128 until a response convergence criterion 126 is satisfied. Once a convergence criterion is satisfied, the entire incremental solving process 116 may be repeated for successive increments until an end condition for simulation is reached. These steps (incremental rotation, load calculation, comparison with a criterion, and adjustment of constraints) are repeated until the computed load from the incremental rotation is within a selected criterion (step 126). Once a convergence criterion is satisfied, the entire incremental solving process 116 may be repeated for successive increments 129 until an end condition for simulation is reached.

During the simulation, the constraint forces initially used for each new incremental calculation step may be the constraint forces determined during the last incremental rotation. In the simulation, incremental rotation and calculations are repeated for a select number of successive incremental rotations until an end condition for simulation is reached.

Figures 1, 5A:
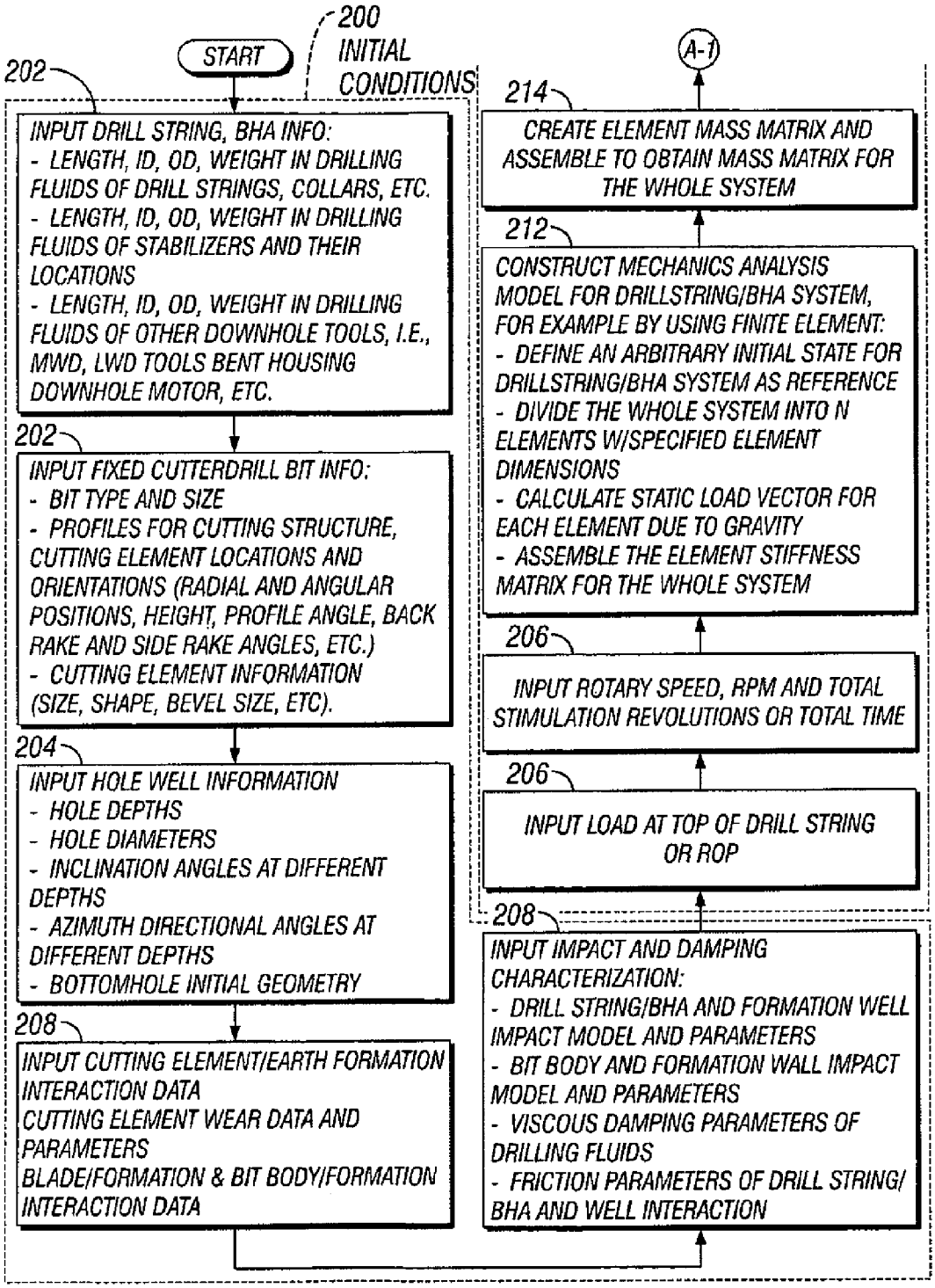
FIGS. 5A-C show a flowchart of a method for modeling the performance of a fixed cutter drill bit drilling in an earth formation.
Figures 2, 5A:
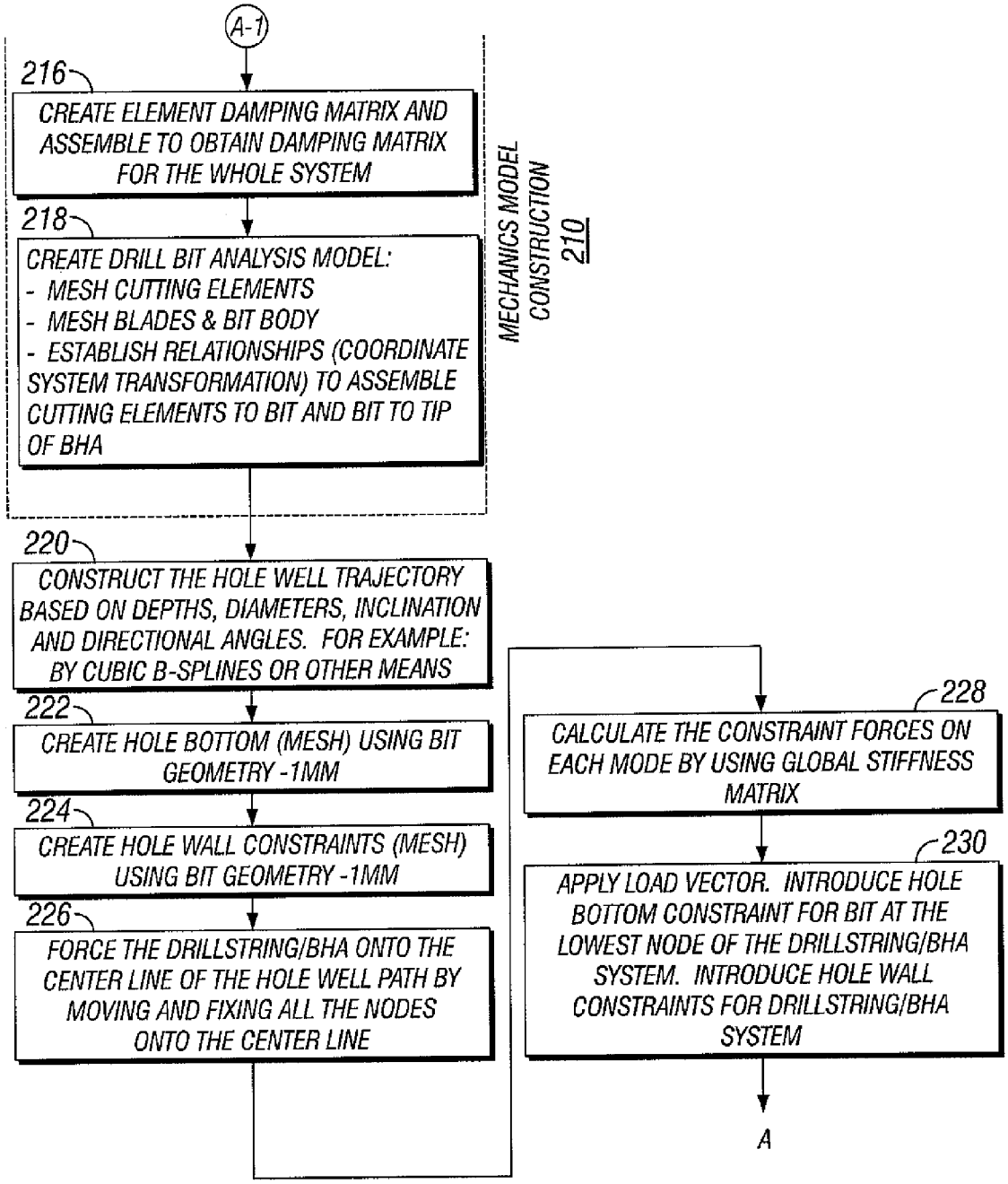
Figures 1, 5B:
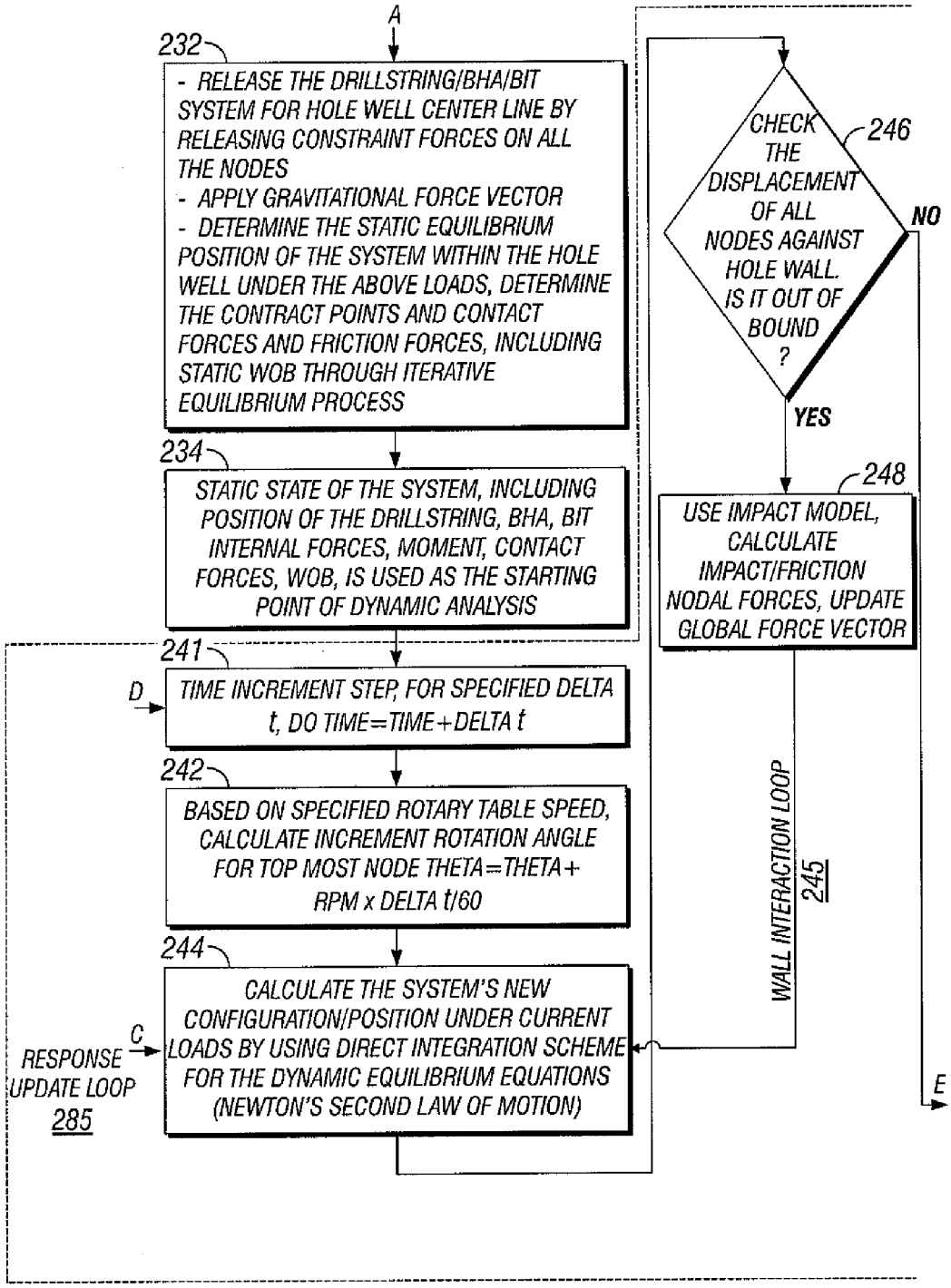
Figures 2, 5B:
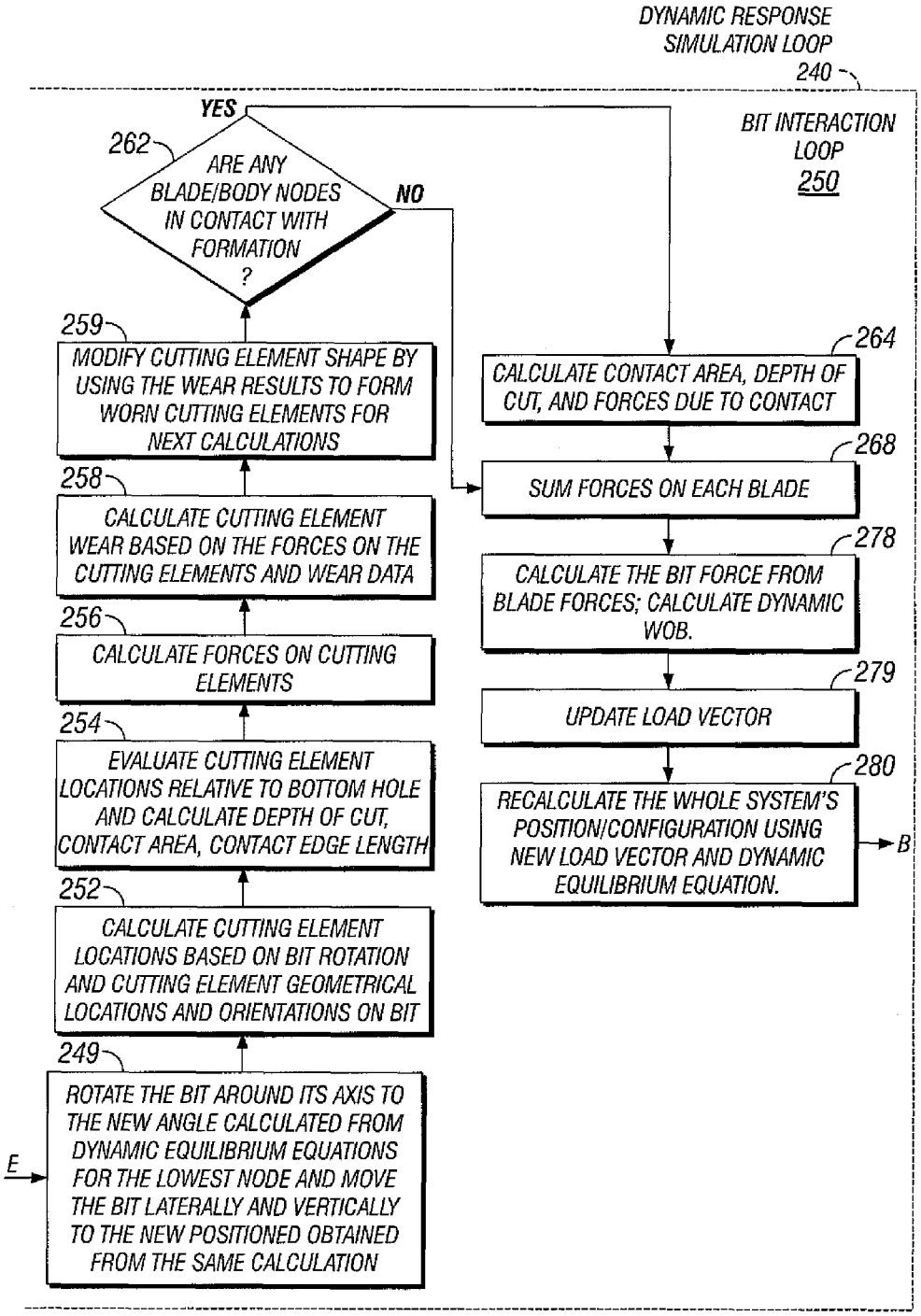
Figure 5C:
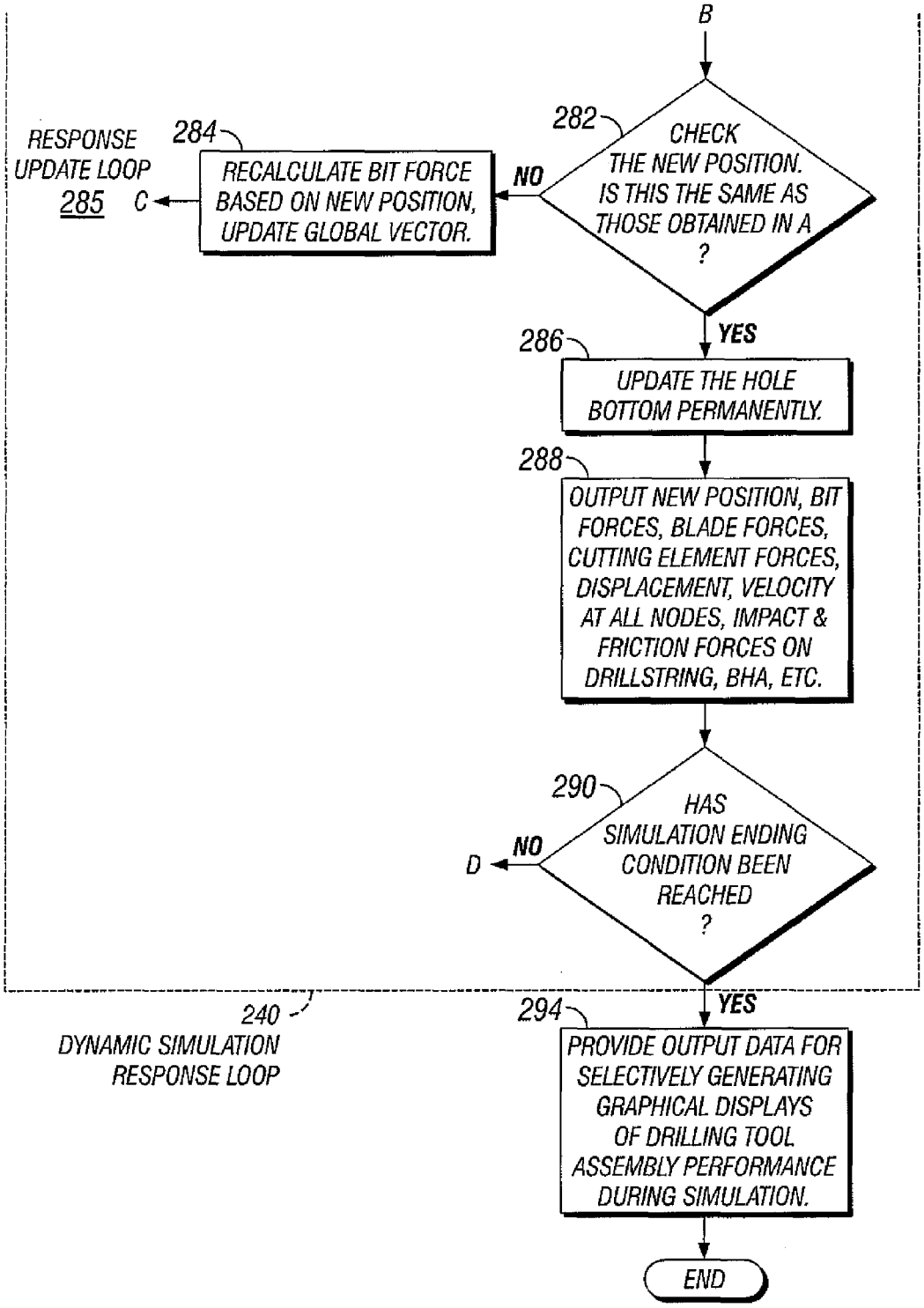

A flow chart of another embodiment of the invention is shown in FIGS. 5A-C. Parameters are provided as input 200 including drilling tool assembly design parameters 202, initial drilling environment parameters 204 and drilling operation parameters 206. Drilling tool assembly/drilling environment interaction parameters are also provided or selected as input 208.

Drilling tool assembly design parameters 202 may include drill string design parameters and BHA design parameters. The drill string can be defined as a plurality of segments of drill pipe with tool joints and the BHA may be defined as including a number of drill collars, stabilizers, and other downhole components, such as a bent housing motor, MWD tool, LWD tool, thruster, point the bit directional drilling tool, push the bit directional drilling tool, shock absorber, point stab, and a drill bit. One or more of these items may be selected from a library list of tools and used in the design of a drilling tool assembly model, as shown in FIG. 5A. Also, while the drill bit is generally considered part of the BHA, the drill bit design parameters may be defined in a bit parameter input screen and used separately in a detailed modeling of bit interaction with the earth formation that can be coupled to the drilling tool assembly design model as described below. Considering the detailed interaction of the bit with the earth formation separately in a bit calculation subroutine coupled to the drilling tool assembly model advantageously allows for the interchangeable use of any type of drill bit which can be defined and modeled using any desired drill bit analysis model. The calculated response of the bit interacting with the formation is coupled to the drilling tool assembly design model so that the effect of the selected drill bit interacting with the formation during drilling can be directly determined for the selected drilling tool assembly.

As previously discussed above in connection with step 202 of FIG. 5A, drill string design parameters may include the length, inside diameter (ID), outside diameter (OD), weight (or density), and other material properties of the drill string in the aggregate. Alternatively, in one or more embodiments, drill string design parameters may include the properties of each component of the drill string and the number of components and location of each component of the drill string. In other examples, the length, ID, OD, weight, and material properties of a segment of drill pipe may be provided as input along with the number of segments of drill pipe that make up the drill string. Material properties of the drill string provided as input may also include the type of material and/or the strength, elasticity, and density of the material. The weight of the drill string, or individual segment of the drill string may be provided as its "air" weight or as "weight in drilling fluids" (the weight of the component when submerged in the selected drilling fluid).

In accordance with one or more embodiments of the invention, the drill string need not be represented in true relative dimensions in the simulation. Instead, the drill string may be represented as sections (nodes) of different lengths. For example, the nodes closer to the BHA and drill bit may be represented as shorter sections (closer nodes) in order to better define the dynamics of the drill string close to the drill bit. On the other hand, drill string sections farther away from the BHA may be represented as longer sections (far apart nodes) in the simulation to save the computer resources.

BHA design parameters include, for example, the bent angle and orientation of the motor, the length, equivalent inside diameter (ID), outside diameter (OD), weight (or density), and other material properties of each of the various components of the BHA. In the example shown, the drill collars, stabilizers, and other downhole components are defined by their lengths, equivalent IDs, ODs, material properties, and eccentricity of the various parts, their weight in drilling fluids, and their position in the drilling tool assembly recorded.

Drill bit design parameters are also provided as input and used to construct a model for the selected drill bit. Drill bit design parameters include, for example, the bit type such as a fixed-cutter drill bit and geometric parameters of the bit. Geometric parameters of the bit may include the bit size (e.g., diameter), number of cutting elements, and the location, shape, size, and orientation of the cutting elements. In the case of a fixed cutter bit, the drill bit design parameters may further include the size of the bit, parameters defining the profile and location of each of the blades on the cutting face of the drill bit, the number and location of cutting elements on each blade, the back rake and side rake angles for each cutting element. In general, drill bit, cutting element, and cutting structure geometry may be converted to coordinates and provided as input to the simulation program. In one or more embodiments, the method used for obtaining bit design parameters involves uploading of 3-dimensional CAD solid or surface model of the drill bit to facilitate the geometric input. Drill bit design parameters may further include material properties of the various components that make up the drill bit, such as strength, hardness, and thickness of various materials forming the cutting elements, blades, and bit body.

In one or more embodiments, drilling environment parameters 204 include one or more parameters characterizing aspects of the wellbore. Wellbore parameters may include wellbore trajectory parameters and wellbore formation parameters. Wellbore trajectory parameters may include any parameter used in characterizing a wellbore trajectory, such as an initial wellbore depth (or length), diameter, inclination angle, and azimuth direction of the trajectory or a segment of the trajectory. In the typical case of a wellbore comprising different segments having different diameters or directional orientations, wellbore trajectory parameters may include depths, diameters, inclination angles, and azimuth directions for each of the various segments. Wellbore trajectory information may also include an indication of the curvature of each segment, and the order or arrangement of the segments in wellbore. Wellbore formation parameters may also include the type of formation being drilled and/or material properties of the formation such as the formation compressive strength, hardness, plasticity, and elastic modulus. An initial bottom surface of the wellbore may also be provided or selected as input. The bottomhole geometry maybe defined as flat or contour and provided as wellbore input. Alternatively, the initial bottom surface geometry may be generated or approximated based on the selected bit geometry. For example, the initial bottomhole geometry may be selected from a "library" (i.e., database) containing stored bottomhole geometries resulting from the use of various drill bits.

In one or more embodiments, drilling operation parameters 206 include the rotary speed (RPM) at which the drilling tool assembly is rotated at the surface and/or a downhole motor speed if a downhole motor is used. The drilling operation parameters also include a weight on bit (WOB) parameter, such as hook load, or a rate of penetration (ROP). Other drilling operation parameters 206 may include drilling fluid parameters, such as the viscosity and density of the drilling fluid, rotary torque and drilling fluid flow rate. The drilling operating parameters 206 may also include the number of bit revolutions to be simulated or the drilling time to be simulated as simulation ending conditions to control the stopping point of simulation. However, such parameters are not necessary for calculation required in the simulation. In other embodiments, other end conditions may be provided, such as a total drilling depth to be simulated or operator command.

In one or more embodiments, input is also provided to determine the drilling tool assembly/drilling environment interaction models 208 to be used for the simulation. As discussed in U.S. Pat. No. 6,516,293 and U.S. Provisional Application No. 60/485,642, cutting element/earth formation interaction models may include empirical models or numerical data useful in determining forces acting on the cutting elements based on calculated displacements, such as the relationship between a cutting force acting on a cutting element, the corresponding scraping distance of the cutting element through the earth formation, and the relationship between the normal force acting on a cutting element and the corresponding depth of penetration of the cutting element in the earth formation. Cutting element/earth formation interaction models may also include wear models for predicting cutting element wear resulting from prolonged contact with the earth formation, cutting structure/formation interaction models and bit body/formation interaction models for determining forces on the cutting structure and bit body when they are determined to interact with earth formation during drilling. In one or more embodiments, coefficients of an interaction model may be adjustable by a user to adapt a generic model to more closely fit characteristics of interaction as seen during drilling in the field. For example, coefficients of the wear model may be adjustable to allow for the wear model to be adjusted by a designer to calculate cutting element wear more consistent with that found on dull bits run under similar conditions.

Drilling tool assembly/earth formation impact, friction, and damping models or parameters can be used to characterize impact and friction on the drilling tool assembly due to contact of the drilling tool assembly with the wall of the wellbore and due to viscous damping effects of the drilling fluid. These models may include drill string-BHA/formation impact models, bit body/formation impact models, drill string-BHA/formation friction models, and drilling fluid viscous damping models. One skilled in the art will appreciate that impact, friction and damping models may be obtained through laboratory experimentation. Alternatively, these models may also be derived based on mechanical properties of the formation and the drilling tool assembly, or may be obtained from literature. Prior art methods for determining impact and friction models are shown, for example, in papers such as the one by Yu Wang and Matthew Mason, entitled "Two-Dimensional Rigid-Body Collisions with Friction," Journal of Applied Mechanics, September 1992, Vol. 59, pp. 635-642.

Input data may be provided as input to a simulation program by way of a user interface which includes an input device coupled to a storage means, a data base and a visual display, wherein a user can select which parameters are to be defined, such as operation parameters, drill string parameters, well parameters, etc. Then once the type of parameters to be defined is selected, the user selected the component or value desired to be changed and enter or select a changed value for use in performing the simulation.

In one or more embodiments, the user may select to change simulation parameters, such as the type of simulation mode desired (such as from ROP control to WOB control, etc.), or various calculation parameters, such as impact model modes (force, stiffness, etc.), bending-torsion model modes (coupled, decoupled), damping coefficients model, calculation incremental step size, etc. The user may also select to define and modify drilling tool assembly parameters. First the user may construct a drilling tool assembly to be simulated by selecting the component to be included in the drilling tool assembly from a database of components and then adjusting the parameters for each of the components as needed to create a drilling tool assembly model that very closely represents the actual drilling tool assembly being considered for use.

In one embodiment, the specific parameters for each component selected from the database may be adjustable, for example, by selecting a component added to the drilling tool assembly and changing the geometric or material property values defined for the component in a menu screen so that the resulting component selected more closely matches with the actual component included in the actual drilling tool assembly. For example, in one embodiment, a stabilizer in the drilling tool assembly may be selected and any one of the overall length, outside body diameter, inside body diameter, weight, blade length, blade OD, blade width, number of blades, thickness of blades, eccentricity offset, and eccentricity angle may be provided as well as values relating to the material properties (e.g., Young's modulus, Poisson's ratio, etc.) of the tool may be specifically defined to more accurately represent the stabilizer to be used in the drilling tool assembly being modeled. Similar features may also be provided for each of the drill collars, drill pipe, cross over subs, etc., included in the drilling tool assembly. In the case of drill pipe, and similar components, additional features defined may include the length and outside diameter of each tool connection joint, so that the effect of the actual tool joints on stiffness and mass throughout the system can be taken into account during calculations to provide a more accurate prediction of the dynamic response of the drilling tool assembly being modeled.

The user may also select and define the well by selecting well survey data and wellbore data. For example, for each segment a user may define the measured depth, inclination angle, and azimuth angle of each segment of the wellbore, and the diameter, well stiffness, coefficient of restitution, axial and transverse damping coefficients of friction, axial and transverse scraping coefficient of friction, and mud density.

Constructing the Model

As shown in FIG. 5A-B, once input data 200 are selected, determined, or otherwise provided, a two-part mechanics analysis model of the drilling tool assembly is constructed 210 and used to determine the initial static state 212 of the drilling tool assembly in the wellbore. The first part of the mechanics analysis model construction 210 takes into consideration the overall structure of the drilling tool assembly, with the drill bit being only generally represented. In this embodiment, a finite element method is used (generally described at 212) wherein an arbitrary initial state (such as hanging in the vertical mode free of bending stresses) is defined for the drilling tool assembly as a reference and the drilling tool assembly is divided into N elements of specified element dimensions (i.e., meshed). The static load vector for each element due to gravity is calculated. Then, element stiffness matrices are constructed based on the material properties, element length, and cross sectional geometrical properties of drilling tool assembly components provided as input for the entire drilling tool assembly (wherein the drill bit is generally represented by a single node). Similarly, element mass matrices are constructed by determining the mass of each element (based on material properties, etc.) for the entire drilling tool assembly 214. Additionally, element damping matrices can be constructed (based on experimental data, approximation, or other method) for the entire drilling tool assembly 216. Methods for dividing a system into finite elements and constructing corresponding stiffness, mass, and damping matrices are known in the art and thus are not explained in detail here. Examples of such methods are shown, for example, in "Finite Elements for Analysis and Design" by J. E. Akin (Academic Press, 1994).

The second part of the mechanics analysis model 210 of the drilling tool assembly is a mechanics analysis model of the drill bit 218 which takes into account details of selected drill bit design. The drill bit mechanics analysis model 218 is constructed by creating a mesh of the cutting elements and establishing a coordinate relationship (coordinate system transformation) between the cutting elements and the bit, and between the bit and the tip of the BHA. As previously noted, examples of methods for constructing mechanics analysis models for fixed cutter bits are disclosed in SPE Paper No. 15618 by T. M. Warren et. al., entitled "Drag Bit Performance Modeling," U.S. Pat. No. 4,815,342, U.S. Pat. No. 5,010789, U.S. Pat. No. 5,042,596, and U.S. Pat. No. 5,131,479 to Brett et al, and U.S. Provisional Application No. 60/485,642.

For each incremental rotation, the method may include calculating cutter wear based on forces on the cutters, the interference of the cutters with the formation, and a wear model and modifying cutter shapes based on the calculated cutter wear. These steps may be inserted into the method at the point indicated by the node labeled "A."

Further, those having ordinary skill will appreciate that the work done by the bit and/or individual cutters may be determined. Work is equal to force times distance, and because embodiments of the simulation provide information about the force acting on a cutter and the distance into the formation that a cutter penetrates, the work done by a cutter may be determined.

Other implementations of a method developed in accordance with this aspect of the invention may include a drilling model based on ROP control. Other implementations may include a drilling model based upon WOB control. Generally speaking the method includes selecting or otherwise inputting parameters for a dynamic simulation. Parameters provided as input include drilling parameters, bit design parameters, cutter/formation interaction data and cutter wear data, and bottomhole parameters for determining the initial bottomhole shape. The data and parameters provided as input for the simulation can be stored in an input library and retrieved as needed during simulation calculations.

Drilling parameters may include any parameters that can be used to characterize drilling. In the method shown, the drilling parameters provided as input include the rate of penetration (ROP) or the weight on bit (WOB) and the rotation speed of the drill bit (revolutions per minute, RPM). Those having ordinary skill in the art would recognize that other parameters (e.g., mud weight) may be included.

Bit design parameters may include any parameters that can be used to characterize a bit design. In the method shown, bit design parameters provided as input include the cutter locations and orientations (e.g., radial and angular positions, heights, profile angles, back rake angles, side rake angles, etc.) and the cutter sizes (e.g., diameter), shapes (i.e., geometry) and bevel size. Additional bit design parameters may include the bit profile, bit diameter, number of blades on bit, blade geometries, blade locations, junk slot areas, bit axial offset (from the axis of rotation), cutter material make-up (e.g., tungsten carbide substrate with hardfacing overlay of selected thickness), etc. Those skilled in the art will appreciate that cutter geometries and the bit geometry can be meshed, converted to coordinates and provided as numerical input. Preferred methods for obtaining bit design parameters for use in a simulation include the use of 3-dimensional CAD solid or surface models for a bit to facilitate geometric input.

Cutter/formation interaction data includes data obtained from experimental tests or numerically simulations of experimental tests which characterize the actual interactions between selected cutters and selected earth formations, as previously described in detail above. Wear data may be data generated using any wear model known in the art or may be data obtained from cutter/formation interaction tests that included an observation and recording of the wear of the cutters during the test. A wear model may comprise a mathematical model that can be used to calculate an amount of wear on the cutter surface based on forces on the cutter during drilling or experimental data which characterizes wear on a given cutter as it cuts through the selected earth formation. U.S. Pat. No. 6,619,411 issued to Singh et al. discloses methods for modeling wear of roller cone drill bits. This patent is assigned to the present assignee and is incorporated by reference in its entirety. Wear modeling for fixed cutter bits (e.g., PDC bits) will be described in a later section. Other patents related to wear simulation include U.S. Pat. Nos. 5,042,596, 5,010,789, 5,131,478, and 4,815,342. The disclosures of these patents are incorporated by reference in their entireties.

Bottomhole parameters used to determine the bottomhole shape may include any information or data that can be used to characterize the initial geometry of the bottomhole surface of the well bore. The initial bottomhole geometry may be considered as a planar surface, but this is not a limitation on the invention. Those skilled in the art will appreciate that the geometry of the bottomhole surface can be meshed, represented by a set of spatial coordinates, and provided as input. In one implementation, a visual representation of the bottomhole surface is generated using a coordinate mesh size of 1 millimeter.

Once the input data is entered or otherwise made available and the bottomhole shape determined, the steps in a main simulation loop can be executed. Within the main simulation loop, drilling is simulated by "rotating" the bit (numerically) by an incremental amount, $\Delta\theta_{bit,i}$. The rotated position of the bit at any time can be expressed as, $$\theta_{bit} = \sum^{i} \Delta\theta_{bit,i}.\Delta\theta_{bit,i},$$

may be set equal to 3 degrees, for example. In other implementations, $\Delta\theta_{bit,i}$ may be a function of time or may be calculated for each given time step. The new location of each of the cutters is then calculated, based on the known incremental rotation of the bit, $\Delta\theta_{bit,i}$, and the known previous location of each of the cutters on the bit. At this step, the new cutter locations only reflect the change in the cutter locations based on the incremental rotation of the bit. The newly rotated location of the cutters can be determined by geometric calculations known in the art. The axial displacement of the bit, $\Delta d_{bit,i}$, resulting for the incremental rotation, $\Delta\theta_{bit,i}$ may be determined using an equation such as:

$$\Delta d_{bit,i} = \frac{(ROP_i / RPM_i)}{1800} \cdot (\Delta\theta_{bit,i}), \tag{1}$$

wherein $\Delta d_{bit,i}$ is measured in inches, ROP is measured in feet/hour, RPM is measured in revolutions per minute, and $\Delta\theta_{bit,i}$ is measured in degrees.

Once the axial displacement of the bit, $\Delta d_{bit,i}$, is determined, the bit is "moved" axially downward (numerically) by the incremental distance, $\Delta d_{bit,i}$, (with the cutters at their newly rotated locations). Then the new location of each of the cutters after the axial displacement is calculated. The calculated location of the cutters now reflects the incremental rotation and axial displacement of the bit during the "increment of drilling." Then, the interference of each cutter with the bottomhole is determined. Determining cutter interactions with the bottomhole includes calculating the depth of cut, the interference surface area, and the contact edge length for each cutter contacting the formation during the increment of drilling by the bit. These cutter/formation interaction parameters can be calculated using geometrical calculations known in the art.

Figure 8:
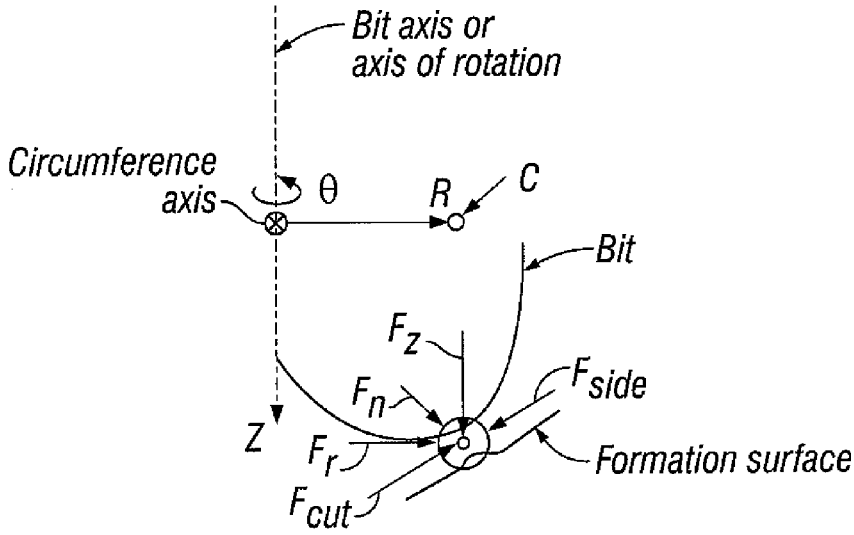
FIG. 8 schematically shows a cutter element in relation to a drill bit acting against a formation.

Once the correct cutter/formation interaction parameters are determined, the axial force on each cutter (in the Z direction with respect to a bit coordinate system as illustrated in FIG. 8) during increment drilling step, i, is determined. The force on each cutter is determined from the cutter/formation interaction data based on the calculated values for the cutter/formation interaction parameters and cutter and formation information.

Referring to FIG. 8, the normal force, cutting force, and side force on each cutter is determined from cutter/formation interaction data based on the known cutter information (cutter type, size, shape, bevel size, etc.), the selected formation type, the calculated interference parameters (i.e., interference surface area, depth of cut, contact edge length) and the cutter orientation parameters (i.e., back rake angle, side rake angle, etc.). For example, the forces are determined by accessing cutter/formation interaction data for a cutter and formation pair similar to the cutter and earth formation interacting during drilling. Then, the values calculated for the interaction parameters (depth of cut, interference surface area, contact edge length, back rack, side rake, and bevel size) during drilling are used to look up the forces required on the cutter to cut through formation in the cutter/formation interaction data. If values for the interaction parameters do not match values contained in the cutter/formation interaction data, records containing the most similar parameters are used and values for these most similar records can be used to interpolate the force required on the cutting element during drilling.

The displacement of each of the cutters is calculated based on the previous cutter location. The forces on each cutter are then determined from cutter/formation interaction data based on the cutter lateral movement, penetration depth, interference surface area, contact edge length, and other bit design parameters (e.g., back rake angle, side rake angle, and bevel size of cutter). Cutter wear is also calculated for each cutter based on the forces on each cutter, the interaction parameters, and the wear data for each cutter. The cutter shape is modified using the wear results to form a worn cutter for subsequent calculations.

Figure 9A:
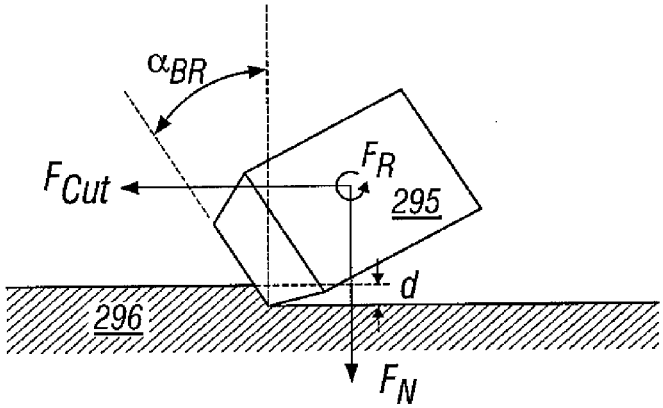
FIG. 9A-C shows nomenclature for a drill bit cutter in relation to a formation for purposes of modeling the cutter.
Figure 9B:
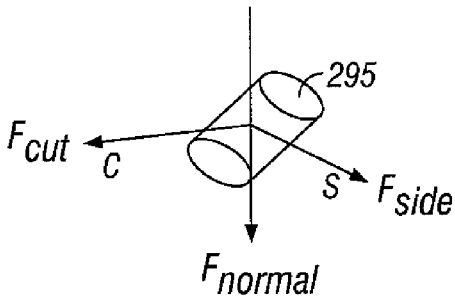
Figure 9C:
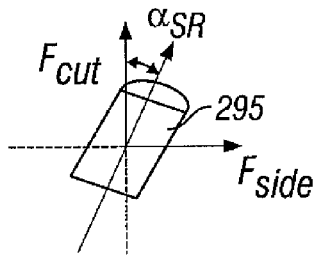
Figure 10A:
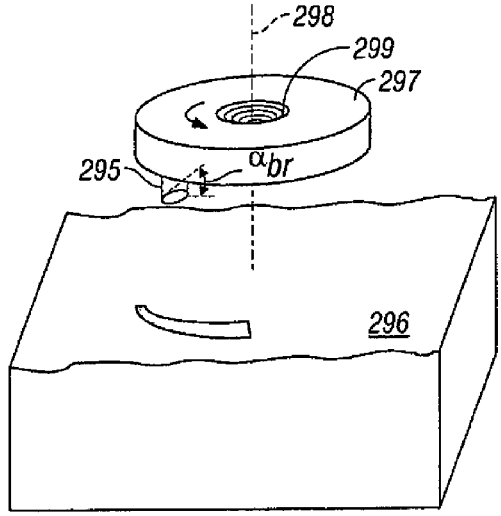
FIG. 10A-E shows a drill bit cutter in relation to a formation for purposes of modeling the cutter.
Figure 10B:
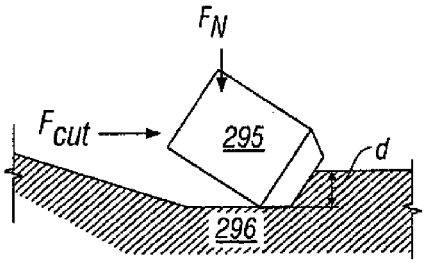
Figure 10C:
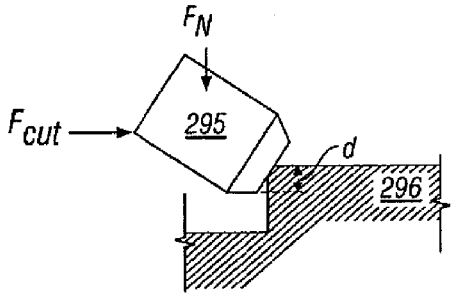
Figure 10D:
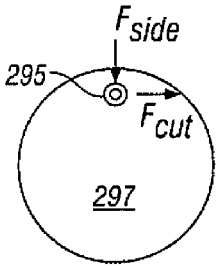
Figure 10E:
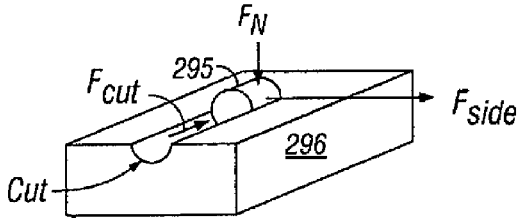

FIG. 9A shows a single cutter 295 in an example of a modeled position for engaging a formation 296 and FIGS. 9B and 9C show force orientation and nomenclature for discussion purposes. Once the forces, for example $F_N$, $F_{cut}$, and $F_{side}$ (see FIG. 9B), on each of the cutters during the incremental drilling step are determined. These forces may be resolved into bit coordinate system, $O_{ZR\theta}$, illustrated in FIG. 8, (axial (Z), radial (R), and circumferential (C) that is perpendicular into the page in FIG. 8). Then, all of the forces on the cutters in the axial direction are summed to obtain a total axial force $F_Z$ on the bit. The axial force required on the bit during the incremental drilling step is taken as the weight on bit (WOB) required to achieve the given ROP or alternatively the ROP required to achieve a given WOB is determined.

The total force required on the cutter to cut through earth formation can be resolved into components in any selected coordinate system, such as the Cartesian coordinate system shown in FIGS. 9A-C and 10A-E. As shown in FIG. 9B, the force on the cutter can be resolved into a normal component (normal force), $F_N$, a cutting direction component (cut force), $F_{cut}$, and a side component (side force), $F_{side}$. In the cutter coordinate system shown in FIG. 9B, the cutting axis is positioned along the direction of cut. The normal axis is normal to the direction of cut and generally perpendicular to the surface of the earth formation 296 interacting with the cutter. The side axis is parallel to the surface of the earth formation 296 and perpendicular to the cutting axis. The origin of this cutter coordinate system is shown positioned at the center of the cutter 295.

Finally, the bottomhole pattern is updated. The bottomhole pattern can be updated by removing the formation in the path of interference between the bottomhole pattern resulting from the previous incremental drilling step and the path traveled by each of the cutters during the current incremental drilling step.

Output information, such as forces on cutters, weight on bit, and cutter wear, may be provided for further analysis. The output information may include any information or data which characterizes aspects of the performance of the selected drill bit drilling the specified earth formations. For example, output information can include forces acting on the individual cutters during drilling, scraping movement/distance of individual cutters on hole bottom and on the hole wall, total forces acting on the bit during drilling, and the weight on bit to achieve the selected rate of penetration for the selected bit. Output information may be used to generate a visual display of the results of the drilling simulation. The visual display can include a graphical representation of the well bore being drilled through earth formations. The visual display can also include a visual depiction of the earth formation being drilled with cut sections of formation calculated as removed from the bottomhole during drilling being visually "removed" on a display screen. The visual representation may also include graphical displays of forces, such as a graphical display of the forces on the individual cutters, on the blades of the bit, and on the drill bit during the simulated drilling. The visual representation may also include graphical displays force angles, Beta angle separation between force components, and historic or time dependent depictions of forces and angles. The means, whether a graph, a visual depiction or a numerical table used for visually displaying aspects of the drilling performance can be a matter of choice for the system designer, and is not a limitation on the invention, According to one aspect of the invention it is useful to display the Beta angle between cut direction component of the total of imbalance force and the radial direction component of the total imbalance force during a period of time of simulated drilling.

As should be understood by one of ordinary skill in the art, with reference to co-owned co-pending U.S. patent application Ser. No 10/888,446, incorporated herein by reference in its entirety, the steps within a main simulation loop are repeated as desired by applying a subsequent incremental rotation to the bit and repeating the calculations in the main simulation loop to obtain an updated cutter geometry (if wear is modeled) and an updated bottomhole geometry for the new incremental drilling step. Repeating the simulation loop as described above will result in the modeling of the performance of the selected fixed cutter drill bit drilling the selected earth formations and continuous updates of the bottomhole pattern drilled. In this way, the method as described can be used to simulate actual drilling of the bit in earth formations.

An ending condition, such as the total depth to be drilled, can be given as a termination command for the simulation, the incremental rotation and displacement of the bit with subsequent calculations in the simulation loop will be repeated until the selected total depth drilled (e.g., $$D = \sum^{i} \Delta d_{bit,i}$$

is reached. Alternatively, the drilling simulation can be stopped at any time using any other suitable termination indicator, such as a selected input from a user or a desired output from the simulation.

Embodiments of the present invention advantageously provide the ability to model inhomogeneous regions and transitions between layers. With respect to inhomogeneous regions, sections of formation may be modeled as nodules or beams of different material embedded into a base material, for example. That is, a user may define a section of a formation as including various non-uniform regions, whereby several different types of rock are included as discrete regions within a single section.

Returning to FIGS. 5A-C, wellbore constraints for the drilling tool assembly are determined, at 222, 224, because the response of the drilling tool assembly is subject to the constraint within the wellbore. First, the trajectory of the wall of the wellbore, which constrains the drilling tool assembly and forces it to conform to the wellbore path, is constructed at 220 using wellbore trajectory parameters provided as input at 204. For example, a cubic B-spline method or other interpolation method can be used to approximate wellbore wall coordinates at depths between the depths provided as input data. The wall coordinates are then discretized (or meshed), at 224 and stored. Similarly, an initial wellbore bottom surface geometry, which is either selected or determined, is also discretized, at 222, and stored. The initial bottom surface of the wellbore may be selected as flat or as any other contour, which can be provided as wellbore input at 204 or 222. Alternatively, the initial bottom surface geometry may be generated or approximated based on the selected bit geometry. For example, the initial bottomhole geometry may be selected from a "library" (i.e., database) containing stored bottomhole geometries resulting from the use of various bits.

In the example embodiment shown in FIG. 5A, a coordinate mesh size of 1 millimeter is selected for the wellbore surfaces (wall and bottomhole); however, the coordinate mesh size is not intended to be a limitation on the invention. Once meshed and stored, the wellbore wall and bottomhole geometry, together, comprise the initial wellbore constraints within which the drilling tool assembly operates, and, thus, within which the drilling tool assembly response is constrained.

Once the mechanics analysis model for the drilling tool assembly including the bit is constructed 210 and the wellbore constraints are specified 222, 224, the mechanics model and constraints can be used to determine the constraint forces on the drilling tool assembly when forced to the wellbore trajectory and bottomhole from its original "stress free" state. In this embodiment, the constraint forces on the drilling tool assembly are determined by first displacing and fixing the nodes of the drilling tool assembly so the centerline of the drilling tool assembly corresponds to the centerline of the wellbore, at 226. Then, the corresponding constraining forces required on each node (to fix it in this position) are calculated at 228 from the fixed nodal displacements using the drilling tool assembly (i.e., system or global) stiffness matrix from 212. Once the "centerline" constraining forces are determined, the hook load is specified, and initial wellbore wall constraints and bottomhole constraints are introduced at 230 along the drilling tool assembly and at the bit (lowest node). The centerline constraints are used as the wellbore wall constraints. The hook load and gravitational force vector are used to determine the WOB.

As previously noted, the hook load is the load measured at the hook from which the drilling tool assembly is suspended. Because the weight of the drilling tool assembly is known, the bottomhole constraint force (i.e., WOB) can be determined as the weight of the drilling tool assembly minus the hook load and the frictional forces and reaction forces of the hole wall on the drilling tool assembly.

Once the initial loading conditions are introduced, the "centerline" constraint forces on all of the nodes may be removed, a gravitational force vector may be applied, and the static equilibrium position of the assembly within the wellbore may be determined by iteratively calculating the static state of the drilling tool assembly 232. Iterations are necessary since the contact points for each iteration may be different. The convergent static equilibrium state is reached and the iteration process ends when the contact points and, hence, contact forces are substantially the same for two successive iterations. Along with the static equilibrium position, the contact points, contact forces, friction forces, and static WOB on the drilling tool assembly may be determined. Once the static state of the system is obtained, it can be used as the staring point for simulation of the dynamic response of the drilling tool assembly drilling earth formation 234.

During the simulation, the constraint forces initially used for each new incremental calculation step may be the constraint forces determined during the last incremental rotation. In the simulation, incremental rotation calculations are repeated for a select number of successive incremental rotations until an end condition for simulation is reached.

As shown in FIG. 5A-C, once input data are provided and the static state of the drilling tool assembly in the wellbore is determined, calculations in the dynamic response simulation loop 240 can be carried out. Briefly summarizing the functions performed in the dynamic response loop 240, the drilling tool assembly drilling earth formation is simulated by "rotating" the top of the drilling tool assembly (and at the location corresponding to a downhole motor, if used) through an incremental angle (at 242) corresponding to a selected time increment, and then calculating the response of the drilling tool assembly under the previously determined loading conditions 244 to the incremental rotation(s). The constraint loads on the drilling tool assembly resulting from interaction with the wellbore wall during the incremental rotation are iteratively determined (in loop 245) and are used to update the drilling tool assembly constraint loads (i.e., global load vector), at 248, and the response is recalculated under the updated loading condition. The new response is then rechecked to determine if wall constraint loads have changed and, if necessary, wall constraint loads are re-determined, the load vector updated, and a new response calculated. Then, the bottomhole constraint loads resulting from bit interaction with the formation during the incremental rotation are evaluated based on the new response (loop 252), the load vector is updated (at 279), and a new response is calculated (at 280). The wall and bottomhole constraint forces are repeatedly updated (in loop 285) until convergence of a dynamic response solution is obtained (i.e., changes in the wall constraints and bottomhole constraints for consecutive solutions are determined to be negligible). The entire dynamic simulation loop 240 is then repeated for successive incremental rotations until an end condition of the simulation is reached (at 290) or until simulation is otherwise terminated. A more detailed description of the elements in the simulation loop 240 follows.

Prior to the start of the simulation loop 240, drilling operation parameters 206 are specified. As previously noted, the drilling operation parameters 206 may include the rotary table speed, downhole motor speed (if a downhole motor is included in the BHA), rate of penetration (ROP), and the hook load (and/or other weight on bit parameter). In this example, the end condition for simulation is also provided at 204, as either the total number of revolutions to be simulated or the total time for the simulation. Additionally, the incremental step desired for calculations should be defined, selected, or otherwise provided. In the embodiment shown, an incremental time step of $\Delta t=10^{-3}$ seconds is selected. However, it should be understood that the incremental time step is not intended to be a limitation on the invention.

Once the static state of the system is known (from 232) and the operational parameters are provided, the dynamic response simulation loop 240 can begin. First, the current time increment is calculated at 241, wherein $t_{i+1}=t_i+\Delta t$ seconds. Then, the incremental rotation occurring during that time increment is calculated at 242. In this embodiment, RPM is considered an input parameter. Therefore, the formula used to calculate the incremental rotation angle at time $t_{i+1}$ is:

$$\Delta\theta_{i+1}=6*RPM*\Delta t, \quad (2)$$

wherein RPM is the rotational speed (in revolutions per minute) and Δt is the time increment (in seconds) of the rotary table or top drive provided as input data (at 204). The calculated incremental rotation angle is applied proximal to the top of the drilling tool assembly (at the node(s) corresponding to the position of the rotary table). If a downhole motor is included in the BHA, the downhole motor incremental rotation is also calculated and applied at the nodes corresponding to the downhole motor.

Once the incremental rotation angle and current time are determined, the system's new configuration (nodal positions) under the extant loads and the incremental rotation is calculated (at 244) using the drilling tool assembly mechanics analysis model and the rotational input as an excitation. A direct integration scheme can be used to solve the resulting dynamic equilibrium equations for the drilling tool assembly. The dynamic equilibrium equation (like the mechanics analysis equation) can be derived using Newton's second law of motion, wherein the constructed drilling tool assembly mass, stiffness, and damping matrices along with the calculated static equilibrium load vector can be used to determine the response to the incremental rotation. For the example shown in FIGS. 5A-C, it should be understood that at the first time increment $t_1$ the extant loads on the system are the static equilibrium loads (calculated for $t_0$) which include the static state WOB and the constraint loads resulting from drilling tool assembly contact with the wall and bottom of the wellbore.

As the drilling tool assembly is incrementally "rotated," constraint loads acting on the bit may change. For example, points of the drilling tool assembly in contact with the borehole surface prior to rotation may be moved along the surface of the wellbore resulting in friction forces at those points. Similarly, some points of the drilling tool assembly, which were close to contacting the borehole surface prior to the incremental rotation, may be brought into contact with the formation as a result of the incremental rotation. This may result in impact forces on the drilling tool assembly at those locations. As shown in FIG. 5A-C, changes in the constraint loads resulting from the incremental rotation of the drilling tool assembly can be accounted for in the wall interaction update loop 245.

In the example shown, once the system's response (i.e., new configuration) under the current loading conditions is obtained, the positions of the nodes in the new configuration are checked at 244 in the wall constraint loop 245 to determine whether any nodal displacements fall outside of the bounds (i.e., violate constraint conditions) defined by the wellbore wall. If nodes are found to have moved outside of the wellbore wall, the impact and/or friction forces which would have occurred due to contact with the wellbore wall are approximated for those nodes at 248 using the impact and/or friction models or parameters provided as input at 208. Then the global load vector for the drilling tool assembly is updated, also at 208, to reflect the newly determined constraint loads. Constraint loads to be calculated may be determined to result from impact if, prior to the incremental rotation, the node was not in contact with the wellbore wall. Similarly, the constraint load can be determined to result from frictional drag if the node now in contact with the wellbore wall was also in contact with the wall prior to the incremental rotation. Once the new constraint loads are determined and the global load vector is updated, at 248, the drilling tool assembly response is recalculated (at 244) for the same incremental rotation under the newly updated load vector (as indicated by loop 245). The nodal displacements are then rechecked (at 246) and the wall interaction update loop 245 is repeated until a dynamic response within the wellbore constraints is obtained.

Once a dynamic response conforming to the borehole wall constraints is determined for the incremental rotation, the constraint loads on the drilling tool assembly due to interaction with the bottomhole during the incremental rotation are determined in the bit interaction loop 250. Those skilled in the art will appreciate that any method for modeling drill bit/earth formation interaction during drilling may be used to determine the forces acting on the drill bit during the incremental rotation of the drilling tool assembly. An example of one method is illustrated in the bit interaction loop 250 in FIG. 5B.

In the bit interaction loop 250, the mechanics analysis model of the drill bit is subjected to the incremental rotation angle calculated for the lowest node of the drilling tool assembly, and is then moved laterally and vertically to the new position obtained from the same calculation, as shown at 249. As previously noted, the drill bit in this example is a fixed cutter drill bit. The interaction of the drill bit with the earth formation is modeled in accordance with a method disclosed in U.S. Provisional Application No. 60/485,642, which as been incorporated herein by reference. Thus, in this example, once the rotation and new position for the bit node are known, they are used as input to the drill bit model and the drill bit model is used to calculate the new position for each of the cutting elements on the drill bit. Then, the location of each cutting element relative to the bottomhole and wall of the wellbore is evaluated, at 262, to determine for each cutting element whether cutting element interference with the formation occurred during the incremental movement of the bit.

If cutting element contact is determined to have occurred with the earth formation, surface contact area between the cutter and the earth formation is calculated along with the depth of cut and the contact edge length of the cutter, and the orientation of the cutting face with respect to the formation (e.g., back rake angle, side rake angle, etc.) at 264. The depth of cut is the depth below the formation surface that a cutting element contacts earth formation, which can range from zero (no contact) to the full height of the cutting element. Surface area contact is the fractional amount of the cutting surface area out of the entire area corresponding to the depth of cut that actually contacts earth formation. This may be a fractional amount of contact due to cutting element grooves formed in the formation from previous contact with cutting elements. The contact edge length is the distance between farthest points on the edge of the cutter in contact with formation at the formation surface. Scraping distance takes into account the movement of the cutting element in the formation during the incremental rotation.

Once the depth of cut, surface contact area, contact edge length, and scraping distance are determined for a cutting element, these parameters can be stored and used along with the cutting element/formation interaction data to determine the resulting forces acting on the cutting element during the incremental movement of the bit (also indicated at 264). For example, in accordance a simulation method described in U.S. Provisional Application No. 60/485,642 noted above, resulting forces on each of the cutters can be determined using cutter/formation interaction data stored in a data library involving a cutter and formation pair similar to the cutter and earth formation interacting during the simulated drilling. Values calculated for interaction parameters (depth of cut, interference surface area, contact edge length, back rack, side rake, and bevel size) during drilling are used to determine the corresponding forces required on the cutters to cut through the earth formation. In cases where the cutting element makes less than full contact with the earth formation due to grooves in the formation surface, an equivalent depth of cut and equivalent contact edge length may be calculated 254 to correspond to the interference surface area and these values are used to determine the forces required on the cutting element during drilling 256.

Once the cutting element/formation interaction variables (contact area, depth of cut, force, etc.) are determined for cutting elements (256, 258, 259), the geometry of the bottom surface of the wellbore is temporarily updated, to reflect the removal of formation by each cutting element during the incremental rotation of the drill bit.

After the bottomhole geometry is temporarily updated, insert wear and strength can also be analyzed, as shown at 258, based on wear models and calculated loads on the cutting elements to determine wear on the cutting elements resulting from contact with the formation and the resulting reduction in cutting element strength.

Once interactions of all of the cutting elements on a blade is determined, blade interaction with the formation may be determined by checking the node displacements at the blade surface, at 268, to determine if any of the blade nodes are out of bounds or make contact with the wellbore wall or bottomhole surface. If blade contact is determined to occur during the incremental rotation, the contact area and depth of penetration of the blade are calculated and used to determine corresponding interaction forces on the blade surface resulting from the contact. Once forces resulting from blade contact with the formation are determined, or it is determined that no blade contact has occurred, the total interaction forces on the blade during the incremental rotation are calculated by summing all of the cutting element forces and any blade surface forces on the blade, at 268.

Once the interaction forces on each blade are determined, any forces resulting from contact of the bit body with the formation may also be determined and then the total forces acting on the bit during the incremental rotation calculated and used to determine the dynamic weight on bit 278. The newly calculated bit interaction forces are then used to update the global load vector at 279, and the response of the drilling tool assembly is recalculated at 280 under the updated loading condition. The newly calculated response is then compared to the previous response at 282 to determine if the responses are substantially similar. If the responses are determined to be substantially similar, then the newly calculated response is considered to have converged to a correct solution. However, if the responses are not determined to be substantially similar, then the bit interaction forces are recalculated based on the latest response at 284 and the global load vector is again updated at 284. Then, a new response is calculated by repeating the entire response calculation (including the wellbore wall constraint update and drill bit interaction force update) until consecutive responses are obtained which are determined to be substantially similar (indicated by loop 285), thereby indicating convergence to the solution for dynamic response to the incremental rotation.

Once the dynamic response of the drilling tool assembly to an incremental rotation is obtained from the response force update loop 285, the bottomhole surface geometry is then permanently updated at 286 to reflect the removal of formation corresponding to the solution. At this point, output information desired from the incremental simulation step can be stored and/or provided as output. For example, the velocity, acceleration, position, forces, bending moments, torque, of any node in the drill string may be provided as output from the simulation. Additionally, the dynamic WOB, cutting element forces (256), resulting cutter wear (259), blade forces, and blade or bit body contact points may be output from the simulation.

This dynamic response simulation loop 240 as described above is then repeated for successive incremental rotations of the bit until an end condition of the simulation (checked at 290) is satisfied. For example, using the total number of bit revolutions to be simulated as the termination command, the incremental rotation of the drilling tool assembly and subsequent iterative calculations of the dynamic response simulation loop 240 will be repeated until the selected total number of revolutions to be simulated is reached. Repeating the dynamic response simulation loop 240 as described above will result in simulating the performance of an entire drilling tool assembly drilling earth formations with continuous updates of the bottomhole pattern as drilled, thereby simulating the drilling of the drilling tool assembly in the selected earth formation. Upon completion of a selected number of operations of the dynamic response simulation loop, results of the simulation may be used to generate output information at 294 characterizing the performance of the drilling tool assembly drilling the selected earth formation under the selected drilling conditions, as shown in FIG. 5A-C. It should be understood that the simulation can be stopped using any other suitable termination indicator, such as a selected wellbore depth desired to be drilled, indicated divergence of a solution, etc.

The dynamic model of the drilling tool assembly described above usefully allows for six degrees of freedom of moment for the drill bit. In one or more embodiments, methods in accordance with the above description can be used to calculate and accurately predict the axial, lateral, and torsional vibrations of drill strings when drilling through earth formation, as well as bit whirl, bending stresses, and other dynamic indicators of performance for components of a drilling tool assembly.

Beta Angle Performance Information Output From Dynamic Model

As noted above, output information from a dynamic simulation of a drilling tool assembly drilling an earth formation may include, for example, the drilling tool assembly configuration (or response) obtained for each time increment, and corresponding cutting element forces, blade forces, bit forces, impact forces, friction forces, dynamic WOB, bending moments, displacements, vibration, resulting bottomhole geometry, radial and circumferential components of total imbalance forces, Beta angle between the components of the imbalance forces, and more. This output information may be presented in the form of a visual representation (indicated at 294 in FIG. 5C).

Examples of the visual representations include a visual representation of the dynamic Beta angle response of the drilling tool assembly to drilling presented on a computer screen. Usefully, the visual representation may include a representation of the Beta angle response over a given period of time or a given number of rotations that are calculated or otherwise obtained during the simulation. For example, a time history of the dynamic Beta angle over a period of time or a number of rotations during simulated drilling may be graphic displayed to a designer. The means used for visually displaying Beta angle simulated during drilling is a matter of convenience for the system designer, and not a limitation on the invention. Another example of output data converted to a visual representation is a number representing the average Beta angle during one complete revolution of the drill bit drilling in the formation. The average may be further subdivide into average Beta angle for portions of a single rotation or average Beta angle during multiple rotations graphically illustrated as a visual display.

Methods for Designing a Drilling Tool Assembly

In another aspect, the invention provides a method for designing a drilling tool assembly for drilling earth formations. For example, the method may include simulating a dynamic response of a drilling tool assembly, determining the radial components and circumferential components of imbalanced forces and the Beta angle between the forces over a period of time, displaying at least a representation of the Beta angle over a period of simulated drilling, adjusting the value of at least one drill bit design parameter, repeating the simulating, and repeating the adjusting and the simulating until a value of the Beta angle over the period of time is determined to be an optimal value.

Methods in accordance with this aspect of the invention may be used to analyze relationships between drill bit design parameters and the Beta angle over a period of drilling and the relationship of these characteristics of the drill bit design and performance to other design parameters and performance characteristics. This method also may be used to design a drilling tool assembly having enhanced drilling characteristics. Further, the method may be used to analyze the effect of changes in a drilling tool configuration on drilling performance. Additionally, the method may enable a drilling tool assembly designer or operator to determine an optimal value of a drill bit design parameter or of a drilling tool assembly design parameter for drilling at a particular depth or in a particular formation.

Examples of drilling tool assembly design parameters include the type and number of components included in the drilling tool assembly; the length, ID, OD, weight, and material properties of each component; and the type, size, weight, configuration, and material properties of the drill bit; and the type, size, number, location, orientation, and material properties of the cutting elements on the bit. Material properties in designing a drilling tool assembly may include, for example, the strength, elasticity, density, wear resistance, hardness, and toughness of the material. It should be understood that drilling tool assembly design parameters may include any other configuration or material parameter of the drilling tool assembly without departing from the spirit of the invention.

As noted above, examples of drilling performance parameters include rate of penetration (ROP), rotary torque required to turn the drilling tool assembly, rotary speed at which the drilling tool assembly is turned, drilling tool assembly vibrations induced during drilling (e.g., lateral and axial vibrations), weight on bit (WOB), and forces acting on the bit, cutting support structure, and cutting elements. Drilling performance parameters may also include the inclination angle and azimuth direction of the borehole being drilled. One skilled in the art will appreciate that other drilling performance parameters exist and may be considered as determined by the drilling tool assembly designer without departing from the scope of the invention.

Figure 6:
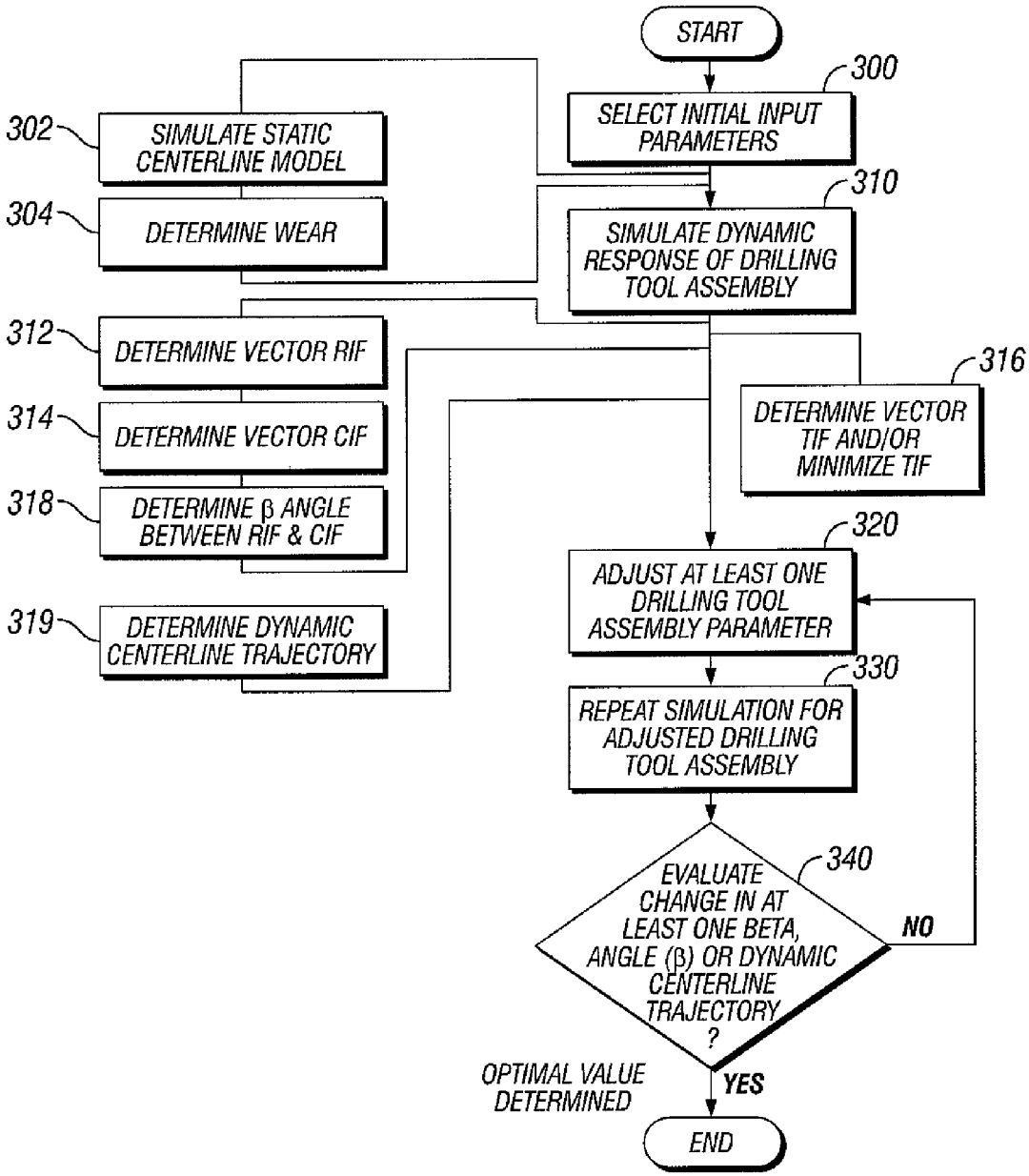
FIG. 6 shows a flow chart of a method for determining an optimal value of at least one drilling tool assembly design parameter.

In one application of this aspect of the invention, illustrated in FIG. 6, the method comprises defining, selecting or otherwise providing initial input parameters at 300 (including drill bit and drilling tool assembly design parameters). The method may further comprise simulating the response of a drill bit design using a static model 302 (a static model defined for these purposes as a model in which it is assumed that the centerline of the drill bit is constrained to be concentric with the centerline of the wellbore while the drill bit is rotated through increments of simulated rotational drilling in an earth formation) to determine cutter wear data 304. The method further comprises using the wear data in a dynamic model (defined as a model in which the centerline of the drill bit is constrained only by the dynamic characteristics of the drilling tool assembly including the drill string and the drill bit design) and simulating the dynamic response of the drilling tool assembly at 310. The dynamic simulation is used to determine a radial component 312 and a circumferential component 314 of the total imbalanced forces on the drill bit and the Beta angle 318 between the radial and circumferential vector components 312 and 314. The method further comprises adjusting at least one drilling tool assembly design parameter at 320 in response to the determined Beta angle, and repeating the simulating of the drilling tool assembly 330. The method also comprises evaluating the change in value of at least one of the Beta angle or the dynamic centerline trajectory at 340, and based on that evaluation, repeating the adjusting, the simulating, and the evaluating until at least the Beta angle parameter is optimized or the dynamic centerline trajectory is optimized.

In one embodiment the total imbalance forces may be determined and/or decreased at 316 to an acceptably small force and even minimized prior to, or concurrently with, the process for modifying or optimizing the Beta angle at 180 degrees during a major portion of the period of simulated drilling.

In one embodiment the dynamic centerline trajectory may be determined at 319. The method further comprises adjusting at least one drilling tool assembly design parameter at 320 in response to the determined dynamic centerline trajectory, and repeating the simulating of the drilling tool assembly 330. The method also comprises evaluating the change in value of at least the dynamic centerline trajectory at 340, and based on that evaluation, repeating the adjusting, the simulating, and the evaluating until at least the dynamic centerline trajectory satisfies predetermined criterion or is optimized.

As used herein "optimized" or "optimizing" means obtaining an improvement in a particular characteristic that is acceptable to the designer for the intended purposes of the drill bit design. This may, for example, satisfy criterion set by the designer for a drill bit design providing a Beta angle between imbalance force components at 180 degrees for a percentage of time that is increased by a selected amount. For example, the criterion may be an increase in the percentage time the Beta angle is at 180 degrees of about 3-%4% or more of the total time of the simulated modeling. For example, in the event that a given modeled design of a drill bit produces a Beta angle that is at 180 degrees for 17 percent of the time, the stability of the drill bit might be optimized where design parameter changes are made to produce a Beta angle at 180 degrees for 21% of the time during the same period of simulated drilling. In one embodiment of the invention it has been found that a drill bit design can be considered optimized when it produces a Beta angle at 180 degrees for more than about 20% of the time. The optimization percentage of time a Beta angle is at 180 degrees for drill bit designs can be as determined by modeling, laboratory testing, or field use to produce a consistently stable drill bit in a given type of formation or in a given variety of types of formations and for intended operating parameters. In the case of the dynamic centerline trajectory as the performance parameter considered for optimizing performance, the criterion set by the designer might be reducing the diameter of the dynamic centerline trajectory.

The reduction might be set at about 25%, 50% or 75%. In another example the criterion might be the reduction of the maximum diameter of the dynamic centerline trajectory to less than about 0.05 inches, 0.01 inches or in another example to no greater than about 0.005 inches, depending upon the tool. In another example the criterion might be changing the dynamic centerline trajectory pattern, such as eliminating a forward whirl pattern, creating a rearward whirl pattern, eliminating a pattern having inward looping, or reducing the size of a triangular shaped pattern.

Figure 11:
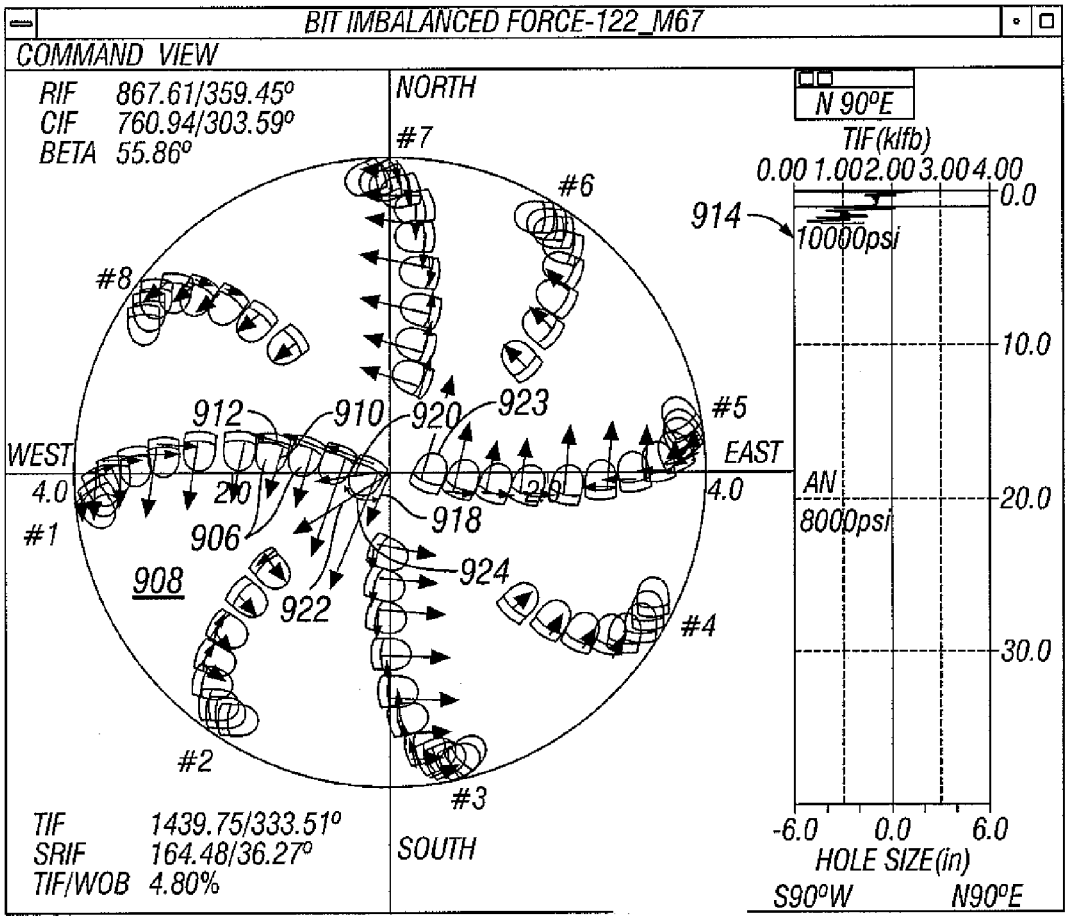
FIG. 11 shows one example of graphically displaying and modeling dynamic response of a fixed cutter drill bit drilling through different layers and through a transition between the different layers, in accordance with an embodiment of the present invention.

FIG. 11 shows one example of graphically displaying and modeling dynamic response of a fixed cutter drill bit drilling through different layers and through a transition between the different layers, in accordance with an embodiment of the present invention. Thus, embodiments of the invention can model drilling in a formation comprising multiple layers, which may include different dip and/or strike angles at the interface planes, or in an inhomogeneous formation (e.g., anisotropic formation or formations with pockets of different compositions). Thus, embodiments of the invention are not limited to modeling bit or cutter wears in a homogeneous formation.

Being able to model the wear of the cutting elements (cutters) and/or the bit accurately makes it possible to design a fixed cutter bit to achieve the desired wear characteristics. In addition, it has been found that the demand of computing power and speed can be reduced by using wear modeling conducted in a static or constrained centerline model and then inserting the wear data into a dynamic model at the appropriate times for use during a dynamic drilling modeling to update the drill bit parameters according to the simulated wear predicted with the simpler static wear model. Inventors have found that this can significantly improve the speed of the dynamic modeling computations without significantly reducing the accuracy of the drilling simulation because the wear rates and results are similar for both constrained centerline analysis and for dynamic analysis.

FIG. 1 shows a graphical depiction of a plurality of cutters 906 spatially oriented on a drill bit 908 with cutting forces 910 and radial forces 912 on each cutter. The display can be presented at increments of rotation. A sequence or rotation increments can also be displayed. As the bit 908 is sequentially rotated according to the simulation, the cutting forces 910 and the radial forces 912 on each of the individual cutters 906 will change according to the forces determined at each increment of rotation. A graphically displayed plot 914 of a selected force, for example the total imbalance force (TIF) 922, may be displayed relative to the simulated drilling depth. The components of the total imbalance force (TIF) 922 acting on the center of on the drill bit are depicted including a circumferential imbalance force vectors (CIF) 918 calculated as the vector sum of all the individual cutting forces 910, and a radial imbalance force vector RIF 920 calculated as the vector sum of all the individual radial forces 912 for all of the cutters 906 on the drill bit 908. A visual depiction of the Beta angle 924 between the total imbalance force components (CIF) 918 and (RIF) 920 is also graphically displayed.

In the case of a constrained centerline model, the graphical depiction can include dynamic movement in the axial direction while the fixed cutter drill bit is constrained about the centerline of the wellbore, but the bit is only allowed to move up and down and rotate around the well axis. Based upon the teachings of the present invention, it will be appreciated that other embodiments may be derived with or without this constraint. For example, a fully dynamic model of the fixed cutter drill bit allows for six degrees of freedom for the drill bit. Thus, using a dynamic model in accordance with embodiments of the invention allows for the prediction of axial, lateral, and torsional vibrations as well as bending moments at any point on the drill bit or along a drilling tool assembly as may be modeled in connection with designing the drill bit.

Modeling Wear of a Fixed Cutter Drill Bit

Figure 12:
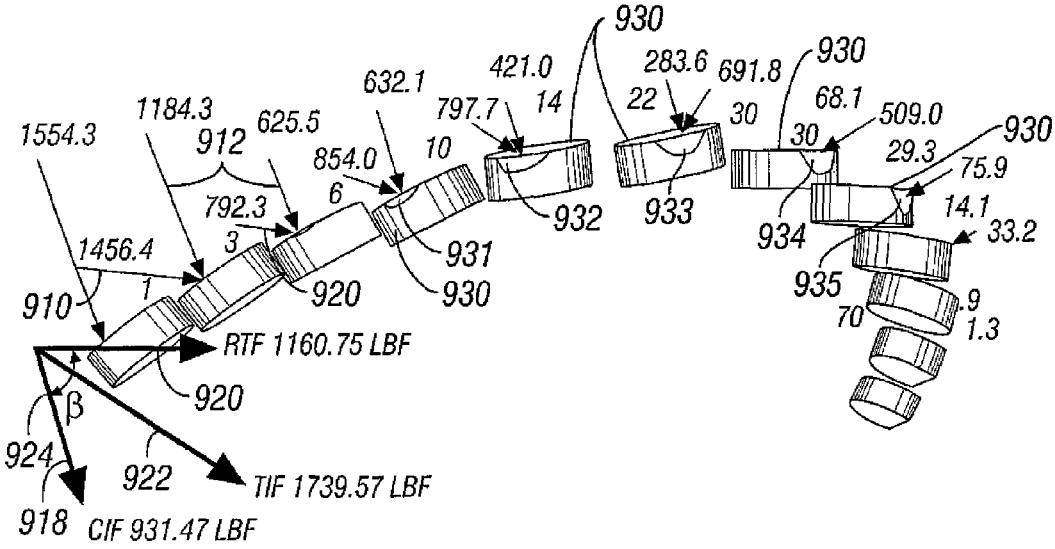
FIG. 12 shows a graphical display of a group of worn cutters illustrating different extents of wear on the cutters in accordance with an embodiment of the invention.

FIG. 12 shows a graphical display of a group of worn cutters 930 for a single blade of a drill bit, illustrating different extents of wear, for example, at 931, 932, 933, 934, and 935 on the cutters 930 in accordance with an embodiment of the invention. As noted above, cutter wear is a function of the force exerted on the cutter. In addition, other factors that may influence the rates of cutter wear include the velocity of the cutter brushing against the formation (i.e., relative sliding velocity), the material of the cutter, the area of the interference or depth of cut (d), and the temperature. Various models have been proposed to simulate the wear of the cutter. For example, U.S. Pat. No. 6,619,411 issued to Singh et al. (the '411 patent) discloses methods for modeling the wear of a roller cone drill bit.

As disclosed in the '411 patent, abrasion of materials from a drill bit may be analogized to a machining operation. The volume of wear produced will be a function of the force exerted on a selected area of the drill bit and the relative velocity of sliding between the abrasive material and the drill bit. Thus, in a simplistic model, $WR=f(F_N, v)$, where WR is the wear rate, $F_N$ is the force normal to the area on the drill bit and v is the relative sliding velocity. $F_N$, which is a function of the bit-formation interaction, and v can both be determined from the above-described simulation.

While the simple wear model described above may be sufficient for wear simulation, other embodiments of the invention may use any other suitable models. For example, some embodiments of the invention use a model that takes into account the temperature of the operation (i.e., $WR=f(F_N, v, T)$), while other embodiments may use a model that includes another measurement as a substitute for the force acting on the bit or cutter. For example, the force acting on a cutter may be represented as a function of the depth of cut (d). Therefore, $F_N$ may be replace by the depth of cut (d) in some model, as shown in equation (3):

$$WR=a1\times10^{a2}\times d^{a3}\times v^{a4}\times T^{a5} \tag{3}$$

where WR is the wear rate, d is the depth of cut, v is the relative sliding velocity, T is a temperature, and a1-a5 are constants.

The wear model shown in equation (3) is flexible and can be used to model various bit-formation combinations. For each bit-formation combination, the constants (a1-a5) may be fine tuned to provide an accurate result. These constants may be empirically determined using defined formations and selected bits in a laboratory or from data obtained in the fields. Alternatively, these constants may be based on theoretical or semi-empirical data.

The term $a1-10^{a2}$ is dependent on the bit/cutter (material, shape, arrangement of the cutter on the bit, etc.) and the formation properties, but is independent of the drilling parameters. Thus, the constants a1 and a2 once determined can be used with similar bit-formation combinations. One of ordinary skill in the art would appreciate that this term ($a1\times10^{a2}$) may also be represented as a simple constant k.

The wear properties of different materials may be determined using standard wear tests, such as the American Society for Testing and Materials (ASTM) standards G65 and B611, which are typically used to test abrasion resistance of various drill bit materials, including, for example, materials used to form the bit body and cutting elements. Further, superhard materials and hardfacing materials that may be applied to selected surfaces of the drill bit may also be tested using the ASTM guidelines. The results of the tests are used to form a database of rate of wear values that may be correlated with specific materials of both the drill bit and the formation drilled, stress levels, and other wear parameters.

The remaining term in equation (3), $d^{a3} \times v^{a4} \times T^{a5}$ is dependent on the drilling parameters (i.e., the depth of cut, the relative sliding velocity, and the temperature). With a selected bit-formation combination, each of the constants (a3, a4, and a5) may be determined by varying one drilling parameter and holding other drilling parameters constant. For example, by holding the relative sliding velocity (v) and temperature (T) constant, a3 can be determined from the wear rate changes as a function of the depth of cut (d). Once these constants are determined, they can be used in the dynamic simulation and may also be stored in a database for later simulation/modeling.

The performance of the worn cutters may be simulated with a constrained centerline model or a dynamic model to generate parameters for the worn cutters and a graphical display of the wear. The parameters of the worn cutters can be used in a next iteration of simulation. For example the worn cutters can be displayed to the design engineer and the parameters can be adjusted by the design engineer accordingly, to change wear or to change one or more other performance characteristics. Simulating, displaying and adjusting of the worn cutters can be repeated, to optimize a wear characteristic, or to optimize or one or more other performance characteristics. By using the worn cutters in the simulation, the results will be more accurate. By taking into account all these interactions, the simulation of the present invention can provide a more realistic picture of the performance of the drill bit.

Note that the simulation of the wear may be performed dynamically with the drill bit attached to a drill string. The drill string may further include other components commonly found in a bottom-hole assembly (BHA). For example, various sensors may be included in drill collars in the BHA. In addition, the drill string may include stabilizers that reduce the wobbling of the BHA or drill bit.

The dynamic modeling may also take into account the drill string dynamics. In a drilling operation, the drill string may swirl, vibrate, and/or hit the wall of the borehole. The drill string may be simulated as multiple sections of pipes. Each section may be treated as a "node," having different physical properties (e.g., mass, diameter, flexibility, stretchability, etc.). Each section may have a different length. For example, the sections proximate to the BHA may have shorter lengths such that more "nodes" are simulated close to BHA, while sections close to the surface may be simulated as longer nodes to minimize the computational demand.

In addition, the "dynamic modeling" may also take into account the hydraulic pressure from the mud column having a specific weight. Such hydraulic pressure acts as a "confining pressure" on the formation being drilled. In addition, the hydraulic pressure (i.e., the mud column) provides buoyancy to the BHA and the drill bit.

The dynamic simulation may also generate worn cutters after each iteration and use the worn cutters in the next iteration. By using the worn cutters in the simulation, the results will be more accurate. By taking into account all these interactions, the dynamic simulation of the present invention can provide a more realistic picture of the performance of the drill bit.

Figure 7:
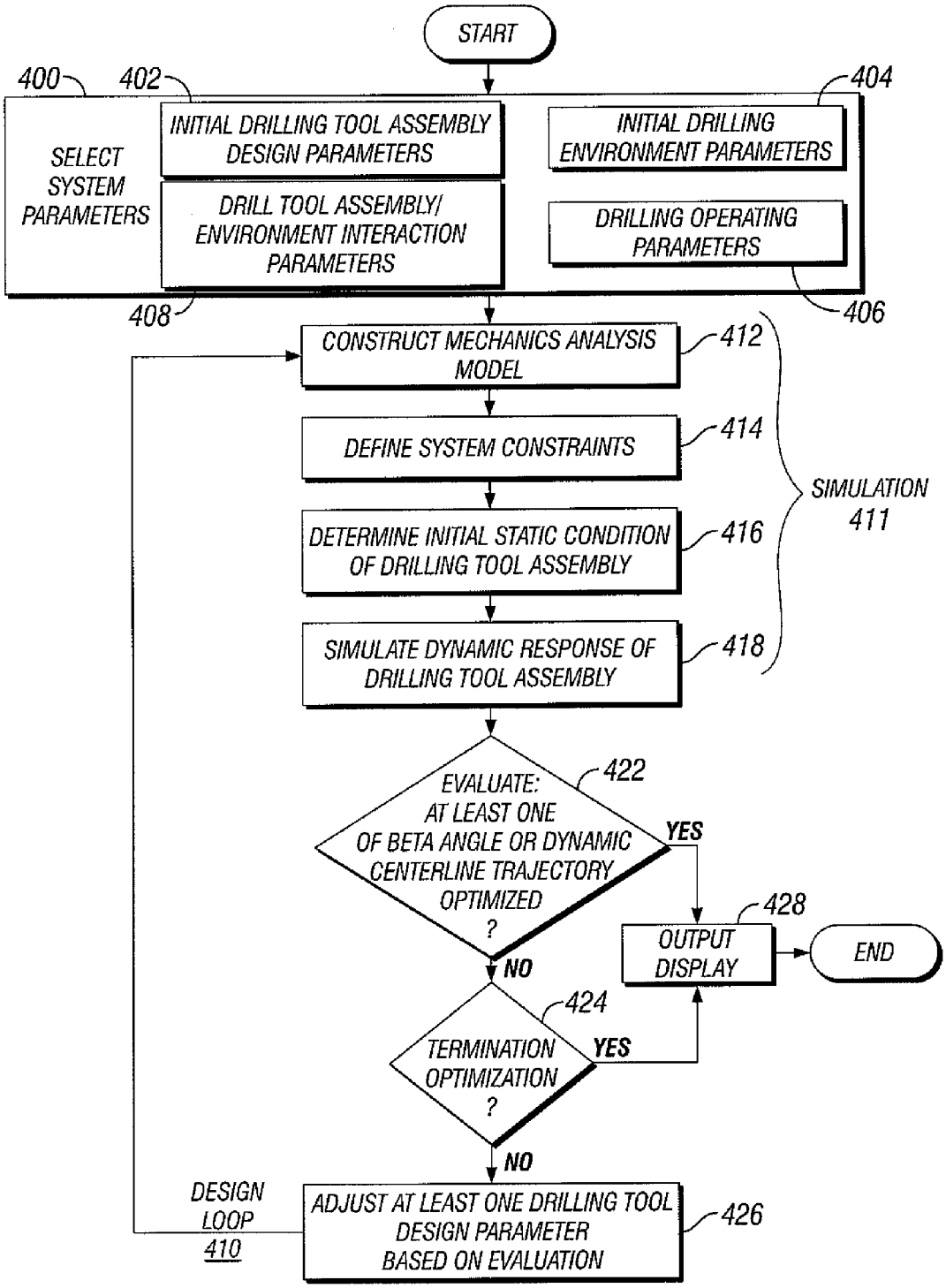
FIG. 7 shows a flow chart of one embodiment of the method for determining an optimal value of at least one drilling tool assembly design parameter in accordance with the method shown in FIG. 6.

Returning to the embodiment of FIG. 7, initial parameters 400 may include initial drilling tool assembly parameters 402, initial drilling environment parameters 404, drilling operating parameters 406, and drilling tool assembly/drilling environment interaction parameters and/or models 408. These parameters may be substantially the same as the input parameters described above for the previous aspect of the invention.

In this example, simulating 411 comprises constructing a mechanics analysis model of the drilling tool assembly 412 based on the drilling tool assembly parameters 402, determining system constraints at 414 using the drilling environment parameters 404, and then using the mechanics analysis model along with the system constraints to solve for the initial static state of the drilling tool assembly in the drilling environment 416. Simulating 411 further comprises using the mechanics analysis model along with the constraints and drilling operation parameters 406 to incrementally solve for the response of the drilling tool assembly to rotational input from a rotary table 418 and/or downhole motor, if used. In solving for the dynamic response, the response is obtained for successive incremental rotations until an end condition signaling the end of the simulation is detected.

Incrementally solving for the response may also include determining, from drilling tool assembly/environment interaction information, loads on the drilling tool assembly during the incremental rotation resulting from changes in interaction between the drilling tool assembly and the drilling environment during the incremental rotation, and then recalculating the response of the drilling tool assembly under the new constraint loads. Incrementally solving may further include repeating, if necessary, the determining loads and the recalculating of the response until a solution convergence criterion is satisfied.

Examples for constructing a mechanics analysis model, determining initial system constraints, determining the initial static state and incrementally solving for the dynamic response of the drilling tool assembly are described in detail for the previous aspect of the invention.

In the present example shown in FIG. 7, adjusting at least one drilling tool assembly design parameter 426 comprises changing a value of at least one drilling tool assembly design parameter after each simulation by data input from a file, data input from an operator, or based on calculated adjustment factors in a simulation program, for example.

Drilling tool assembly design parameters may include any of the drilling tool assembly parameters noted above. Thus in one example, a design parameter, such as the length of a drill collar, can be repeatedly adjusted and simulated to determine the effects of BHA weight and length on a drilling performance parameter (e.g., ROP). Similarly, the inner diameter or outer diameter of a drilling collar may be repeatedly adjusted and a corresponding change response obtained. Similarly, a stabilizer or other component can be added to the BHA or deleted from the BHA and a corresponding change in response obtained. Further, a drill bit design parameter may be repeatedly adjusted and corresponding dynamic responses obtained to determine the effect on the Beta angle of changing one or more drill bit design parameters, such as the cutting support structure profile (e.g., cutter layout, blade profile, cutting element shape and size, and/or orientation) on the drilling performance of the drilling tool assembly.

In the example of FIG. 7, repeating the simulating 411 for the "adjusted" drilling tool assembly comprises constructing a new (or adjusted) mechanics analysis model (at 412) for the adjusted drilling tool assembly, determining new system constraints (at 414), and then using the adjusted mechanics analysis model along with the corresponding system constraints to solve for the initial static state (at 416) of the of the adjusted drilling tool assembly in the drilling environment. Repeating the simulating 411 further comprises using the mechanics analysis model, initial conditions, and constraints to incrementally solve for the response of the adjusted drilling tool assembly to simulated rotational input from a rotary table and/or a downhole motor, if used.

Once the response of the previous assembly design and the response of the current assembly design are obtained, the effect of the change in value of at least one design parameter on at least the Beta angle over a period of simulate drilling time can be evaluated (at 422). For example, during each simulation, values of desired drilling performance parameters (WOB, ROP, impact loads, axial, lateral, or torsional vibration, etc.) can be calculated and stored. Then, these values or other factors related to the drilling response, can be analyzed to determine the effect of adjusting the drilling tool assembly design parameter on the value of the at least one drilling performance parameter.

Once an evaluation of at least one drilling parameter is made, based on that evaluation the adjusting and the simulating may be repeated until it is determined that the at least the Beta angle over a period of simulate drilling time is optimized or an end condition for optimization has been reached (at 424). The Beta angle over a period of simulated drilling time may be determined to be at an optimal value when the Beta angle is at or near 180 degrees for a percentage of time that is increased by about 3%-4% or more of the total time of the simulated modeling. For example, in the event that a given modeled design of a drill bit known to have some instability produces a Beta angle that is at 180 degrees for 17 percent of the time, the stability of the drill bit might be improved and optimized where design parameter changes are made to produce a Beta angle at 180 degrees for 21% of the time during the same period of simulated drilling. In one embodiment of the invention it has been found that a drill bit design can be considered optimized when it produces a Beta angle at 180 degrees for more than about 20% of the time. It has been found that such an optimization of the dynamic model provides improved drilling stability and thus minimized axial or lateral impact force or evenly distributed forces about the cutting structure of a drill bit. The increased average Beta angle over a period of dynamically modeled drilling simulation can indicate optimized stability of the drill bit and can also be an indicator of other performance parameters such as a maximum rate of penetration, a minimum rotary torque for a given rotation speed, and/or most even weight on bit for a given set of adjustment variables.

A simplified example of repeating the adjusting and the simulating based on evaluation of consecutive responses is as follows. Assume that the BHA weight is the drilling tool assembly design parameter to be adjusted (for example, by changing the length, equivalent ID, OD, adding or deleting components), and ROP is the drilling performance parameter to be optimized. Therefore, after obtaining a first response for a given drilling tool assembly configuration, the weight of the BHA can be increased and a second response can be obtained for the adjusted drilling tool assembly. The weight of the BHA can be increased; for example, by changing the ID for a given OD of a collar in the BHA (will ultimately affect the system mass matrix). Alternatively, the weight of the BHA can be increased by increasing the length, OD, or by adding a new collar to the BHA (will ultimately affect the system stiffness matrix). In either case, changes to the drilling tool assembly will affect the mechanics analysis model for the system and the resulting initial conditions. Therefore, the mechanics analysis model and initial conditions will have to be re-determined for the new configuration before a solution for the second response can be obtained. Once the second response is obtained, the two responses (one for the old configuration, one for the new configuration) can be compared to determine which configuration (BHA weight) resulted in the most favorable (or greater) ROP. If the second configuration is found to result in a greater ROP, then the weight of the BHA may be further increased, and a (third) response for the newer configuration) may be obtained and compared to the second. Alternatively, if the increase in the weight of the BHA is found to result in a decrease in the ROP, then the drilling tool assembly design may be readjusted to decrease the BHA weight to a value lower than that set for the first drilling tool assembly configuration and a (third) response may be obtained and compared to the first. This adjustment, recalculation, evaluation may be repeated until it is determined that an optimal or desired value of at least one drilling performance parameter, such as ROP in this case, is obtained.

Advantageously, embodiments of the invention may be used to analyze the relationship between drilling tool assembly design parameters and drilling performance in a selected drilling environment. Additionally, embodiments of the invention may be used to design a drilling tool assembly having optimal drilling performance for a given set of drilling conditions. Those skilled in the art will appreciate that other embodiments of the invention exist which do not depart from the spirit of this aspect of the invention.

Method for Optimizing Drilling Performance

In another aspect, the invention provides a method for determining optimal drilling operating parameters for a selected drilling tool assembly. In one embodiment, this method includes simulating a dynamic response of a drilling tool assembly, adjusting the value of at least one drilling operating parameters, repeating the simulating, and repeating the adjusting and the simulating until a value of at least one drilling performance parameter is determined to be an optimal value.

Advantageously, embodiments of the invention may be used to analyze the relationship between drilling parameters and drilling performance for a select drilling tool assembly drilling a particular earth formation. Additionally, embodiments of the invention may be used to optimize the drilling performance of a given drilling tool assembly. Those skilled in the art will appreciate that other embodiments of the invention exist which do not depart from the spirit of this aspect of the invention.

Further, it should be understood that regardless of the complexity of a drilling tool assembly or the trajectory of the wellbore in which it is to be constrained, the invention provides reliable methods that can be used for predicting the dynamic response of the drilling tool assembly drilling an earth formation. The invention also facilitates designing a drilling tool assembly having enhanced drilling performance, and helps determine optimal drilling operating parameters for improving the drilling performance of a selected drilling tool assembly.

In one or more embodiments, the method described above is embodied in a computer program and the program also includes subroutines for generating a visual displays representative of the performance of the fixed cutter drill bit drilling earth formations.

According to one alternative embodiment, the cutter/formation interaction may be based on data from a cutter/formation interaction model, and the cutter/formation interaction model may comprise empirical data obtained from cutter/formation interaction tests conducted for one or more cutters on one or more different formations in one or more different orientations. In alternative embodiments, the data from the cutter/formation interaction model is obtained from a numerical model developed to characterize the cutting relationship between a selected cutter and a selected earth formation. In one or more embodiments, the interaction between cutters on a fixed cutter bit and an earth formation during drilling is determined based on data stored in a look up table or database. In one or more embodiments, the data is empirical data obtained from cutter/formation interaction tests, wherein each test involves engaging a selected cutter on a selected earth formation sample and the tests are performed to characterize cutting actions between the selected cutter and the selected formation during drilling by a fixed cutter drill bit. The tests may be conducted for a plurality of different cutting elements on each of a plurality of different earth formations to obtain a "library" (i.e., organized database) of cutter/formation interaction data. The data may then be used to predict interaction between cutters and earth formations during simulated drilling. The collection of data recorded and stored from interaction tests will collectively be referred to as a cutter/formation interaction model.

Cutter/formation interaction models as described above can be used to accurately model interaction between one or more selected cutters and one or more selected earth formation during drilling. Once cutter/formation interaction data are stored, the data can be used to model interaction between selected cutters and selected earth formations during drilling. During simulations wherein data from a cutter/formation interaction library is used to determine the interaction between cutters and earth formations, if the calculated interaction (e.g., depth of cut, contact areas, engagement length, actual back rake, actual side rake, etc. during simulated cutting action) between a cutter and a formation falls between data values experimentally or numerically obtained, linear interpolation or other types of best-fit functions can be used to calculate the values corresponding to the interaction during drilling. The interpolation method used is a matter of convenience for the system designer and not a limitation on the invention. In other embodiments, cutter/formation interaction tests may be conducted under confining pressure, such as hydrostatic pressure, to more accurately represent actual conditions encountered while drilling. Cutting element/formation tests conduced under confining pressures and in simulated drilling environments to reproduce the interaction between cutting elements and earth formations for roller cone bits is disclosed in U.S. Pat. No. 6,516,293 which is assigned to the assignee of the present invention and incorporated herein by reference.

In addition, when creating a library of data, embodiments of the present invention may use multilayered formations or inhomogeneous formations. In particular, actual rock samples or theoretical models may be constructed to analyzed inhomogeneous or multilayered formations. In one embodiment, a rock sample from a formation of interest (which may be inhomogeneous), may be used to determine the interaction between a selected cutter and the selected inhomogeneous formation. In a similar vein, the library of data may be used to predict the performance of a given cutter in a variety of formations, leading to more accurate simulation of multilayered formations.

As previously explained, it is not necessary to know the mechanical properties of any of the earth formations for which laboratory tests are performed to use the results of the tests to simulate cutter/formation interaction during drilling. The data can be accessed based on the type of formation being drilled. However, if formations which are not tested are to have drilling simulations performed for them, it is preferable to characterize mechanical properties of the tested formations so that expected cutter/formation interaction data can be interpolated for untested formations based on the mechanical properties of the formation. As is well known in the art, the mechanical properties of earth formations include, for example, compressive strength, Young's modulus, Poisson's ratio and elastic modulus, among others. The properties selected for interpolation are not limited to these properties.

Returning to FIGS. 5A-C and FIG. 7, information, such as forces on cutters, weight on bit, cutter wear, imbalance force components, and Beta angle may be provided as output, at 294 of FIG. 5C and 428 of FIG. 7. The output information may include any information or data which characterizes aspects of the performance of the selected drill bit drilling the specified earth formations. For example, output information can include forces acting on the individual cutters during drilling, scraping movement/distance of individual cutters on hole bottom and on the hole wall, total forces acting on the bit during drilling, and the weight on bit to achieve the selected rate of penetration for the selected bit. As shown, output information may be used to generate a visual display of the results of the drilling simulation, at 294 of FIG. 5C and 428 of FIG. 7. The visual display can include a graphical representation of the well bore being drilled through earth formations. The visual display can also include a visual depiction of the earth formation being drilled with cut sections of formation calculated as removed from the bottomhole during drilling being visually "removed" on a display screen. The visual representation may also include graphical displays, such as a graphical display of the forces on the individual cutters, on the blades of the bit, and on the drill bit during the simulated drilling. The means used for visually displaying aspects of the drilling performance is a matter of choice for the system designer, and is not a limitation on the invention.

As should be understood by one of ordinary skill in the art, with reference again to FIGS. 5A-C or to FIG. 7 the steps within the main simulation loop 240 including steps 241-290 (FIG. 5B) and loop 410 (FIG. 7) are repeated as desired by applying a subsequent incremental rotation to the bit and repeating the calculations in the main simulation loop to obtain an updated cutter geometry (if wear is modeled) and an updated bottomhole geometry for the new incremental drilling step. Repeating the simulation loop 240 (FIG. 5B) or the simulation loop 410 (FIG. 7) as described above will result in the modeling of the performance of the selected fixed cutter drill bit drilling the selected earth formations and continuous updates of the bottomhole pattern drilled. In this way, the method as described can be used to simulate actual drilling of the bit in earth formations.

Graphically Displaying of Modeling and Simulating

According to one aspect of the invention output information from the modeling may be presented in the form of a visual representation.

Other exemplary embodiments of the invention include graphically displaying of the modeling or the simulating of the performance of the fixed cutter drill bit, the performance of the cutters or performance characteristics of the fixed cutter drill bit drilling in an earth formation. The graphically displaying of the drilling performance may be further enhanced by also displaying input parameters.

Figure 13:
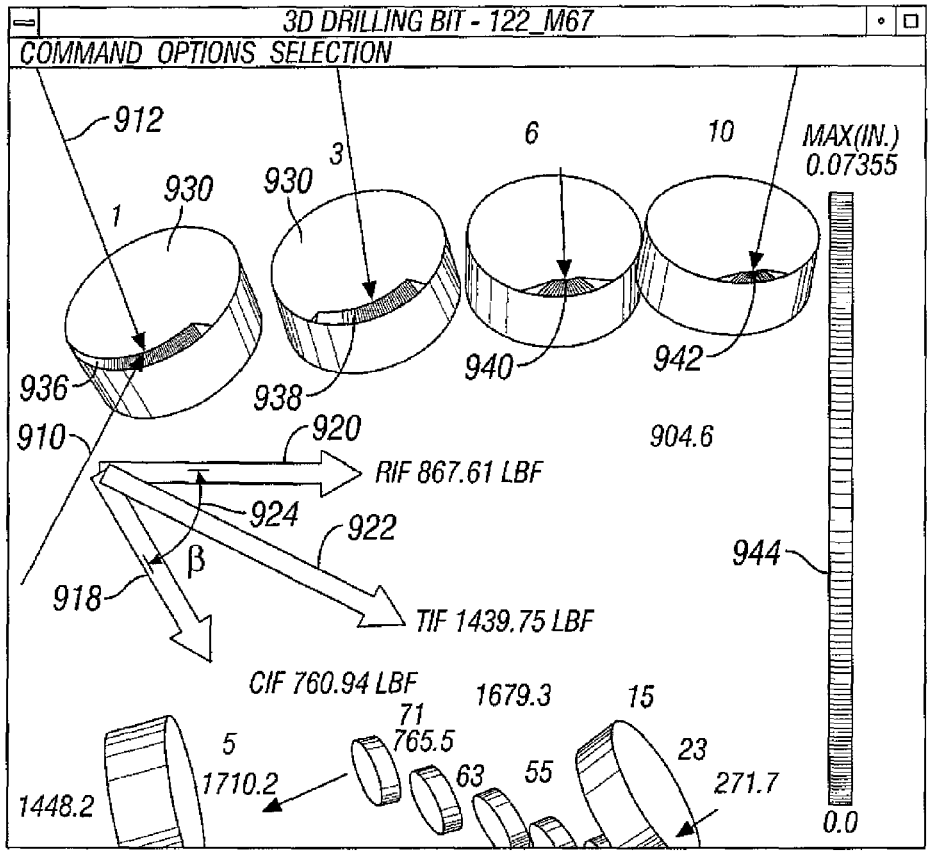
FIG. 13 shows an example of modeling and graphically displaying performance of individual cutters of a fixed cutter drill bit, for example cut area shape and distribution, together with performance characteristics of the drill bit, for example imbalance force vectors, and Beta angle between the components in accordance with an embodiment of the present invention.

FIG. 13 shows an example of modeling and of graphically displaying performance of individual cutters 930 of a fixed cutter drill bit, for example cut area shape and distribution, together with performance characteristics of the drill bit, for example total imbalance force vectors 922, and Beta angle 924 between the circumferential and radial components 918 and 920, respectively, in accordance with an embodiment of the present invention.

According to one alternative embodiment, FIG. 13 also shows an example of modeling and of graphically displaying performance of individual cutters of a fixed cutter drill bit, for example cut area shapes 936, 938, 940, and 942 and distribution of loading represented by a color coding, shown here as a the gray scale, at 944, together with performance characteristics of the drill bit, and in particular components of a total imbalance force vector (TIF) at 922, including radial imbalance force vector component (RIF) at 920 and the circumferential imbalance force vector component (CIF) at 918 of the total imbalance force. The Beta angle 924 between the forces components applied to the center of the drill bit is also depicted. In accordance with one embodiment the Beta angle 924 is presented as a performance parameter that can be visually observed by the design engineer to get a feel for the effect of any adjustments made to the drill bit design parameters. The magnitude of the forces and the directions are visually displayed. The components of imbalance forces and the components of the forces may also be displayed in a time sequence depiction to help visualize the duration of the Beta angle remaining at or above a given level for a portion of the simulated drilling time. The design engineer can select any portion of the possible information to be provided visually in such graphical displays. For example, an individual cutter can be selected; it can be virtually rotated and studied from different orientations. The design parameters of an individual cutter can be adjusted and the simulation repeated to provide another graphical display. The adjustment can be made to change the performance characteristics. The adjustments can also be made, repeatedly if necessary, to optimize a parameter or a plurality of parameters of the design for an optimum resultant Beta angle and duration of the Beta angle at or near 180 degrees.

Figure 14:
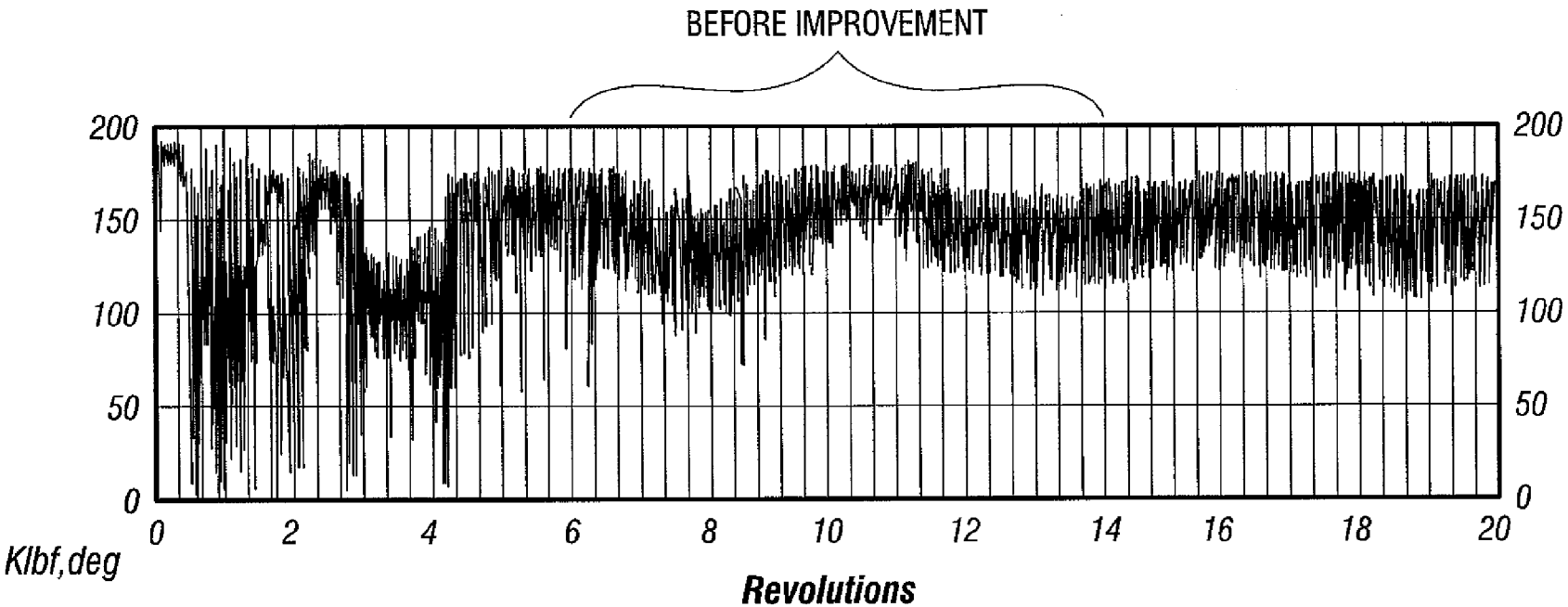
FIG. 14 shows a simulated example of modeling and graphically displaying a historic plot of a dynamic Beta angle between cut imbalance force components and radial imbalance force components for a drill bit in a drilling string in which the performance is not optimum.

FIG. 14 shows a simulated example of modeling and graphically displaying a historic plot of a dynamic Beta angle between cut imbalance force components and radial imbalance force components for a drill bit in a drilling string in which the performance is not optimum.

Figure 15:
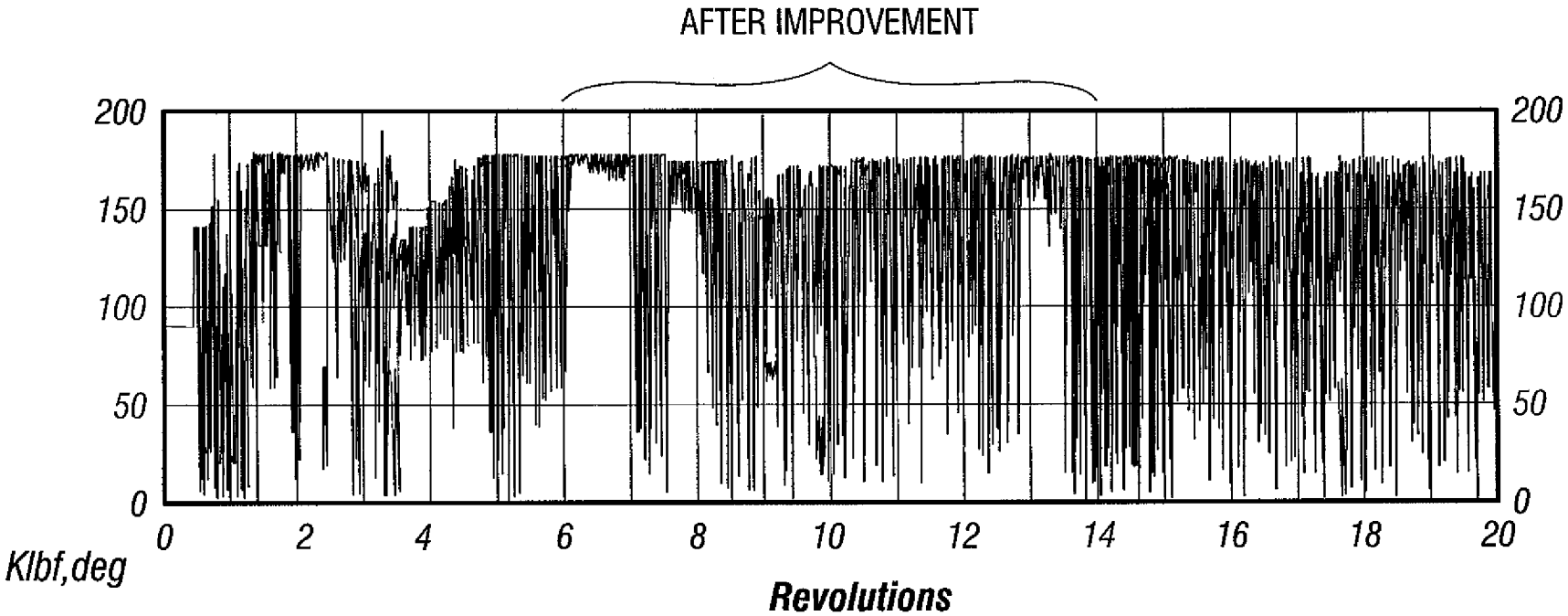
FIG. 15 shows a simulated example of modeling and graphically displaying a historic plot of a dynamic Beta angle between cut imbalance force components and radial imbalance force components for a drill bit in the same drill string as for FIG. 14 in which drill bit design was modified to increase the time during which the Beta angle is at or near 180 degrees in accordance with the present inventions.

FIG. 15 shows a simulated example of modeling and graphically displaying a historic plot of a dynamic Beta angle between cut imbalance force components and radial imbalance force components for a drill bit in the same drill string as for FIG. 14 in which drill bit design was modified to increase the time during which the Beta angle is at or near 180 degrees in accordance with the present inventions. In accordance with one embodiment of the present invention, the Beta angle in a dynamic analysis model should be at or near 180 degrees for a percentage of time that is increased by about 3%-4% or more of the total time of the simulated modeling in order to obtain a better performing drill bit. For example, in the event that a given modeled design of a drill bit produces a Beta angle that is at 180 degrees for 17 percent of the time, the stability of the drill bit might be optimized where design parameter changes are made to produce a Beta angle at 180 degrees for 21% of the time during the same period of simulated drilling. In one embodiment of the invention it has been found that a drill bit design can be considered optimized when it produces a Beta angle at 180 degrees for more than about 20% of the time. Thus, the time during which the Beta angle is at or near 180 degrees or the percentage of increments of rotation at which the Beta angle is at or near 180 degrees is a parameter of the simulated performance that has uniquely been found to facilitate fixed cutter drill bit design. It is useful to the drill bit designer to graphically display a historic plot of a dynamic Beta angle between circumferential or cut imbalance force component and radial imbalance force component.

Figure 16:
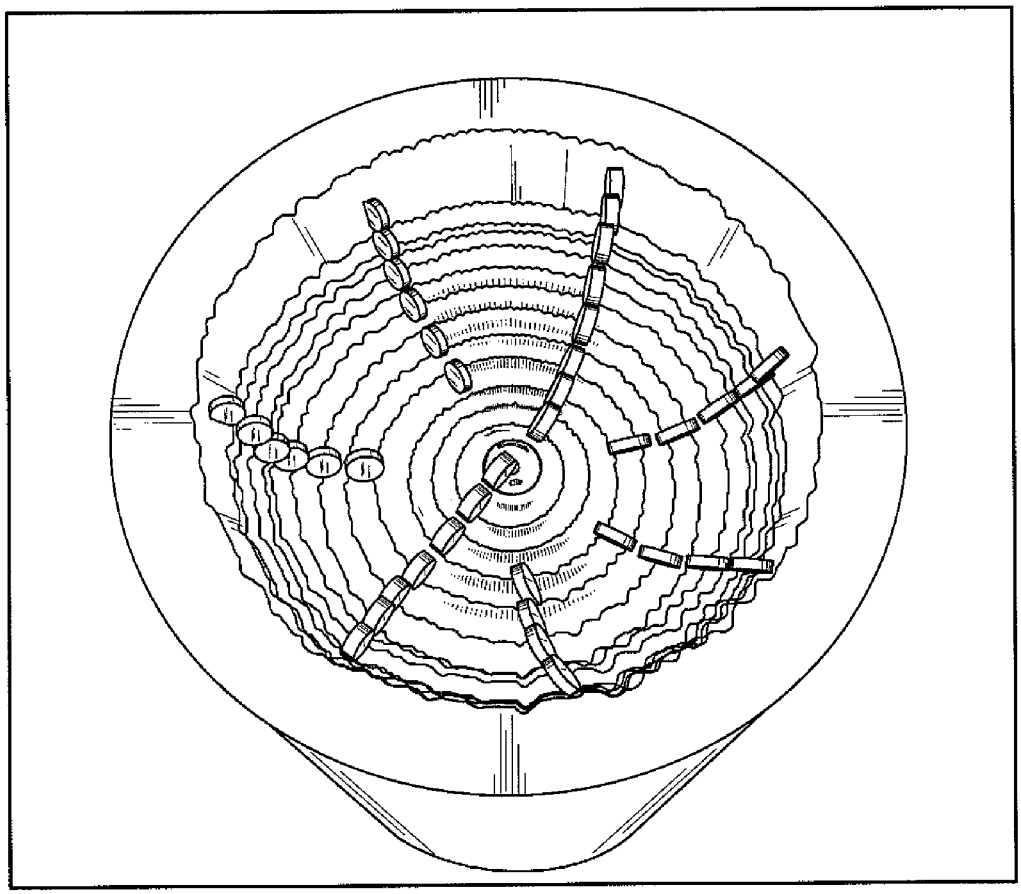
FIG. 16 shows a simulated example of a bottomhole pattern obtained with a drill bit in a drill string as in FIG. 14, before improved according to the present invention.

FIG. 16 shows a simulated example of a bottomhole pattern obtained with a drill bit in a drill string as in FIG. 14, before performance improvement according to one embodiment of the present invention. The bottom hole pattern shows an irregular or rough or chattered surface, indicative of instability while drilling.

Figure 17:
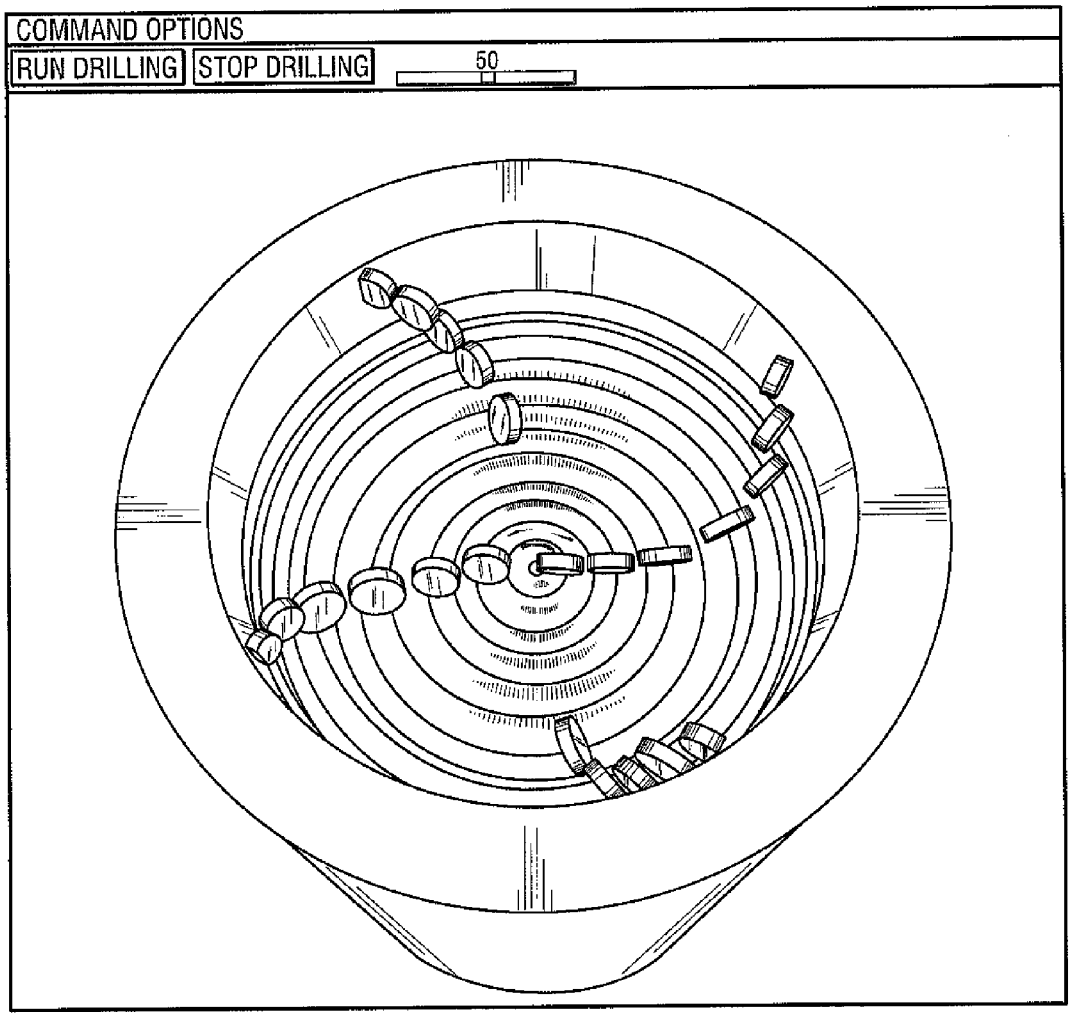
FIG. 17 shows a simulated example of a bottomhole pattern obtained with a drill bit in a drill string as in FIG. 15, after the design was modified to increase the time during which the Beta angle is at or near 180 degrees in accordance with the present inventions according to the present invention.

FIG. 17 shows a simulated example of a bottomhole pattern obtained with a drill bit in a drill string as in FIG. 15, after the design was modified to increase the time during which the Beta angle is at or near 180 degrees in accordance with one embodiment of the present invention. The bottom hole pattern shows regular and smooth circular troughs or cut path profile rings on the surface of the formation, indicative of stability while drilling.

Figure 18:
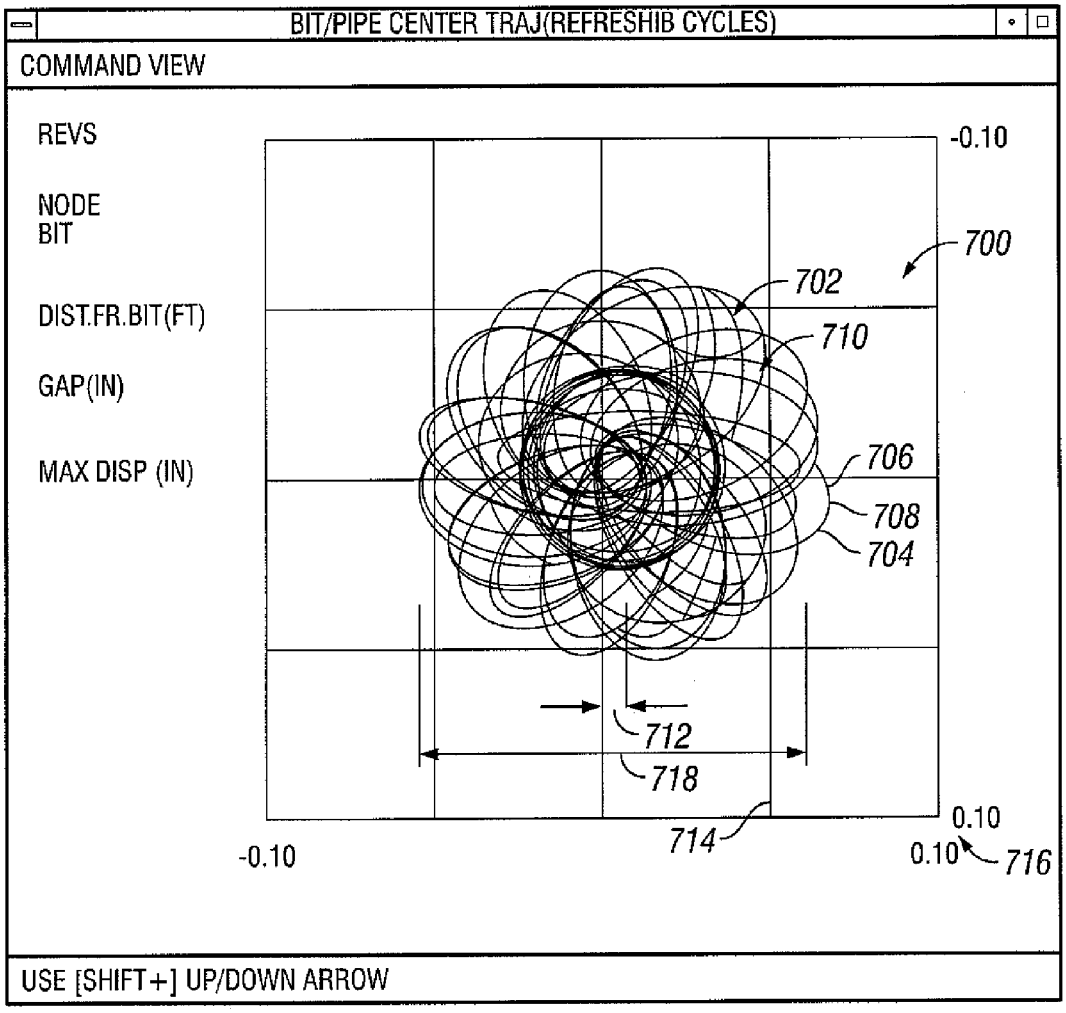
FIG. 18 shows a simulated example of modeling and graphically displaying a historic plot of a dynamic centerline trajectory for a selected interval of rotation of a fixed cutter drill bit for a drill bit in a drilling string in which the performance is not optimum.

FIG. 18 shows an example of modeling and of graphically displaying a dynamic centerline trajectory for a selected interval of rotation of a fixed cutter drill bit similar to the one for which the Beta angle plot is not optimum as in FIG. 14 and corresponding to the simulation of a bottom hole pattern depicted in FIG. 16. In accordance with one embodiment of the invention, a dynamic model of the fixed cutter drill bit allows for six degrees of freedom for the drill bit. Thus, using a dynamic model in accordance with the embodiments of the invention allows for the prediction of axial, lateral, and torsional vibrations as well as bending moments at any point on the drill bit or along a drilling tool assembly as may be modeled in connection with designing the drill bit. The graphical display 700 of the centerline trajectory 702 of the drill bit facilitates the design of a fixed cutter drill bit. The dynamic centerline trajectory 702 is calculated for one or more increments of rotation or a sequence of increments of rotation. The position of the centerline of the drill bit is indicated at each increment of simulated rotation, for example at points 704 and then one increment later at 706 with a straight line 708 connecting between the points 704 and 706 to simulate and show the dynamic centerline trajectory 702. The average offset distance 712 from the true center 710 of the bore hole of the center of the plotted trajectory is small and may be measured by the grid 714 and scale 716 in inches. The maximum dimension 718 across the plotted dynamic centerline trajectory may be referred to as the diameter 718 of the dynamic centerline trajectory. In this case the diameter of the dynamic centerline trajectory is not minimized. The depicted dynamic centerline trajectory 710 indicates that the drill bit design does not have optimum performance.

Figure 19:
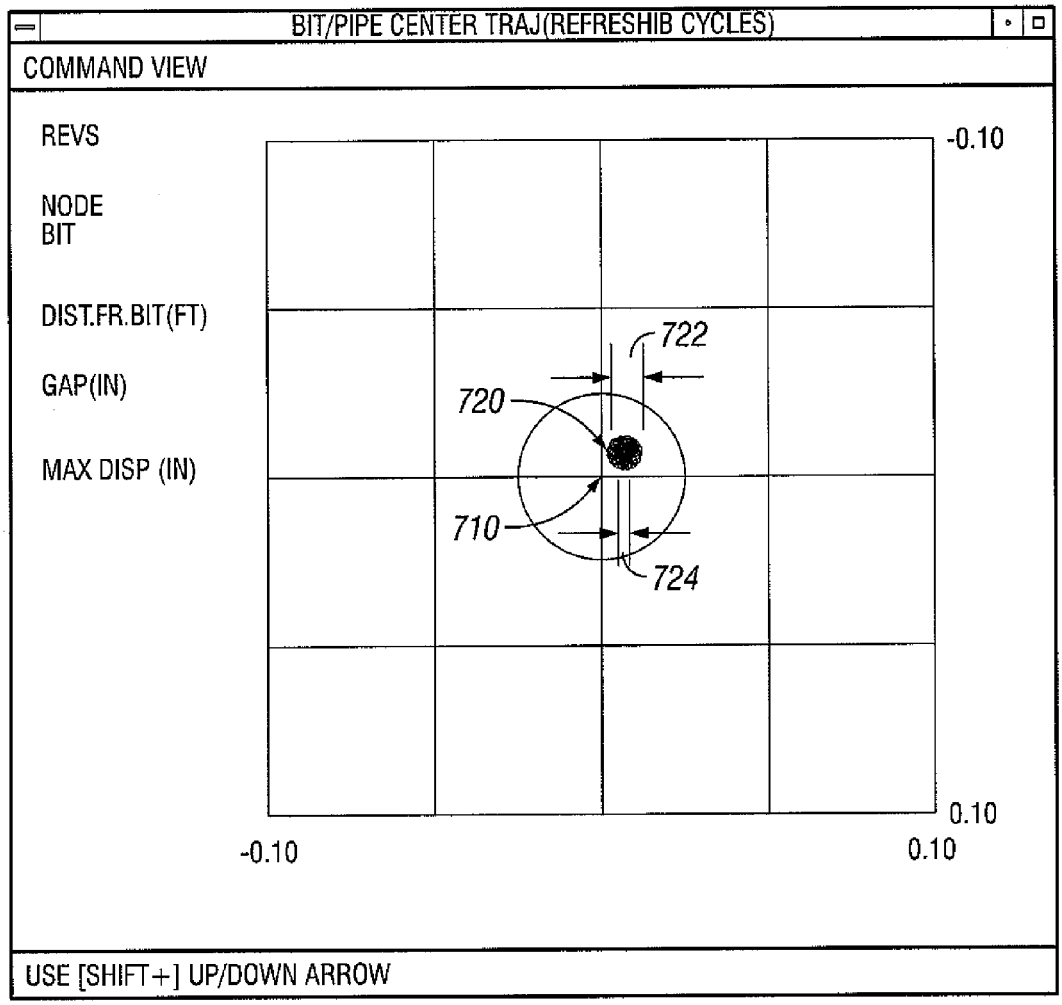
FIG. 19 shows a simulated example of modeling and graphically displaying a historic plot of a dynamic centerline trajectory for a selected interval of rotation of a drill bit in the same drill string as for FIG. 14 in which drill bit design was modified to reduce the maximum diameter of the dynamic centerline trajectory of the drill bit in accordance with the present inventions.

FIG. 19 shows an example of modeling and of graphically displaying dynamic centerline trajectory for a selected interval of rotation of a fixed cutter drill bit similar to the one simulated in FIGS. 15 and 17, in which the performance is improved. The improvement is determined as indicated above by an increased percentage of time a calculated Beta angle is at or near 180 degrees in accordance with an embodiment of the present invention. It has been discovered by the inventors that there is also a correlation between the decrease in maximum diameter 722 of the dynamic centerline trajectory 720 and improved performance of a drill bit. The offset 724 of the dynamic centerline trajectory 720 from the center 710 of the bore hole is small and the plot of the dynamic centerline trajectory 720 remains within a pattern having a small diameter 722 during the rotation of the drill bit.

Figure 20:
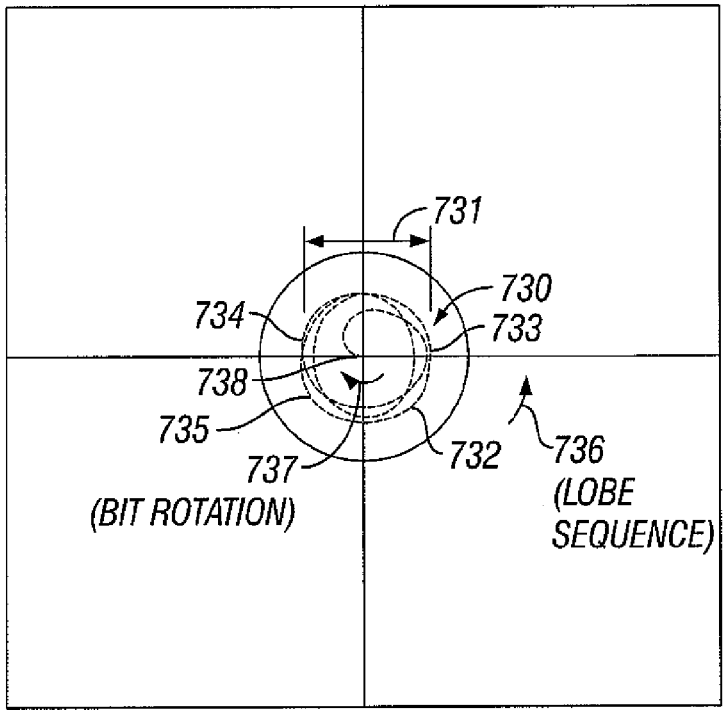
FIG. 20 shows an example of modeling and of graphically displaying dynamic centerline trajectory for a selected interval of rotation of a fixed cutter drill bit, in which maximum diameter of the dynamic centerline trajectory plot is small but that has a pattern with protruding lobes, which lobes dynamically advance in a direction opposite to the direction of drill bit rotation and that has been determined to be an example of a pattern indicating an unstable drill bit design.

FIG. 20 shows another example of modeling and of graphically displaying a dynamic centerline trajectory 730 for a selected interval of rotation of a fixed cutter drill bit according to other design parameters. The maximum diameter 731 of the dynamic centerline trajectory 730 plot is small. The pattern of the dynamic centerline trajectory 730 has protruding lobes 732 (solid line), 733 (long dashed line), 734 (long and short dashed line), and 735 (short dashed line), which lobes dynamically advance in a rotation direction 736 opposite to the direction 737 of drill bit rotation. In many instances the number of lobes corresponds to one more than the number of blades on the drill bit. It has been discovered by the inventors that a dynamic centerline trajectory pattern with lobes proceeding in a direction 736 opposite to the direction of drill bit rotation, similar to the one depicted at 730, is an example of a pattern potentially indicating an unstable drill bit design. In this context the term proceeding is understood by observing for example, that after start of rotation at the center 738 the first outwardly protruding lobe produced is lobe 732, the next lobe produce is 733, then 734, and then 735. Additional modeled rotation would continue the sequence in a reverse direction 736 around the perimeter of the pattern. Thus, according to some embodiments of the invention, adjusting drill bit design parameters to modify such a dynamic centerline trajectory pattern to avoid lobes dynamically proceeding in the direction opposite to the direction of drill bit rotation can produce a design and a drill bit with enhanced stability and/or performance. Minimizing the maximum diameter in combination with eliminating or avoiding the indicated same direction pattern for the dynamic centerline trajectory can also be beneficial.

Figure 21:
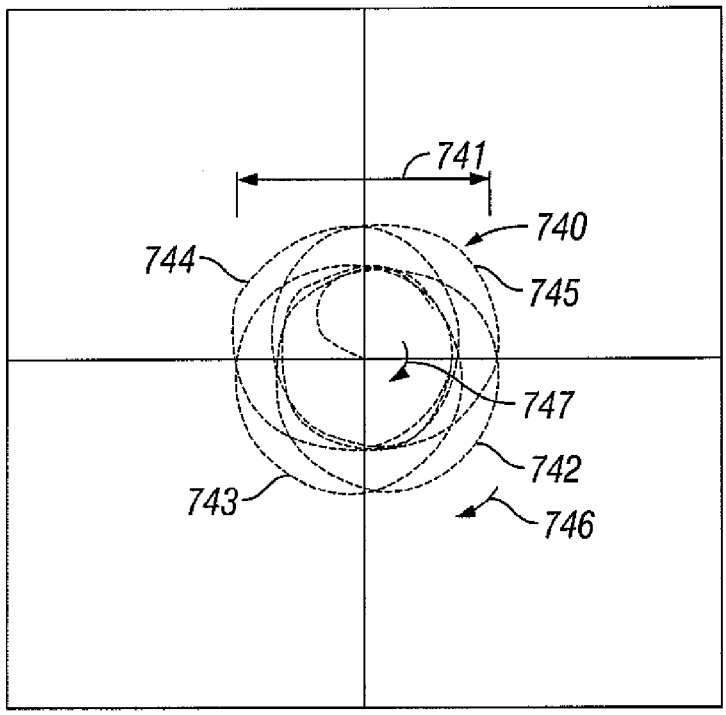
FIG. 21 shows an example of modeling and of graphically displaying dynamic centerline trajectory for a selected interval of rotation of a fixed cutter drill bit, in which maximum diameter of the dynamic centerline trajectory plot is not minimized and that has a pattern with protruding lobes, which lobes dynamically advance in the same direction as the direction of drill bit rotation and that has been determined to be an example of a pattern indicating a stable drill bit design.

FIG. 21 shows an example of modeling and of graphically displaying a dynamic centerline trajectory 740 for a selected interval of rotation of a fixed cutter drill bit according to other design parameters. The maximum diameter 741 of the dynamic centerline trajectory 740 plot is not minimized. The pattern of the dynamic centerline trajectory 740 has protruding lobes 742 (solid line), 743 (long dashed line), 744 (long and short dashed line), and 745 (short dashed line), which lobes dynamically advance in a rotation direction 746 in the same to the direction 747 of drill bit rotation. It has been discovered by the inventors that a dynamic centerline trajectory pattern with lobes proceeding in the same direction as the direction of drill bit rotation, similar to the one depicted at 740, is an example of a pattern potentially indicating a stable drill bit design. Thus, according to some embodiments of the invention, adjusting drill bit design parameters to obtain such a dynamic centerline trajectory pattern with lobes advancing in the same direction as the direction of drill bit rotation can produce a design and a drill bit with enhanced stability and/or performance. This may be the case even though the maximum diameter 741 is not minimized. Minimizing the maximum diameter 741 in combination with obtaining the indicated same direction pattern for the dynamic centerline trajectory is also beneficial.

Figure 22:
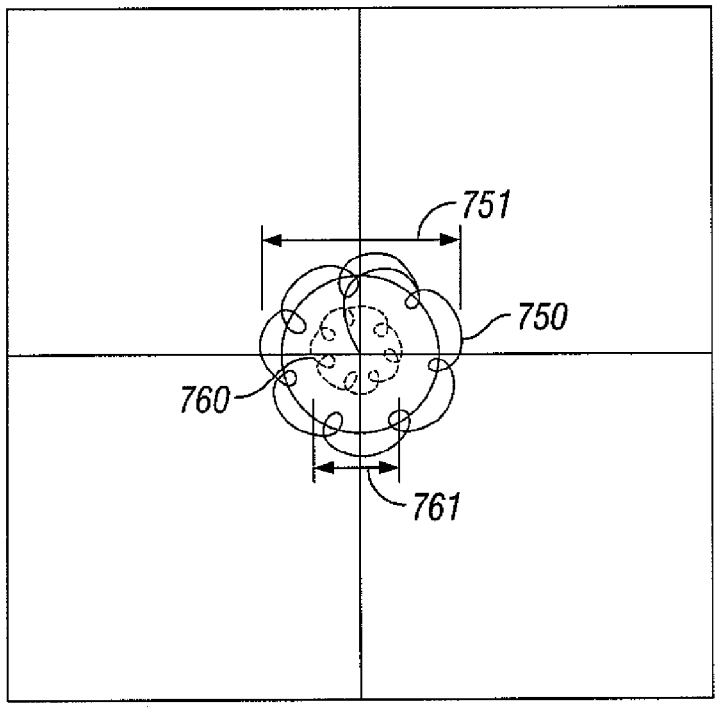
FIG. 22 shows an example of modeling and graphically displaying dynamic centerline trajectory for a selected interval of rotation of a fixed cutter drill bit, in which maximum diameter of the dynamic centerline trajectory plot is not minimized and has a inward looping pattern indicating an unstable drill bit design and a second example (indicated in dashed lines on the same drawing) in which the maximum diameter is reduced sufficiently so that a stable drill bit design is indicated.

FIG. 22 shows an example of modeling and graphically displaying a dynamic centerline trajectory 750 (solid line) for a selected interval of rotation of a fixed cutter drill bit, in which maximum diameter 751 of the dynamic centerline trajectory 750 plot is not minimized and has a inward looping pattern indicating an unstable drill bit design. A second example of a dynamic centerline trajectory 760 (indicated in dashed lines superimposed on the same drawing) in which the maximum diameter 761 is reduced sufficiently so that a stable drill bit design is indicated.

Figure 23:
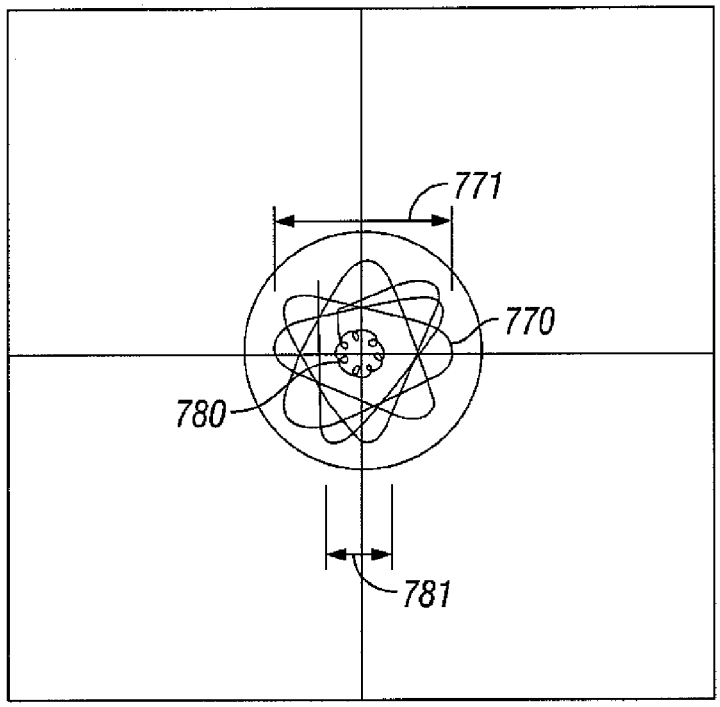
FIG. 23 shows another example of modeling and graphically displaying dynamic centerline trajectory for a selected interval of rotation of a fixed cutter drill bit, in which maximum diameter of the dynamic centerline trajectory plot is not minimized and has a generally triangular pattern indicating an unstable drill bit design and a second example (indicated in dashed lines on the same drawing) in which the maximum diameter of the dynamic centerline trajectory plot is reduced sufficiently so that a stable drill bit design is indicated.

FIG. 23 shows another example of modeling and graphically a dynamic centerline trajectory 770 (solid line) for a selected interval of rotation of a fixed cutter drill bit, in which maximum diameter 171 of the dynamic centerline trajectory plot is not minimized and has a generally triangular pattern indicating an unstable drill bit design. A second example of a dynamic centerline trajectory 780 (indicated in dashed lines superimposed on the same drawing) in which the maximum diameter of the dynamic centerline trajectory 780 plot is reduced sufficiently so that a stable drill bit design is indicated.

Figure 24:
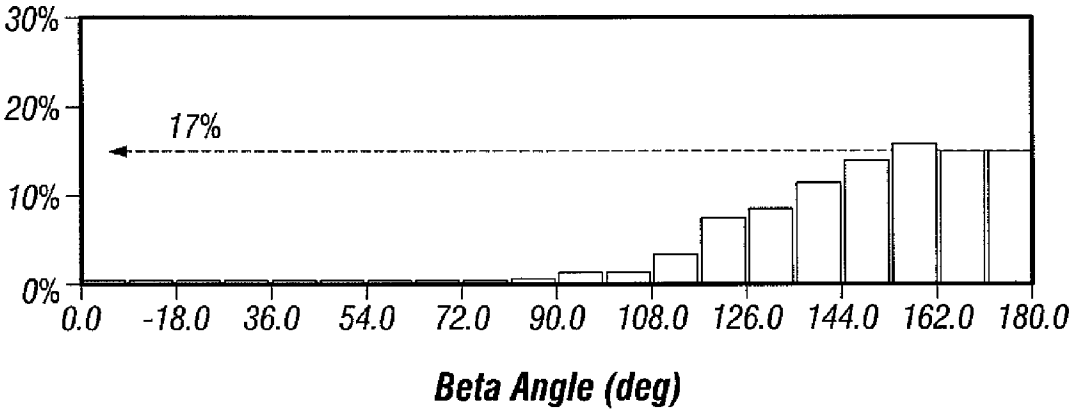
FIG. 24 shows an example of modeling and of graphically displaying a spectrum bar graph of the percent of occurrences of parameter values within given ranges of Beta angles between unbalanced force components for a fixed cutter drill bit similar to the one for which the Beta angle plot is not optimum as in FIG. 14 and that does not have optimum performance.

FIG. 24 shows an example of modeling and of graphically displaying a statistical distribution-scatter plot or bar graph of the percent of occurrences of Beta angles between unbalanced force components within given angular ranges. The fixed cutter drill bit modeled is similar to the one for which the Beta angle plot is not optimum as in FIG. 14, the bottom hole pattern is rough as in FIG. 16, the diameter of the dynamic centerline trajectory pattern is not minimized similar to the pattern shown in FIG. 18, and the performance is not optimized.

Figure 25:
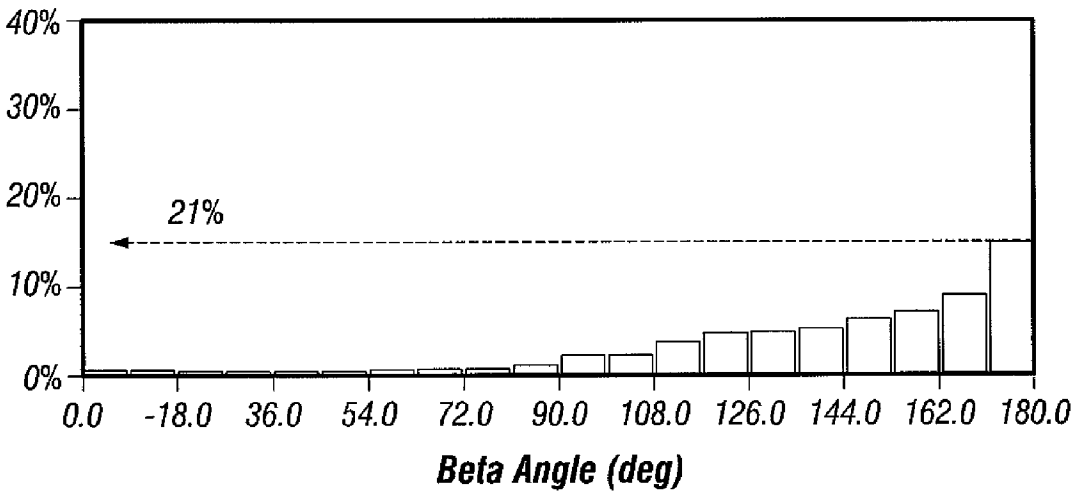
FIG. 25 shows an example of modeling and of graphically displaying a spectrum bar graph of the percent of occurrences of parameter values within given ranges of Beta angles between unbalanced force components for a fixed cutter drill bit, in which the performance is improved based upon increased percentage of time that the simulated Beta angle is at or near 180 degrees in accordance with an embodiment of the present invention.

FIG. 25 shows an example of modeling and of graphically displaying a bar graph of the percent of occurrences of parameter values within given ranges of Beta angles between imbalanced force components for a fixed cutter drill bit, in which the performance is improved based upon increased percentage of time that the simulated Beta angle is at or near 180 degrees in accordance with an embodiment of the present invention. The fixed cutter drill bit modeled is similar to the one for which the Beta angle plot improved as in FIG. 15, the bottom hole pattern shows smooth rings as in FIG. 17, the diameter of the dynamic centerline trajectory pattern is not minimized similar to the pattern shown in FIG. 19. The simulated drill bit considered to be one that provides stable drilling performance.

In one example, Beta angle results determined using a dynamic centerline analysis would indicate that an original drill bit design was found to spend about 17% of the drilling time at a Beta angle of 180 degrees. An improvement made by changing angles on five out of eight blades by +/−5 degrees in this example would cause the Beta angle to spend 21% of the drilling time at 180 degrees. The resulting improved performance and stability of the improved drill bit would have been successfully predicted. A comparison of the Beta angle results determined using a static analysis (or constrained centerline analysis) for the same proposed drill bit drilling in a formation for a period of time would indicate that in the original unimproved drill bit (case 1) would have a ratio of TIF/WOB of 2.52%; a Beta angle of 111 degrees, and a ratio of RIF/CIF of 0.82. The improved drill bit would have a TIF/WOB of 2.97%; a Beta angle of 102 degrees, and a ratio of RIF/CIF of 0.81. Thus, the static analysis would have predicted that case 1 was likely to perform better than case 2 because the TIF/WOB is lower in Case 1, the Beta angle is higher in Case 1, and the RIF/CIF is approximately the same in Case 1 and in Case 2.

Other exemplary embodiments of the invention include simulating the fixed cutter drill bit drilling in an earth formation, graphically displaying of the Beta angle magnitude and duration, adjusting a value of at least one design parameter for the fixed cutter drill bit according to the graphical display; and repeating the simulating, displaying and adjusting to increase the percentage of time that the Beta angle is at or near 180 degrees for the fixed cutter drill bit and repeating the simulating and adjusting can be used to optimize a performance characteristic.

According to another embodiment, adjusting at least one fixed cutter drill bit design parameter may be usefully included in the design of the fixed cutter drill bit. For example, at least one of the drill bit design parameters may be selected from a group of such parameters including number of cutters, bit cutting profile, position of cutters on drill bit blades, bit axis offset of the cutter, bit diameter, cutter radius on bit, cutter vertical height on bit, cutter inclination angle on bit, cutter body shape, cutter size, cutter height, cutter diameter, cutter orientation, cutter back rake angle, cutter side rake angle, working surface shape, working surface orientation, bevel size, bevel shape, bevel orientation, cutter hardness, PDC table thickness, and cutter wear model. Adjusting one or more of these parameters to increase the period of time during a period of drilling that the Beta angle is at 180 degrees has been found to facilitate the design process. A fixed cutter drill bit designed by the methods of one or more of the various embodiments of the invention has been found to be useful and particularly has been found to provide stable drilling.

It should be understood that the invention is not limited to the specific embodiments of graphically displaying, the types of visual representations, or the type of display. The parameters of the displays for the various embodiments are exemplary and for purposes of illustrating certain aspects of the invention. The means used for visually displaying aspects of simulated drilling is a matter of convenience for the system designer, and is not intended to limit the invention.

Designing Fixed Cutter Bits

In another aspect of one or more embodiments, the invention provides a method for designing a fixed cutter bit. In accordance with an embodiment of the present invention, FIG. 26 shows a flow diagram of an example of a method 950 for designing a fixed cutter drill bit, as for example, by providing initial input parameters 951, simulating performance of a fixed cutter drill bit drilling in an earth formation 952, graphically displaying at least on drilling performance characteristic to a design engineer 954, adjusting at least one parameter affecting performance or the fixed cutter drill bit 956, repeating the simulating and displaying with the adjusted parameter 958, and making 960 a fixed cutter drill bit 962 in accordance with the resulting design parameters.

A set of bit design parameters may be determined to be a desired set when the drilling performance determined for the bit is selected as acceptable. In one implementation, the drilling performance may be determined to be acceptable when the calculated imbalance force on a bit during drilling is less than or equal to a selected amount.

Figure 26:
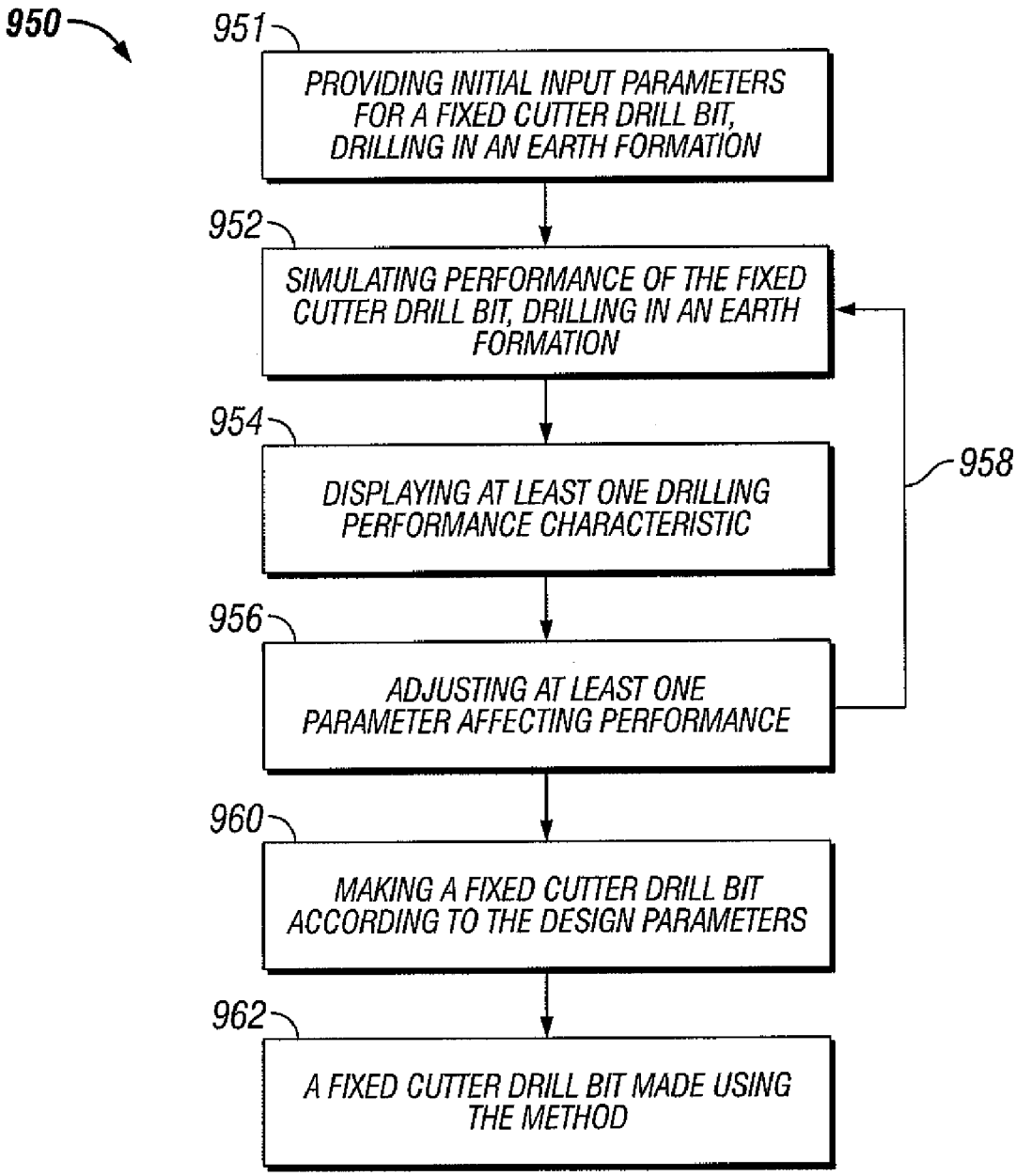
FIG. 26 shows a flow diagram of an example of a method for simulating, graphically displaying, adjusting, designing, and making a fixed cutter drill bit in accordance with an embodiment of the present invention.

Embodiments of the invention similar to the method shown in FIG. 26 can be adapted and used to analyze relationships between bit design parameters and the drilling performance of a bit. Embodiments of the invention similar to the method shown in FIG. 26 can also be adapted and used to design fixed cutter drill bits having enhanced drilling characteristics, such as faster rates of penetration, more even wear on cutting elements, or a more balanced distribution of force on the cutters or the blades of the bit. Methods in accordance with this aspect of the invention can also be used to determine optimum locations or orientations for cutters on the bit, such as to balance forces on the bit or to optimize the drilling performance (rate of penetration, useful life, etc.) of the bit.

In one or more embodiments in accordance with the method shown in FIG. 27, bit design parameters are selected at 1152 and may include the number of cutters on the bit, cutter spacing, cutter location, cutter orientation, cutter height, cutter shape, cutter profile, cutter diameter, cutter bevel size, blade profile, bit diameter, etc. and others of a type that may subsequently be altered by the design engineer. These are only examples of parameters that may be adjusted. A drill bit having those selected parameters is simulated drilling an earth formation at 1154. At 1153 the imbalance forces and the Beta angle are determined during a simulated period of drilling. The radial imbalance force vector RIF is determined by adding (vector addition) of all radial forces on all of the individual cutters summed and applied as a vector RIF to the center of the face of the drill bit. The cut direction or circumferential imbalance force vector CIF is determined by adding (vector addition) of all cut/circumferential forces on all of the individual cutters summed and applied as a vector CIF to the center of the face of the drill bit. The Beta angle is the angle between the vector forces RIF and CIF and the angle is calculated at each increment of rotation during simulated drilling to provide a historic display of the Beta angle 1155. The selected design parameters may be altered at step 1156 in the design loop 1160. Additionally, bit design parameter adjustments may be entered manually by an operator after the completion of each simulation or, alternatively, may be programmed by the system designer to automatically occur within the design loop 1160. For example, one or more selected parameters may be incrementally increased or decreased with a selected range of values for each iteration of the design loop 1160. The method used for adjusting bit design parameters is a matter of convenience for the system designer. Therefore, other methods for adjusting parameters may be employed as determined by the system designer. Thus, the invention is not limited to a particular method for adjusting design parameters.

In alternative embodiments, the method for designing a fixed cutter drill bit may include repeating the adjusting of at last one drilling parameter and the repeating of the simulating the bit drilling a specified number of times or, until terminated by instruction from the user. In these cases, repeating the "design loop" 1060 (i.e., the adjusting the bit design and the simulating the bit drilling) described above can result in a library of stored output information which can be used to analyze the drilling performance of multiple bits designs in drilling earth formations and a desired bit design can be selected from the designs simulated.

An optimal set of bit design parameters may be defined as a set of bit design parameters which produces a desired degree of improvement in drilling performance, in terms of rate of penetration, cutter wear, optimal axial force distribution between blades, between individual cutters, and/or optimal lateral forces distribution on the bit. For example, in one case, a design for a bit may be considered optimized when the resulting lateral force on the bit is substantially zero or less than 1% of the weight on bit.

To design a fixed cutter bit with respect to wear of the cutter and/or bit, the wear modeling described above may be used to select and design cutting elements. Cutting element material, geometry, and placement may be iteratively varied to provide a design that wears acceptably and that compensates, for example, for cutting element wear or breakage. For example, iterative testing may be performed using different cutting element materials at different locations (e.g., on different surfaces) on selected cutting elements. Some cutting elements surfaces may be, for example, tungsten carbide, while other surfaces may include, for example, overlays of other materials such as polycrystalline diamond. For example, a protective coating may be applied to a cutting surface to, for example, reduce wear. The protective coating may comprise, for example, a polycrystalline diamond overlay over a base cutting element material that comprises tungsten carbide.

Material selection may also be based on an analysis of a force distribution (or wear) over a selected cutting element, where areas that experience the highest forces or perform the most work (e.g., areas that experience the greatest wear) are coated with hardfacing materials or are formed of wear-resistant materials.

Additionally, an analysis of the force distribution over the surface of cutting elements may be used to design a bit that minimizes cutting element wear or breakage. For example, cutting elements that experience high forces and that have relatively short scraping distances when in contact with the formation may be more likely to break. Therefore, the simulation procedure may be used to perform an analysis of cutting element loading to identify selected cutting elements that are subject to, for example, the highest axial forces. The analysis may then be used in an examination of the cutting elements to determine which of the cutting elements have the greatest likelihood of breakage. Once these cutting elements have been identified, further measures may be implemented to design the drill bit so that, for example, forces on the at-risk cutting elements are reduced and redistributed among a larger number of cutting elements.

Further, heat checking on gage cutting elements, heel row inserts, and other cutting elements may increase the likelihood of breakage. For example, cutting elements and inserts on the gage row and heel row typically contact walls of a wellbore more frequently than other cutting elements. These cutting elements generally have longer scraping distances along the walls of the wellbore that produce increased sliding friction and, as a result, increased frictional heat. As the frictional heat (and, as a result, the temperature of the cutting elements) increases because of the increased frictional work performed, the cutting elements may become brittle and more likely to break. For example, assuming that the cutting elements comprise tungsten carbide particles suspended in a cobalt matrix, the increased frictional heat tends to leach (e.g., remove or dissipate) the cobalt matrix. As a result, the remaining tungsten carbide particles have substantially less interstitial support and are more likely to flake off of the cutting element in small pieces or to break along interstitial boundaries.

The simulation procedure may be used to calculate forces acting on each cutting element and to further calculate force distribution over the surface of an individual cutting element. Iterative design may be used to, for example, reposition selected cutting elements, reshape selected cutting elements, or modify the material composition of selected cutting elements (e.g., cutting elements at different locations on the drill bit) to minimize wear and breakage. These modifications may include, for example, changing cutting element spacing, adding or removing cutting elements, changing cutting element surface geometries, and changing base materials or adding hardfacing materials to cutting elements, among other modifications.

Further, several materials with similar rates of wear but different strengths (where strength, in this case, may be defined by factors such as fracture toughness, compressive strength, hardness, etc.) may be used on different cutting elements on a selected drill bit based upon both wear and breakage analyses. Cutting element positioning and material selection may also be modified to compensate for and help prevent heat checking.

Referring again to FIG. 27, drilling characteristics use to determine whether drilling performance is improved by adjusting bit design parameters can be provided as output and analyzed upon completion of each simulation 1054 or design loop 1060. The output may include graphical displays that visually show the changes of the drilling performance or drilling characteristics. Drilling characteristics considered may include, the rate of penetration (ROP) achieved during drilling, the distribution of axial forces on cutters, etc. The information provided as output for one or more embodiments may be in the form of a visual display on a computer screen of data characterizing the drilling performance of each bit, data summarizing the relationship between bit designs and parameter values, data comparing drilling performances of the bits, or other information as determined by the system designer. The form in which the output is provided is a matter of convenience for a system designer or operator, and is not a limitation of the present invention.

Figure 27:
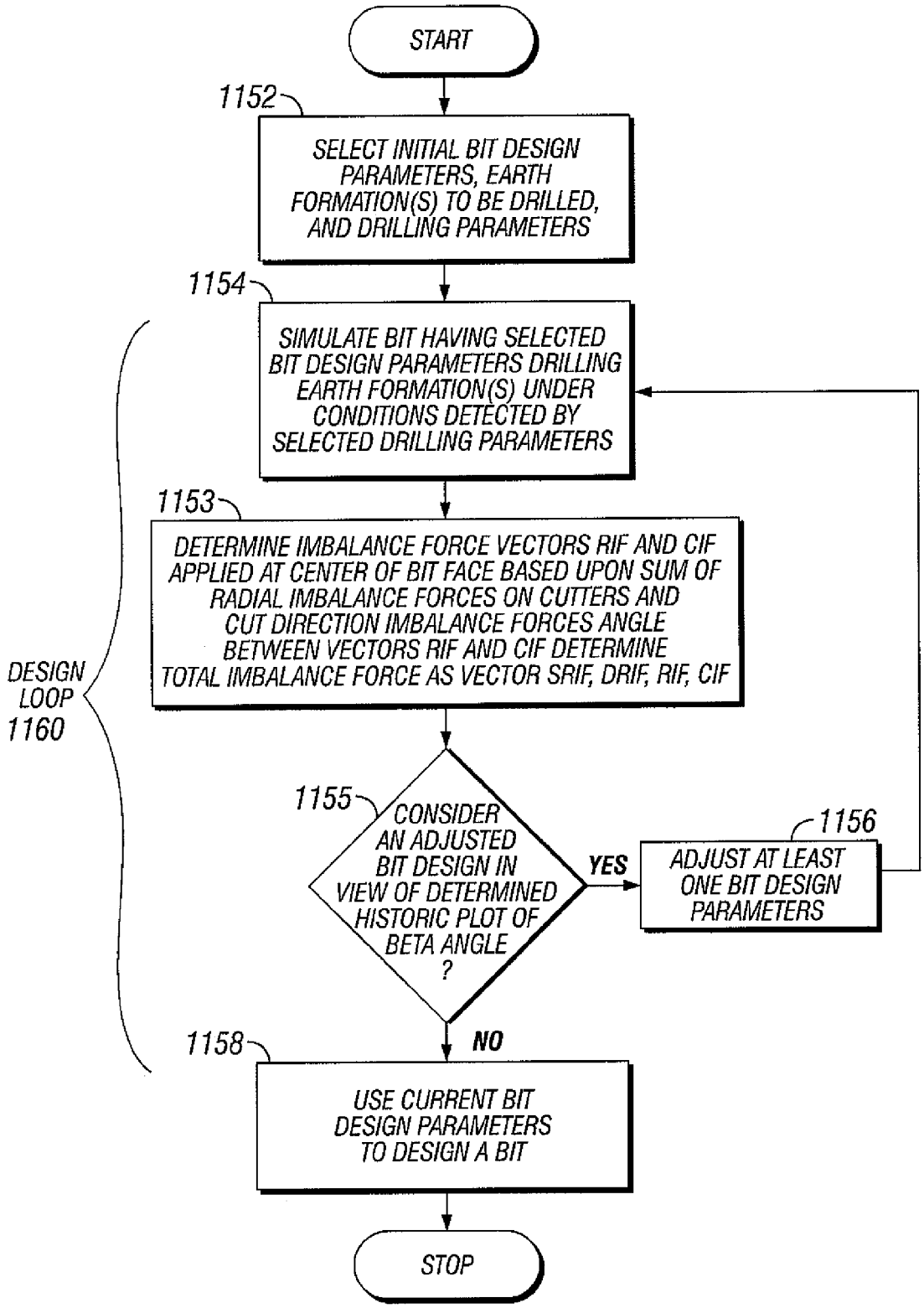
FIG. 27 shows a flow diagram of an example of a method for optimizing a drill bit design by simulating, graphically displaying, adjusting, designing, and making a fixed cutter drill bit in accordance with an embodiment of the present invention.

In one or more other embodiments, instead of adjusting bit design parameters, the method may be modified to adjust selected drilling parameters and consider their effect on the drilling performance of a selected bit design, as illustrated in FIG. 27. Similarly, the type of earth formation being drilled may be changed and the simulating repeated for different types of earth formations to evaluate the performance of the selected bit design in different earth formations.

As set forth above, one or more embodiments of the invention can be used as a design tool to optimize the performance of fixed cutter bits drilling earth formations. One or more embodiments of the invention may also enable the analysis of drilling characteristics for proposed bit designs prior to the manufacturing of bits, thus, minimizing or eliminating the expensive of trial and error designs of bit configurations. Further, the invention permits studying the effect of bit design parameter changes on the drilling characteristics of a bit and can be used to identify bit design which exhibit desired drilling characteristics. Further, use of one or more embodiments of the invention may lead to more efficient designing of fixed cutter drill bits having enhanced performance characteristics.

Optimizing Drilling Parameters

In another aspect of one or more embodiments of the invention, a method for optimizing drilling parameters of a fixed cutter bit is provided. Referring to FIG. 27, in one embodiment the method includes selecting a bit design, selecting initial drilling parameters, and selecting earth formation(s) to be represented as drilled 1152. The method also includes simulating the bit having the selected bit design drilling the selected earth formation(s) under drilling conditions dictated by the selected drilling parameters 1152. The simulating 1154 may comprise calculating interaction between cutting elements on the selected bit and the earth formation at selected increments during drilling and determining the forces on the cutting elements based on cutter/interaction data in accordance with the description above. The method further includes adjusting at least one drilling parameter 1156 and repeating the simulating 1154 (including drilling calculations) until an optimal set of drilling parameters is obtained. An optimal set of drilling parameters can be any set of drilling parameters that result in an improved drilling performance over previously proposed drilling parameters. In preferred embodiments, drilling parameters are determined to be optimal when the drilling performance of the bit (e.g., calculated rate of penetration, etc.) is determined to be maximized for a given set of drilling constraints (e.g., within acceptable WOB or ROP limitations for the system).

Methods in accordance with the above aspect can be used to analyze relationships between drilling parameters and drilling performance for a given bit design. This method can also be used to optimize the drilling performance of a selected fixed cutter bit design.

Example Alternative Embodiments

Those skilled in the art will appreciate that numerous other embodiments of the invention can be devised which do not depart from the scope of the invention as claimed. For example, alternative method can be used to account for dynamic load changes in constraint forces during incremental rotation of a drill string drilling through earth formation. For example, instead of using a finite element method, a finite difference method or a weighted residual method can be used to model the drilling tool assembly. Similarly, embodiments of the invention may be developed using other methods to determining the forces on a drill bit interacting with earth formation or other methods for determining the dynamic response of the drilling tool assembly to the drilling interaction of a bit with earth formation. For example, other method may be used to predict constraint forces on the drilling tool assembly or to determine values of the constraint forces resulting from impact or frictional contact with the wellbore.

Additionally, any wear model known in the art may be used with embodiments of the invention. Further, modified versions of the method described above for determining forces resulting from cutting element interaction with the bottomhole surface may be used, including analytical, numerical, or experimental methods. Additionally, methods in accordance with the invention described above may be adapted and used with any model of a downhole cutting tool to determine the dynamic response of a drilling tool assembly to the cutting interaction of the downhole cutting tool.

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

What is claimed is:

1. A computer implemented method for designing a fixed cutter drill bit, comprising:

dynamically modeling the fixed cutter drill bit during simulated drilling in an earth formation for a period of time;

determining radial and circumferential components of imbalance forces on the drill bit and a Beta angle between the radial and circumferential components of the imbalance force during the period of dynamically simulated drilling;

adjusting a value of at least one design parameter for the fixed cutter drill bit based upon at least the Beta angle, wherein the adjusting the value of at least one design parameter comprises adjusting the at least one parameter to increase the proportion of time the Beta angle is at or near 180 degrees by about 3% or more of the simulated drilling time; and repeating the simulating, determining, and adjusting to change a simulated performance of the fixed cutter drill bit.

2. The method of claim 1, wherein the repeating comprises:

repeating the steps of simulating, determining, and adjusting until pre-selected criteria for a proportion of time the Beta angle is at or near 180 degrees is obtained.

3. The method of claim 1, wherein the drill bit design parameters comprise at least one of number of cutters, bit cutting profile, position of cutters on drill bit blades, bit axis offset of the cutter, bit diameter, cutter radius on bit, cutter vertical height on bit, cutter inclination angle on bit, cutter body shape, cutter size, cutter height, cutter diameter, cutter orientation, cutter back rake angle, cutter side rake angle, working surface shape, working surface orientation, bevel size, bevel shape, bevel orientation, cutter hardness, PDC table thickness, and cutter wear model.

4. The method of claim 1, wherein simulating further comprises:

modeling of the drill bit dynamically drilling in the formation without constraining a centerline of the drill bit to be coaxial with a centerline of a bore hole.

5. The method of claim 1, wherein simulating further comprises:

modeling of the drill bit dynamically drilling in the formation while constraining the dynamic movement of the centerline of the drill bit based upon drill string parameters.

6. The method of claim 1, wherein the simulating comprises:

solving for a dynamic response of the drill bit to an incremental rotation using a mechanics analysis model, and repeating said solving for a select number of successive incremental rotations.

7. The method of claim 1, wherein:

the simulating comprises determining a wear pattern on a plurality of cutters on the fixed cutter drill bit over the simulated drilling time based upon a constrained centerline model and using the determined wear pattern in a dynamic centerline model for determining the total imbalance forces, circumferential and the radial components of total imbalance forces, and the Beta angle during the simulated drilling time.

8. The method of claim 1, further comprising:

adjusting a value of at least one design parameter to decrease a total imbalance force over the simulated period of drilling time.

9. The method of claim 1, further comprising:

displaying at least the Beta angle between the radial and circumferential components of the total imbalance force for the period of simulated drilling time; and the adjusting a value of at least one design parameter for the fixed cutter drill bit comprises adjusting based upon the display of the Beta angle.

10. The method of claim 9, wherein the displaying comprises graphically displaying at least the Beta angle.

11. The method of claim 10, wherein the displaying comprises graphically displaying a historical plot of at least the Beta angle over the simulated period of drilling time for a plurality of increments of simulated rotation.

12. The method of claim 10, further comprising repeating the simulating, determining, displaying, and adjusting to increase the average Beta angle over the simulated period of drilling time.

13. The method of claim 10, further comprising repeating the simulating, determining, displaying, and adjusting to increase the period of simulated drilling time at which the Beta angle is at or near 180 degrees to about 20% or more of the simulated drilling time.

14. The method of claim 10, wherein the graphically displaying comprises:

displaying a total imbalance force vector on the drill bit spatially oriented relative to at least one cutter of the drill bit, a radial imbalance force component, a circumferential force imbalance component, and a Beta angle between the radial imbalance force component and the circumferential force imbalance component.

15. The method of claim 10, wherein the graphically displaying comprises:

displaying a graphical plot of the Beta angle between the radial component of the total imbalance force vector on the fixed cutter drill bit and the circumferential component of the total imbalance force vector on the fixed cutter drill bit.

16. The method of claim 1, wherein the simulating further comprises:

determining a dynamic centerline trajectory for the drill bit during simulated drilling, and adjusting further comprises adjusting at least one drill bit design parameter based upon the dynamic centerline trajectory.

17. The method of claim 1, wherein a drill bit design is selected according to the adjusted at least one drill bit parameter.

18. A fixed cutter drill bit designed by the method of claim 1.

19. A computer implemented method for designing a fixed cutter drill bit, comprising:

dynamically modeling the fixed cutter drill bit during simulated drilling in an earth formation for a period of time;

determining a Beta angle between the total of imbalanced radial forces and the total of imbalanced circumferential forces of the fixed cutter drill bit while dynamically simulating drilling in an earth formation;

graphically displaying the Beta angle to a design engineer, for the design engineer to adjust at least one design parameter for the fixed cutter drill bit; and repeating the steps of determining, and displaying for the design engineer to adjust at least one design parameter until a period of simulated drilling time at which the Beta angle is at or near 180 degrees is increased by about 3% or more of the simulated drilling time.

20. The method of claim 19, wherein the period of simulated drilling time at which the Beta angle is at or near 180 degrees is about 20% or more of the simulated drilling time.

21. The method of claim 19, wherein a drill bit design is selected according at least one drill bit parameter adjusted by the design engineer.

22. A fixed cutter drill bit designed by the method of claim 19.

* * * * *